US007024131B2

(12) United States Patent
Komatsu et al.

(10) Patent No.: US 7,024,131 B2
(45) Date of Patent: Apr. 4, 2006

(54) PROCESS CARTRIDGE ASSEMBLING METHOD, PROCESS CARTRIDGE REMANUFACTURING METHOD, AND CONNECTING MEMBER

(75) Inventors: Noriyuki Komatsu, Shizuoka (JP); Toshiyuki Karakama, Shizuoka (JP); Toru Oguma, Shizuoka (JP); Ryuta Murakami, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 98 days.

(21) Appl. No.: 10/701,467

(22) Filed: Nov. 6, 2003

(65) Prior Publication Data

US 2004/0136746 A1 Jul. 15, 2004

(30) Foreign Application Priority Data

Nov. 8, 2002 (JP) ..... 2002-325327

(51) Int. Cl.
*G03G 15/00* (2006.01)
*G03G 15/08* (2006.01)
*G03G 21/16* (2006.01)

(52) U.S. Cl. ..... 399/109; 399/104; 399/111

(58) Field of Classification Search ..... 399/102, 399/103, 104, 105, 109, 111, 113
See application file for complete search history.

(56) References Cited

U.S. PATENT DOCUMENTS

| | | | | |
|---|---|---|---|---|
| 5,294,960 | A | 3/1994 | Nomura et al. | 355/210 |
| 5,543,898 | A | 8/1996 | Shishido et al. | 355/210 |
| 5,623,328 | A | 4/1997 | Tsuda et al. | 399/111 |
| 5,749,027 | A | 5/1998 | Ikemoto et al. | 399/113 |
| 5,828,928 | A | 10/1998 | Sasago et al. | 399/111 |
| 5,966,566 | A | 10/1999 | Odagawa et al. | 399/109 |
| 6,519,430 | B1 | 2/2003 | Higeta et al. | 399/109 |
| 6,574,445 | B1 | 6/2003 | Higeta et al. | 399/103 |
| 6,577,829 | B1 | 6/2003 | Higeta et al. | 399/109 |
| 6,658,224 | B1 | 12/2003 | Yokoi et al. | 399/113 |
| 6,754,460 | B1 * | 6/2004 | Lewis et al. | 399/109 |
| 2001/0041080 | A1 * | 11/2001 | Higeta et al. | 399/103 |
| 2002/0028087 | A1 * | 3/2002 | Higeta et al. | 399/109 |
| 2002/0131791 | A1 | 9/2002 | Yokoi et al. | 399/113 |
| 2002/0159788 | A1 | 10/2002 | Miyabe et al. | 399/109 |
| 2003/0108358 | A1 | 6/2003 | Yokoi et al. | 399/109 |
| 2003/0113131 | A1 | 6/2003 | Watanabe et al. | 399/111 |
| 2003/0161657 | A1 | 8/2003 | Yokoi et al. | 399/119 |

FOREIGN PATENT DOCUMENTS

| | | |
|---|---|---|
| JP | 6-130740 | 5/1994 |
| JP | 2000-55015 | 2/2000 |
| JP | 2001-18482 | 1/2001 |
| JP | 2003-177651 | 6/2003 |

* cited by examiner

*Primary Examiner*—Sandra L. Brase
(74) *Attorney, Agent, or Firm*—Fitzpatrick, Cella, Harper & Scinto

(57) ABSTRACT

A simple method for remanufacturing a process cartridge which includes removing a first cover, removing a second cover, separating frames, removing a fixing pin, removing a developing roller, refilling developer, positioning provisionally a supporting frame to a developing frame, attaching the developing roller, attaching the supporting frame, connecting a first frame and connecting a second frame.

19 Claims, 49 Drawing Sheets

PROCESS CARTRIDGE ASSEMBLING METHOD, PROCESS CARTRIDGE REMANUFACTURING METHOD, AND CONNECTING MEMBER

BACKGROUND OF THE INVENTION

1. Field of the Invention

The present invention relates to a method of remanufacturing a process cartridge that is attached in a detachable manner to a main body of an electrophotographic image forming apparatus, a method of assembling a process cartridge, and a connecting member.

Here, the electrophotographic image forming apparatus forms an image on a recording medium by using an electrophotographic image forming method. Examples of the electrophotographic image forming apparatus include an electrophotographic copying machine, an electrophotographic printer (such as a laser beam printer or an LED printer), a facsimile device and a word processor.

In addition, a process cartridge is a cartridge in which charging means, developing means or cleaning means is integrated with an electrophotographic photosensitive member, and which can be attached to or detached from the main body of the electrophotographic image forming apparatus.

2. Related Background Art

Conventionally, for an image forming apparatus using an electrophotographic image forming process, a process cartridge system is adopted in which the electrophotographic photosensitive member and process means that acts on the electrophotographic photosensitive member are integrated as a cartridge, which is attached in a detachable manner to the main body of the electrophotographic image forming apparatus. According to this process cartridge system, maintenance of the apparatus can be performed by a user without a service person, so that usability can be improved largely.

Such a process cartridge is used for forming an image on a recording medium utilizing a developer. Therefore, as images are formed, the developer is consumed. When the developer is consumed and it becomes impossible to form an image having a quality good enough to satisfy a user who bought a process cartridge, the process cartridge looses its value.

Conventionally, it is desired to realize a simple remanufacture method of a process cartridge that can remanufacture a process cartridge that lost its value as the developer was consumed. It is also desired to realize a simple assembling method of a process cartridge.

Therefore, as the conventional remanufacturing method and the assembling method of a process cartridge, there are methods described in U.S. Pat. Nos. 6,519,430 and 5,966,566. In these methods, for a cartridge having a structure in which a developer frame or a developing frame and a drum frame are connected in a rotatable manner, a pin or others that connects the both members is removed so as to explode a main body of the cartridge for remanufacture.

Another conventional method is disclosed in Japanese Patent Application Laid-open No. 6-130740. In this method, the cartridge has plural frames that can be separated from each other. A developer frame and a developing frame are separated from each other for remanufacture and assembly.

An ultrasonic welding method is used for bonding frames that constitute a process cartridge. The ultrasonic welding method is also used for bonding the developing frame and the developer frame for containing the developer. A support frame for supporting a developing roller is attached to the developing frame in a movable manner (see U.S. patent application Publication No. 02-159788).

In addition, there is another conventional remanufacturing and assembling method of a process cartridge having a frame connection portion by a resin connection, in which a resin connection portion is cut off and then the frames are connected again using a spacer at the connection portion (Japanese Patent Application Laid-open No. 2001-18482).

Furthermore, there are other conventional methods for remanufacturing and assembling two parts on purpose of improving remanufacture property. One is a method of using a supporting member made of a resin for attaching a casing cover of an electronic apparatus as disclosed in Japanese Patent Application Laid-open No. 2000-55015. Another method uses a bonding member made of an elastomer having a wave-like portion as disclosed in U.S. Pat. No. 6,574,445.

Furthermore, there is another conventional remanufacturing method for recycling a process cartridge, in which cleaning means is removed from the process cartridge and replaced with new one. First, screws that fix the cleaning means to a frame are removed, and then the cleaning means is removed. In addition, there is a remanufacturing and assembling method in which new cleaning means is fixed to a frame using screws (see U.S. Pat. No. 6,577,829 and Japanese Patent Application Laid-open No. 2003-177651).

SUMMARY OF THE INVENTION

An object of the present invention is to provide a simple method for remanufacturing a process cartridge, a simple method for assembling a process cartridge, and a connecting member for the methods.

It is another object to provide a method of remanufacturing a process cartridge, in which a process cartridge that lost its value as developer was consumed can be used again as merchandise.

It is yet another object of the present invention to provide a method of remanufacturing a process cartridge that is detachably attachable to a main body of an electrophotographic image forming apparatus, the method including:

(a) a first cover removing step of removing a first cover member from a drum frame and one of a developing frame and a developer frame on one end side in a longitudinal direction of the process cartridge;

(b) a second cover removing step of removing a second cover member on the other end side in the longitudinal direction of the process cartridge;

(c) a frame separating step of separating one of the developing frame and the developer frame from the drum frame;

(d) a pin removing step of separating the developing frame from the first end cover by removing the pin;

(e) a developing roller removing step of removing the first end cover and the second end cover from the supporting frame to remove the developing roller;

(f) a developer refilling step of refilling a developer in a developer containing portion through a developer supply opening of the developer frame that is exposed by removing the developing roller from the supporting frame;

(g) a step of provisionally positioning the supporting frame on the developing frame;

(h) a developing roller fixing step of rotatably attaching the developing roller by attaching the first end cover and the second end cover to the supporting frame;

(i) a supporting frame attaching step of rotatably connecting the first end cover to the developing frame by attaching the fixing pin;

(j) a first frame connecting step of positioning and fixing a drum frame and one of the developing frame and a developer frame by the first cover member on one end side in a longitudinal direction thereof; and (k) a second frame connecting step of positioning and fixing a drum frame and one of the developing frame and the developer frame by the second cover member on the other end side in the longitudinal direction thereof.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Hereinafter, embodiments of the present invention will be described with reference to drawings.

In the following description, a short side direction of a process cartridge C means the direction in which the cartridge C is attached to or removed from an apparatus main body 200. The short side direction is the same as the direction in which the recording medium is fed.

Furthermore, a longitudinal direction of the cartridge C is the direction crossing (substantially perpendicular to) the direction in which the cartridge C is attached to or removed from the apparatus main body 200. The longitudinal direction is parallel with a surface of a recording medium and is the direction crossing the feeding direction of the recording medium.

<Entire Structure of Image Forming Apparatus>

Figure 1:
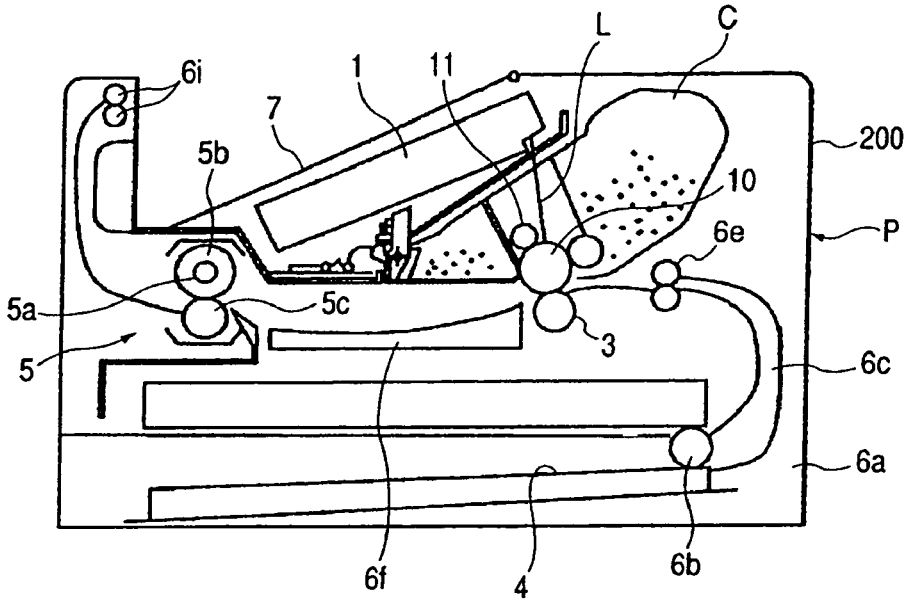
FIG. 1 is a vertical cross section of an electrophotographic image forming apparatus.

First, with reference to FIG. 1, the entire structure of an electrophotographic image forming apparatus will be described. A laser bean printer P shown in FIG. 1 forms an image on a recording medium 4 (such as a recording sheet of paper, an OHP sheet, a cloth) utilizing an electrophotographic image forming process. A surface of a photosensitive drum 10 that is a drum-like electrophotographic photosensitive member is charged by a charging roller 11 uniformly. The photosensitive drum 10 is irradiated with a laser beam L corresponding to image information from an optical means 1. Thus, an electrostatic latent image corresponding to image information is formed on the photosensitive drum 10. The formed latent image is developed by developing means that will be described later. Thus, a toner image is formed.

On the other hand, in synchronization with formation of the toner image, the recording medium 4 set in a feeding cassette 6*a* is fed by a pick up roller 6*b*, a feeding guide 6*c* and a resist roller pair 6*e*. After that, the recording medium 4 passes through a nip portion between the photosensitive drum 10 and a transfer roller 3 to which a constant voltage is applied. On this occasion, the toner image that is formed on the photosensitive drum 10 is transferred onto the recording medium 4. The recording medium 4 that received the transferred toner image is fed to a fixing means 5 by a feeding guide 6*f*. This fixing means 5 includes a fixing roller 5*b* that houses drive rollers 5*c* and 5*a*. Heat and pressure are applied to the recording medium 4 passing through another nip portion between the rollers 5*b* and 5*c*. In this way, the toner image is fixed on the recording medium 4. After that, the recording medium 4 is fed by a delivery roller pair 6*i* and is delivered to a delivery tray 7.

<Process Cartridge>

Next, the cartridge C will be described with reference to FIG. 2. Furthermore, a structure of the cartridge C and a method of assembling the cartridge C will be described as follows.

Figure 2:
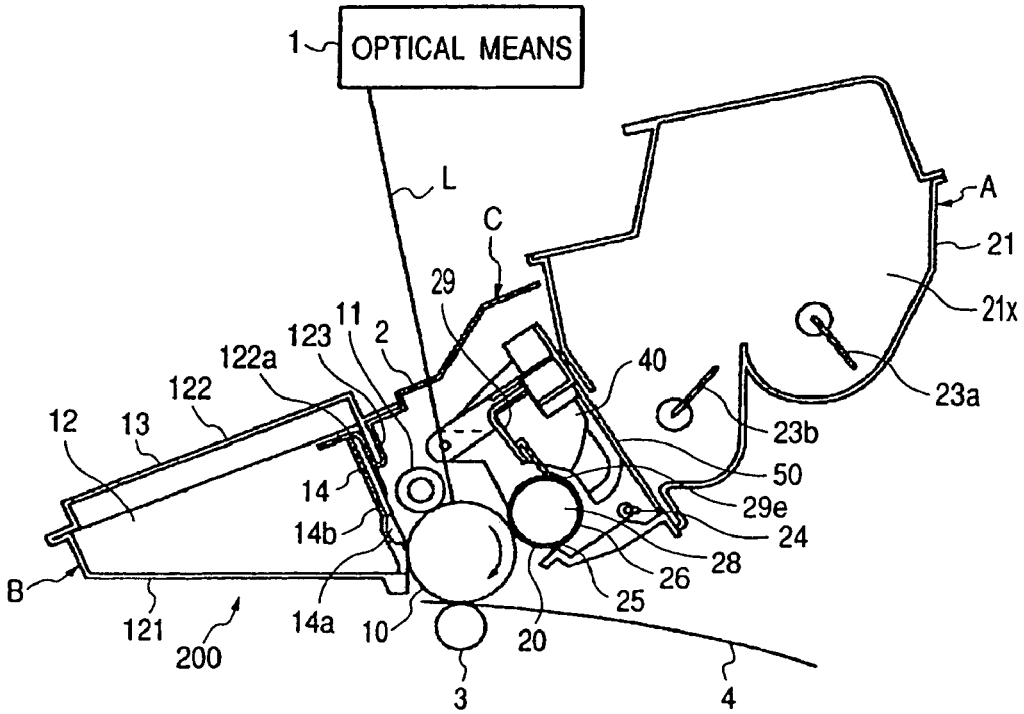
FIG. 2 is a cross section of a process cartridge according to an embodiment mode of the present invention.

In FIG. 2, a developing device unit A includes a developer frame 21 for containing developer (hereinafter, referred to as toner), a developing roller 20 for feeding toner to an electrostatic latent image formed on the photosensitive drum 10 so as to form a visible image, a developing blade 29 for applying a confliction electrostatic charge to the toner so that a toner layer is formed on a surface of the developing roller 20, and the like. In addition, at a lower opening between the developing roller 20 and a developing frame 50, a prevention sheet 25 is provided for sealing the opening. The sheet 25 prevents leakage of toner in the lower direction of the developing roller 20.

The developing means supplies the toner in the developer frame 21 to the developing roller 20 by rotation of toner feeding members 23*a* and 23*b*. Then, the toner makes the developing roller 20 housing a stationary magnet 28 rotate and is charged with an friction electrostatic charge by a blade 29*e* that is formed integrally with the developing blade 29 or is bonded to the same. Then a toner layer having a controlled thickness is formed on the surface of the developing roller 20 by the blade 29*e*. The developing roller 20 keeps a clearance via a spacer runner 26 and is pressed to the photosensitive drum 10 by a biasing spring 32 (see FIG. 7). Then, the developing roller 20 supplies the toner layer formed on the surface to a developing area of the photosensitive drum 10. The toner is transferred onto the photosensitive drum 10 in accordance with the electrostatic latent image. As a result, a toner image is formed. In addition, a toner agitating member 24 for circulating the toner inside a developing chamber is attached in a pivotable manner to the vicinity of the developing roller 20.

In FIG. 2, a photosensitive unit B of the cartridge C includes the photosensitive drum 10 for forming an electrostatic latent image, the charging roller 11 for charging a surface of a photosensitive layer uniformly, and the cleaning blade 14 for removing residual toner sticking on the photosensitive drum 10 without being transferred onto the recording medium 4 so that the toner is stocked in a waste toner container (a removed developer storage portion) 12.

In FIG. 2, the photosensitive drum 10 rotates in the clockwise direction. A constant voltage is applied to the charging roller 11. Therefore, the charging roller 11 charges uniformly the surface of the photosensitive layer on the photosensitive drum 10 that contacts the charging roller 11. Then, the photosensitive drum 10 is irradiated with a laser beam L from the optical means 1 corresponding to image information through an exposure opening 2. Thus, an electrostatic latent image is formed on the photosensitive drum 10. After that, a toner image is formed on the photosensitive drum 10 by the developing means.

A voltage having a polarity opposite to that of the toner image is applied to the transfer roller 3 that is provided to the image forming apparatus main body so that the toner image formed on the photosensitive drum 10 is transferred onto the recording medium 4. After that, residual toner on the photosensitive drum 10 is removed by the blade 14. The blade 14 scrapes the residual toner on the photosensitive drum 10 by the blade 14*a* that is provided so as to abut the photosensitive drum 10, and collects the toner in the waste toner container 12.

<Structure of Housing of Cartridge C>

Next, a structure of a housing of a cartridge C according to the embodiment will be described. The cartridge C shown in this embodiment includes the developing device unit A and the photosensitive unit B that are integrated as a unit. The developing device unit A includes the developer frame 21 and the developing frame 50 connected to each other and further includes the supporting frame 40 for supporting the developing blade 29 that is connected to the same. The photosensitive unit B includes a drum frame 13 housing the photosensitive drum 10, the charging roller 11, the cleaning blade 14 and others. This cartridge C is attached to a cartridge attachment means that are provided to the apparatus main body 200 in a detachable manner.

(Description of Developing Device Unit A)

As shown in FIG. 2, the unit A includes the developer frame 21 and the developing frame 50.

Figure 3:
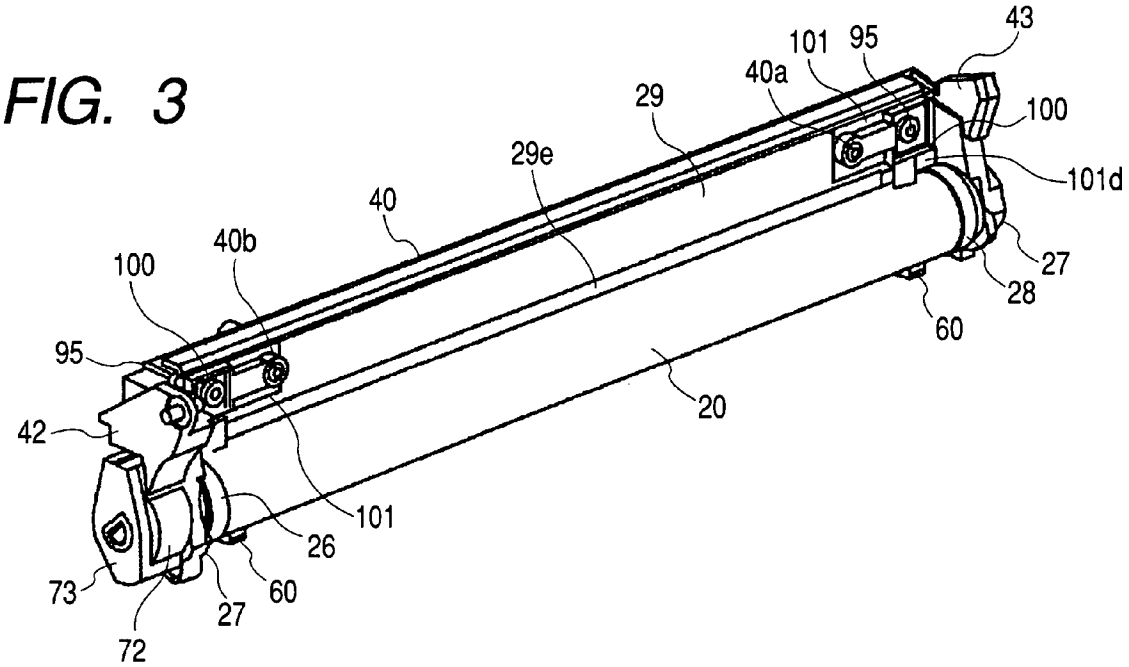
FIG. 3 is a perspective view of a supporting frame according to an embodiment mode of the present invention.
Figure 4:
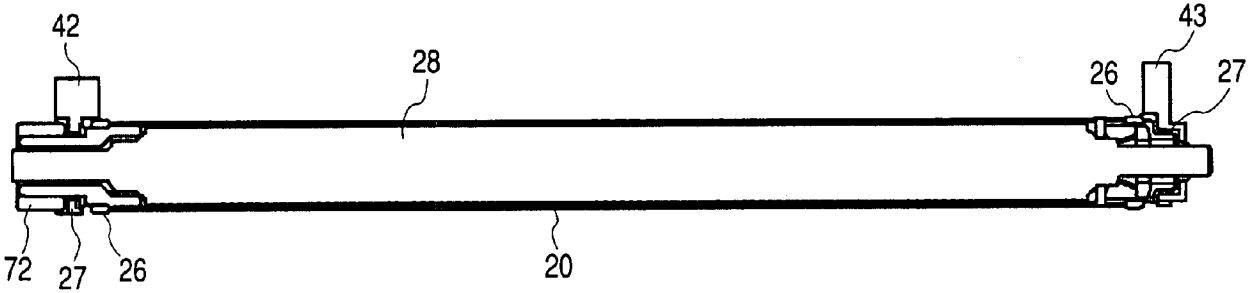
FIG. 4 is a cross section of a developing roller according to an embodiment mode of the present invention.

As shown in FIGS. 3 and 4, the supporting frame 40 has a first end cover 42 and a second end cover 43 at both ends. The members are fixed and retain the developing roller 20 and the developing blade 29. The developing roller 20 is rotatably supported by the first end cover 42 and the second end cover 43 respectively at both ends in a rotatable manner via bearings 27. The spacer runner 26, which has substantially the same axis as the developing roller 20 and an outer diameter larger than that of the developing roller 20 by a necessary gap between the photosensitive drum 10 and the developing roller 20, is provided to both ends of the developing roller 20 in a slidable manner. The developing blade 29 engages positioning bosses 40*a* and 40*b* of the supporting frame 40 so as to be positioned. Then, the blade 29 is fixed by a screw 95. The tip of the blade 29*e* abuts the developing roller 20.

At one end of the developing roller 20, there are provided a developing roller gear 72 for transmitting rotation drive power to the developing roller 20, a dropout stopper of the developing roller gear 72, and a fixing member 73 for determining a phase of the stationary magnet 28 housed in the developing roller 20. A toner regulating member 100 that scrapes the toner on the end of developing roller 20 forward the inner in the longitudinal direction is provided at each end of the developing blade 29 in the longitudinal direction.

In addition, a thin plate roller scraper 101 is provided between the developing blade 29 and the toner regulating member 100. The tip 101*d* of the scraper 101 abuts the runner 26. Thus, the roller scraper 101 scrapes the toner and dust sticking to the runner 26. Therefore, the scraper 101 can prevent a distance between the photosensitive drum 10 and the developing roller 20 from fluctuating.

Figure 5:
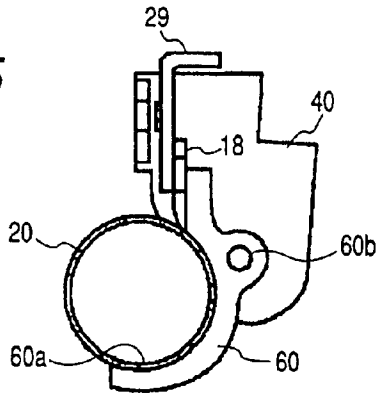
FIG. 5 is a cross section of a magnetic seal portion.

A magnetic seal 60 is provided at both ends of the developing roller 20 in the longitudinal direction. FIG. 5 shows a cross section thereof. The magnetic seal 60 has plural magnetic poles on a surface 60*a* that is opposed to the surface of the developing roller 20. The magnetic seal 60 is seal means for absorbing the toner by a magnetic curtain between the developing roller 20 and itself. The developing roller 20 and the magnetic seal 60 are fixed to the same supporting frame 40. Accordingly, even if the developing roller 20 follows the circumference of the photosensitive drum 10 and the supporting frame 40 is moved, the clearance between the developing roller 20 and the magnetic seal 60 can be set to a constant value. Therefore, the toner seal at both ends of the developing roller 20 by the magnetic seal 60 can be performed sufficiently.

Figure 6B:
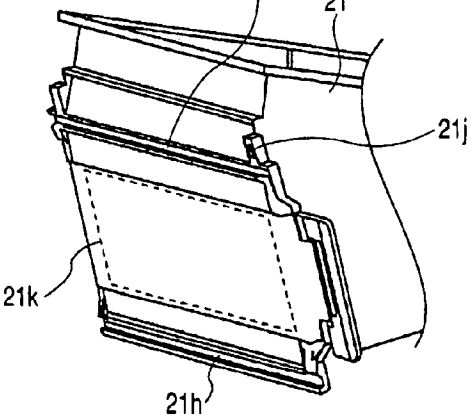
FIGS. 6A and 6B are explanatory diagrams of a welding portion.
Figure 6A:
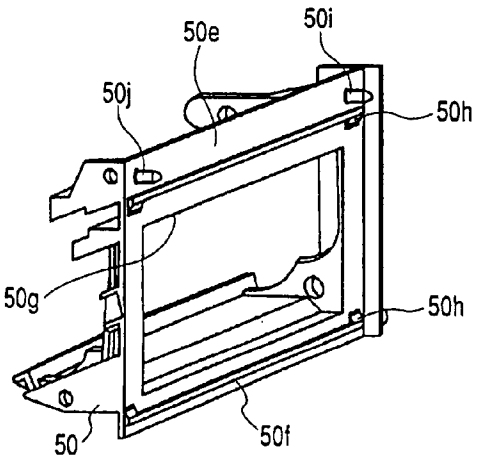

The developing frame 50 and the developer frame 21 are fixed by performing the welding of welding ribs 50*e* and 50*f* provided to upper and lower portions of an opening portion 50*g* of the developing frame 50 shown in FIGS. 6A and 6B with welding surfaces 21*g* and 21*h* provided to upper and lower portions of an opening portion 21*k* of the developer frame 21 as being described later.

Figure 7:
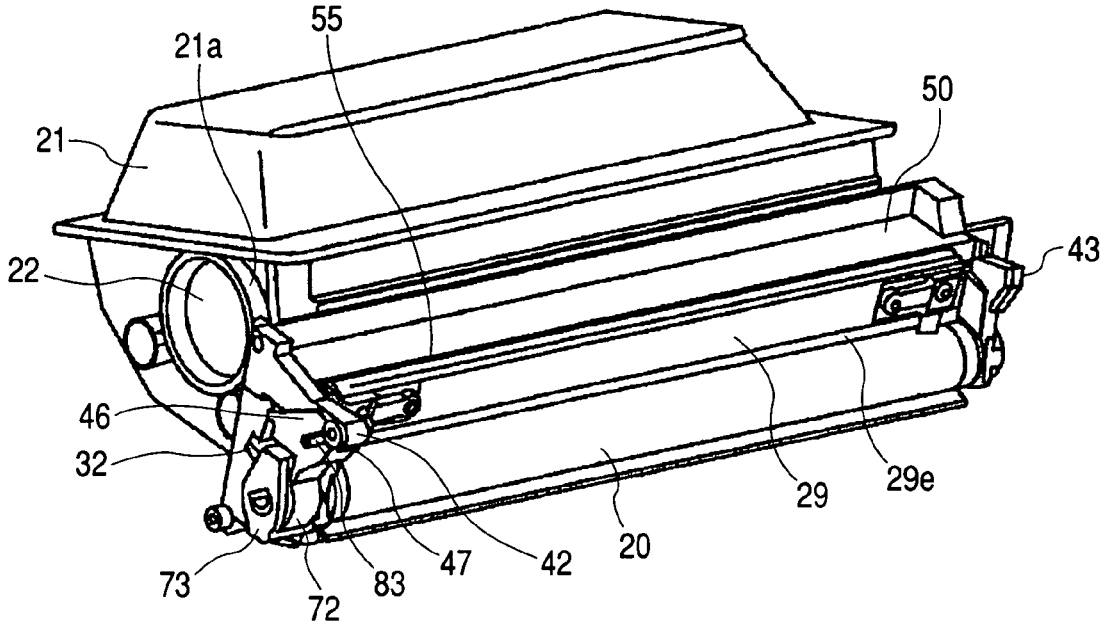
FIG. 7 is a perspective view of a developing device unit according to an embodiment mode of the present invention.

As shown in FIG. 7, 'a toner filling inlet 21*a* is provided at the side surface of the frame 21. After filling toner in the frame 21 through the toner filling inlet 21*a*, a toner cap 22 is used for plugging the toner filling inlet 21*a*. Thus, it is sealed so that the toner does not leak in the frame 21. The supporting frame 40 is provided in the frame 50. A swinging arm 46 having a swinging hole 47 is provided at the end of the first end cover 42 that is fixed to the supporting frame 40. A supporting arm 55 having a fixing hole 56 (not shown in FIG. 7) is provided at the end of the developing frame 50. The end cover 42 and the developing frame 50 are connected to each other in a rotatable manner by a fixing pin 83. The swinging hole 47 of the end cover 42 and the fixing pin 83 are engaged with each other in a slidable manner with some clearance. The fixing hole 56 and the fixing pin 83 are engaged with each other tightly.

Figure 8:
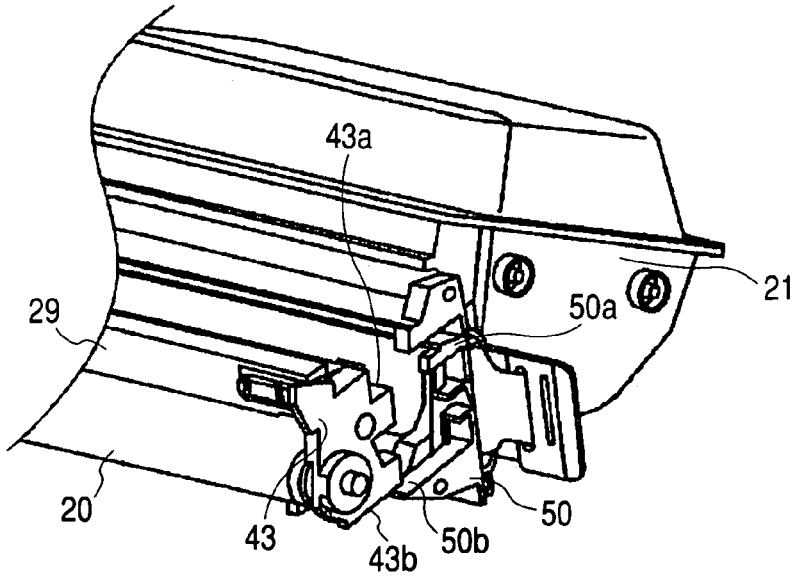
FIG. 8 is a perspective view of a developing device unit according to an embodiment mode of the present invention.

As shown in FIG. 8, sliding planes 43*a* and 43*b* are provided in parallel to substantial upper and lower surfaces of the second end cover 43. On the other hand, guiding planes 50*a* and 50*b* are provided at portions that are opposed to the sliding planes 43*a* and 43*b* of the second end cover 43 with a tiny clearance. These sliding planes 43*a* and 43*b* and the guiding planes 50*a* and 50*b* enable the end cover 43 to slide in a constant direction.

As shown in FIG. 7, the biasing spring 32 is provided between the end cover 42 and the developing frame 50. Similarly, another biasing spring 32 is provided between the end cover 43 and the developing frame 50 (not shown). This spring 32 presses the developing roller 20 provided to the supporting frame 40 to the photosensitive drum 10 with a constant clearance by the spacer runner 26.

(Description of Photosensitive Unit B)

Figure 9:
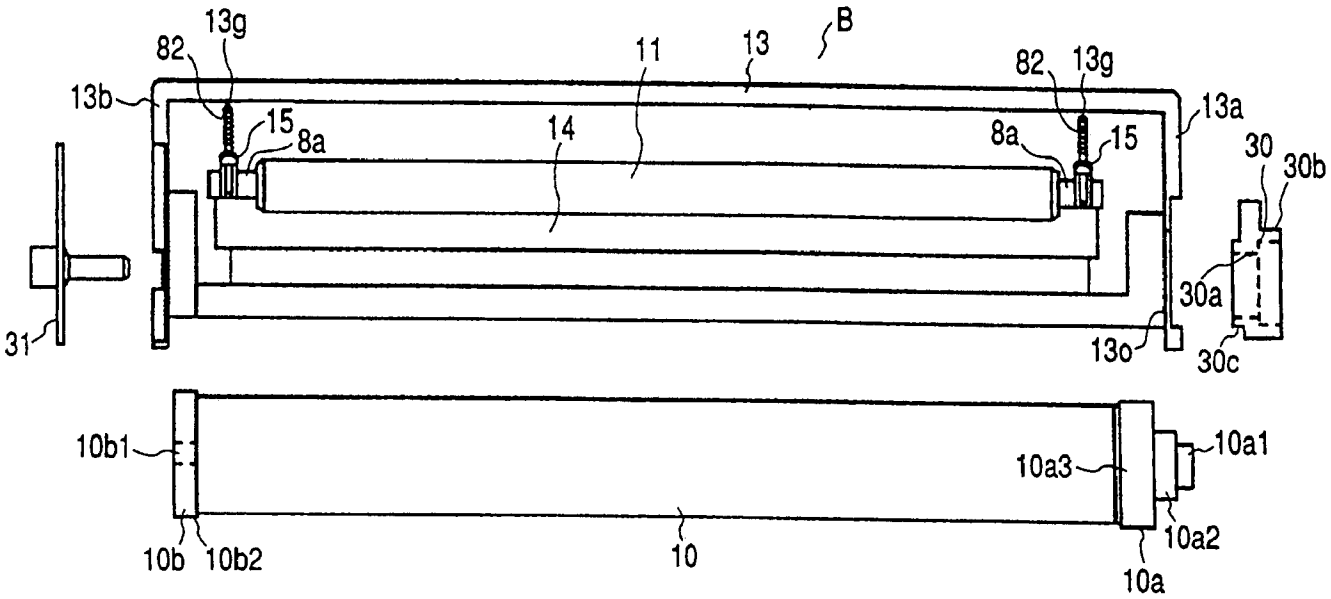
FIG. 9 is an explanatory diagram of a photosensitive member unit according to an embodiment mode of the present invention.
Figure 10:
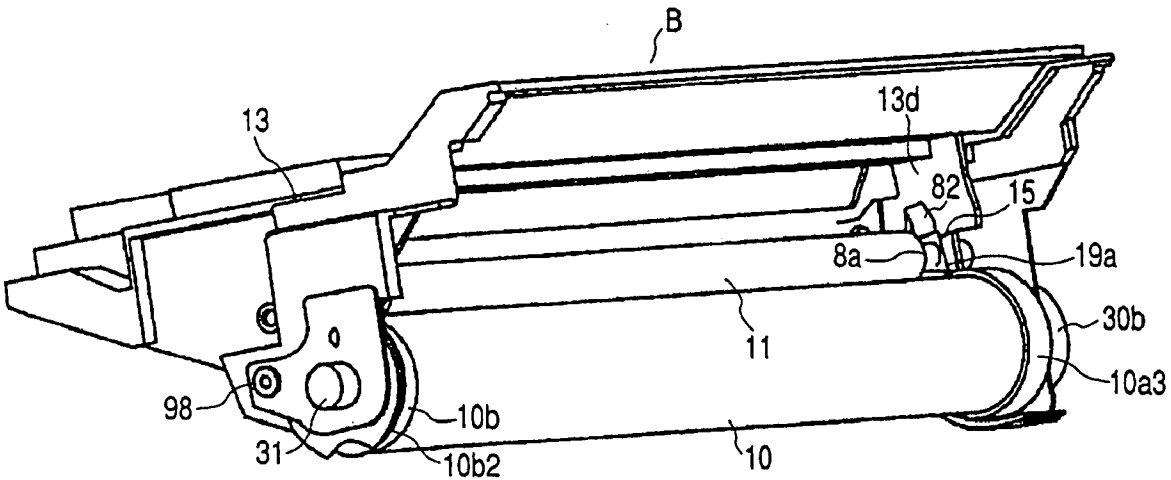
FIG. 10 is an explanatory diagram of a photosensitive member unit according to an embodiment mode of the present invention.
Figure 11:
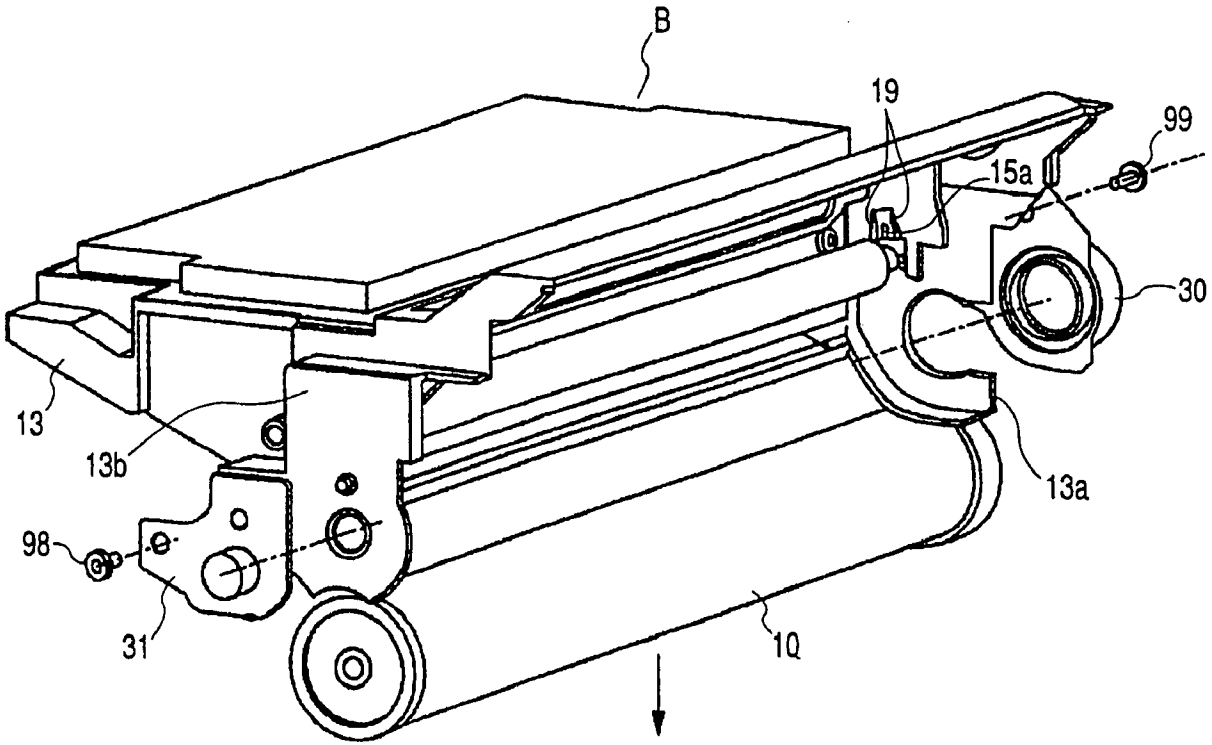
FIG. 11 is a diagram for explaining removal of a photosensitive drum.

With reference to FIGS. 9, 10, and 11, the structure of the photosensitive unit B will be described. A drive side flange 10*a* is attached to one end of the photosensitive drum 10, and a non-drive side flange 10*b* is attached to the other end of the same. The flange 10*a* includes a coupling projection portion 10*a*1, a shaft portion 10*a*2, and a gear portion 10*a*3 for driving a developing roller gear (not shown). The flange 10*b* includes an inner diameter portion 10*b*1 for inserting a centering shaft 31 and a gear portion 10*b*2 for driving a transferring gear (not shown) of the main body.

A method of supporting the photosensitive drum 10 includes fixing a drum bearing 30 to an end portion 13*a* of the drum frame 13 by a screw 99 in the state where an inner diameter portion 30*a* of the drum bearing 30 is engaged with the shaft portion 10*a*2 of the flange 10*a* in a rotatable manner at the right (drive input) side. This drum bearing 30 includes the inner diameter portion 30*a* and an outer diameter portion 30*c* having the same axis and protruding inwardly. This outer diameter portion 30*c* is engaged with a cut portion 13*o* having an arc shape provided to the drum frame 13. The cut portion 13*o* has a center angle sufficiently larger than 90 degrees. The width of an opening portion of the cut portion 13*o* is larger than the diameter of the shaft portion 10*a*2.

Figure 12:
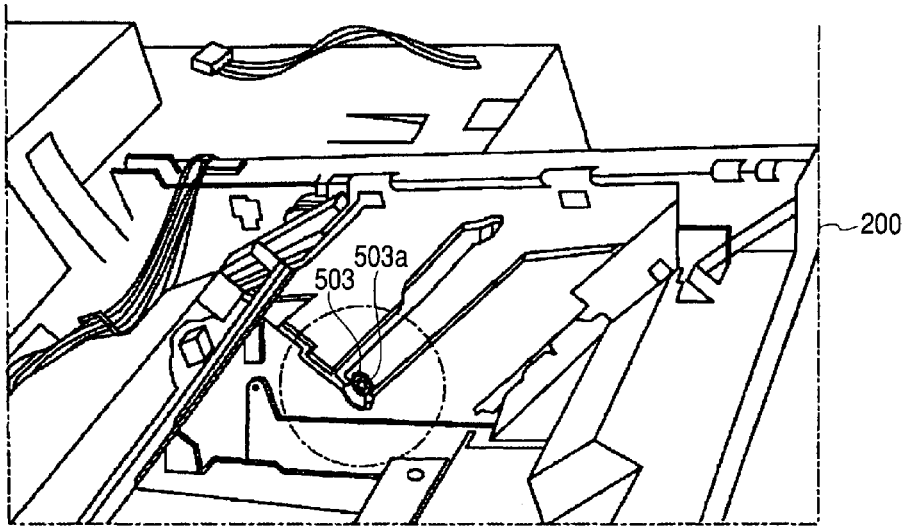
FIG. 12 is an explanatory diagram of a drive transmission member that is attached to a main body of the apparatus.

The coupling projection portion 10*a*1 has a shape like a twisted polygon column. When the cartridge C is attached to the apparatus main body 200, the coupling projection portion 10*a*1 engages a drive transmission member 503 having a shape like a twisted polygon hole 503*a* provided to the apparatus main body 200 shown in FIG. 12 so as to receive a rotation drive force. At the same time, the flange 10*a* is moved toward the drive transmission member 503 and is adjusted by the center.

Similarly at the left (non-drive input) side, the centering shaft 31 is fixed to a side portion 13*b* of the drum frame 13 by a screw 98 in the state where the centering shaft 31 is engaged with the inner diameter portion 10*b*1 of the flange 10*b*.

Next, a method of supporting the charging roller 11 will be described. A bearing guide 19 is provided to the inner wall 13*d* of the drum frame 13 (at two portions). The bearing 15 can move along the guide 19. In addition, the biasing member 82 is attached to a boss 15*a* of the bearing 15 at one end, and the other end is contacted with a bottom surface 13*g* of the drum frame 13. Accordingly, there is always a biasing force that is applied to the biasing member 82 toward the photosensitive drum 10. In addition, the bearing 15 does not drop from the bearing guide 19 owing to a stopper 19*a* of the guide 19. The charging roller 11 is supported by the drum frame 13 by attaching a core metal 8*a* to the bearing 15. The charging roller 11 abuts the surface of the photosensitive drum 10 by the biasing member 82. The biasing member 82 is a compressed coil spring.

As shown in FIG. 2, the frame structure of the drum frame 13 includes an integrated molding made of a resin material (not shown) or connection between a drum lower frame 121 and a drum upper frame 122. The drum frame 13 in this example includes the drum lower frame 121 and the drum upper frame 122 that are welded with each other by ultrasonic welding.

Figure 13:
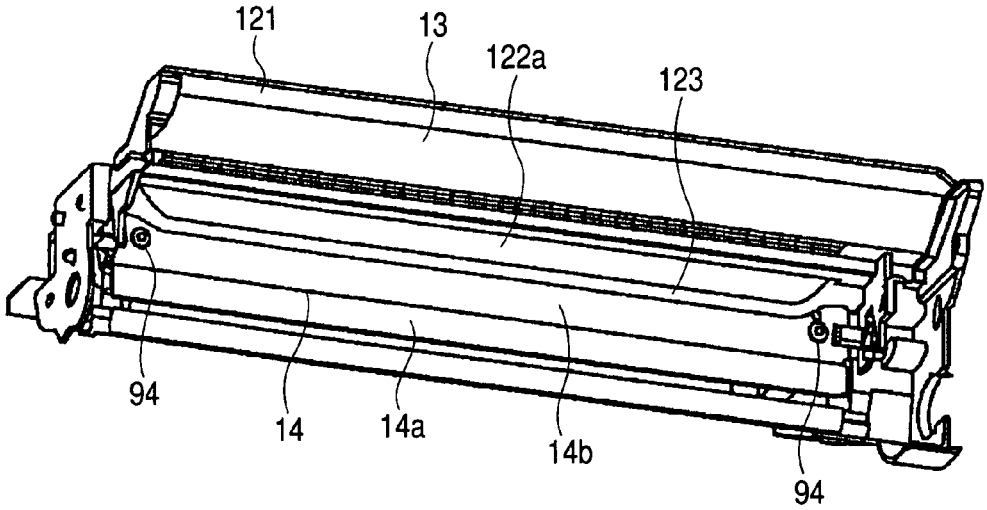
FIG. 13 is an explanatory diagram for a structure of a photosensitive unit.

In addition, the blade 14 and the drum frame 13 have a rib 122*a* of the frame 122 covering a surface of a blade supporting portion 14*b* at the attachment side of the photosensitive drum 10 as shown in FIGS. 2 and 13. A foaming elastomer 123 is injected in the gap between the supporting portion 14*b* and the rib 122*a* for sealing.

Figure 14:
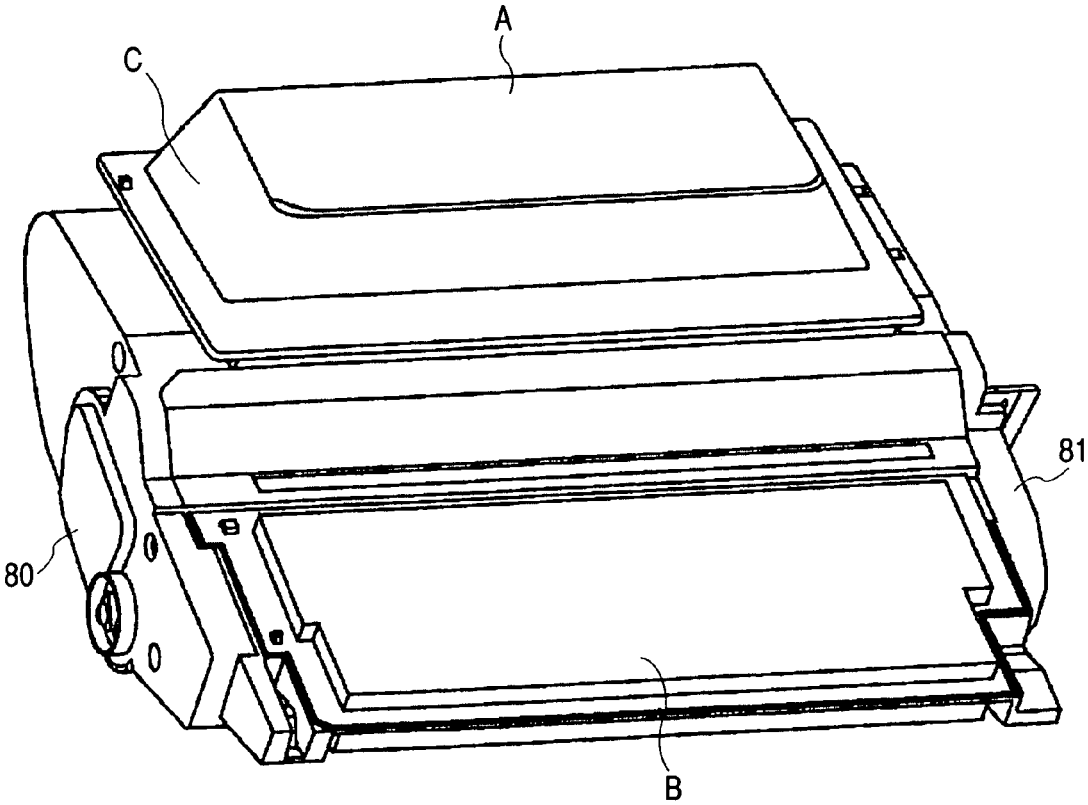
FIG. 14 is a perspective view of a process cartridge according to an embodiment of the present invention.

These units A and B are positioned by a first cover member 80 and a second cover member 81 at both sides in the longitudinal direction as shown in FIG. 14. The units A and B are fixed to the cover members 80 and 81 in an integral manner by using screws and resin bonding (that will be described later in detail). Thus, the units A and B constitute the cartridge C.

<Method of Assembling Developing Device Unit A>

A method of assembling partially the unit A to which the embodiment of the present invention is applied will be described. First, a method of welding the developing frame 50 with the developer frame 21 will be described with reference to FIGS. 6, 15 and 16. The developing frame 50 includes the welding ribs 50*e* and 50*f* at upper and lower portions of the opening portion 50*g*. Welding portions 50*h* are provided to tips of the welding ribs 50*e* and 50*f* (see FIG. 6A). On the other hand, the welding planes 21*g* and 21*h* are provided at upper and lower portions of the opening portion 21*k* of the developer frame 21 (see FIG. 6B).

Figure 15:
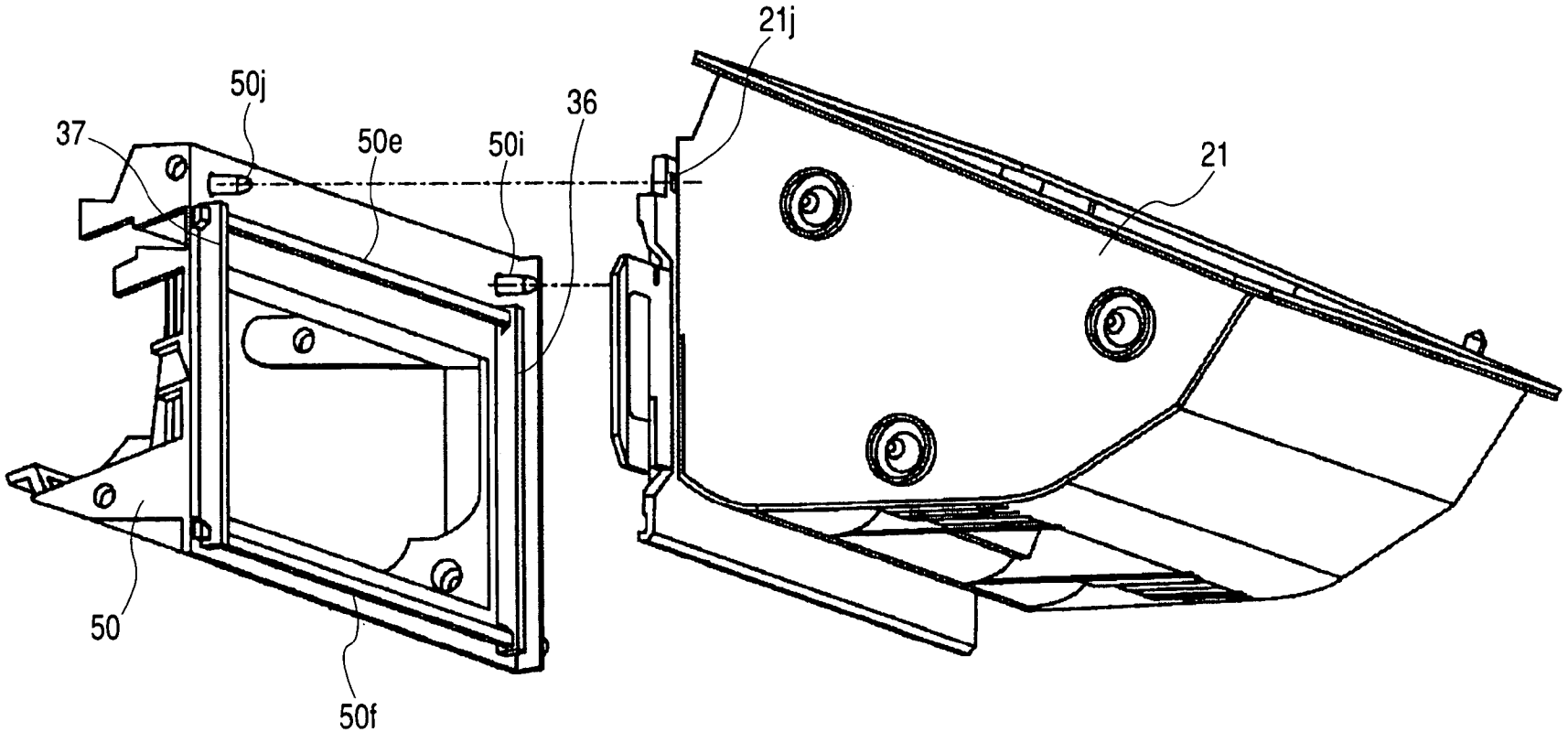
FIG. 15 is an explanatory diagram of a welding portion.
Figure 16A:
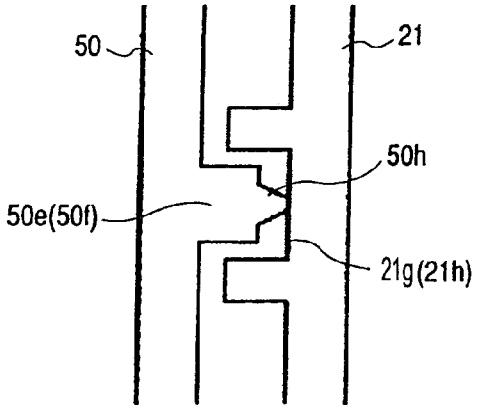
FIGS. 16A and 16B are explanatory diagrams of a welding portion.
Figure 16B:
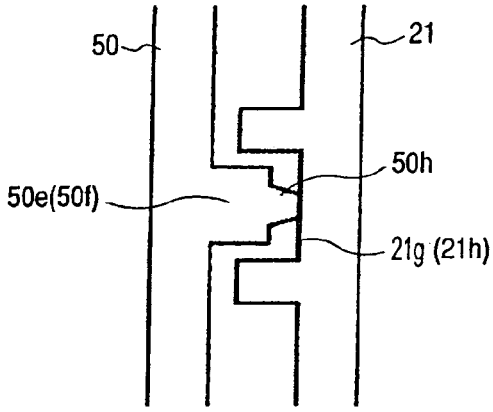

As shown in FIG. 15, an elastic seal member 36 is provided at one end in the longitudinal direction between the frames 50 and 21, and an elastic seal member 37 is provided at the other end in the longitudinal direction so as to overlap the welding ribs 50*e* and 50*f*. The both frames are positioned by engaging positioning bosses 50*i* and 50*j* of the frame 50 respectively with positioning holes of the frame 21 for assembly, one of which is denoted by reference characters 21*j*. On this occasion as shown in FIG. 16A, the welding portion 50*h* at the tip of the welding rib 50*e* (50*f*) is contacted with the welding plane 21*g* (21*h*) of the developer frame 21. This contact portion is vibrated by an ultrasonic vibration device. Thus, as shown in FIG. 16B, the welding portion 50*h* melts and is welded to the planes 21*g* and 21*h*. As a result, the frames 50 and 21 are fixed to each other stiffly.

Figure 17:
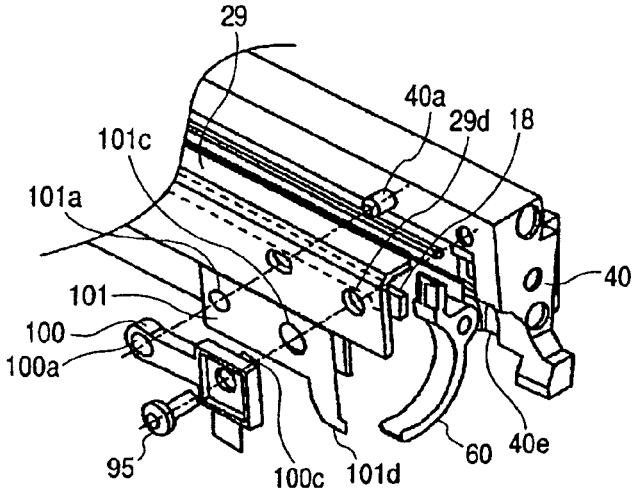
FIG. 17 is a diagram for explaining assembly of a developing blade.

Next, a method of attaching the magnetic seal 60 to the developing blade 29 will be described. As shown in FIG. 17, the seal 60 is inserted in a recess portion 40*e* that is provided at one end of the frame 40 in the longitudinal direction. Then, the seal 60 is pressed by the developing blade 29 via a seal member 18. Although the seal 60 is in a provisionally positioned state, it is pressed via the seal member 18. Therefore, the seal 60 does not drop from the recess portion 40*e*. The other end portion (not shown) is also assembled in the same way.

(Process of Attaching Developing Blade)

As shown in FIG. 17, the developing blade 29 is positioned by engaging the positioning bosses 40*a* and 40*b* of the supporting frame 40. The toner regulating member 100 is positioned when a positioning rib 100*c* engages the fixing hole 29*d* of the developing blade 29 and a positioning hole 100*a* engages the positioning boss 40*a* of the supporting frame 40.

The scraper 101 is positioned when the positioning holes 101*a* and 101*c* engage the boss 40*a* and the rib 100*c*, respectively.

The developing blade 29, the regulating member 100, and the scraper 101 are fastened together to the supporting frame 40 by the same screw 95. The other end portion in the longitudinal direction (not shown) is also assembled in the same way.

(Process of Setting Supporting Frame)

Figure 18:
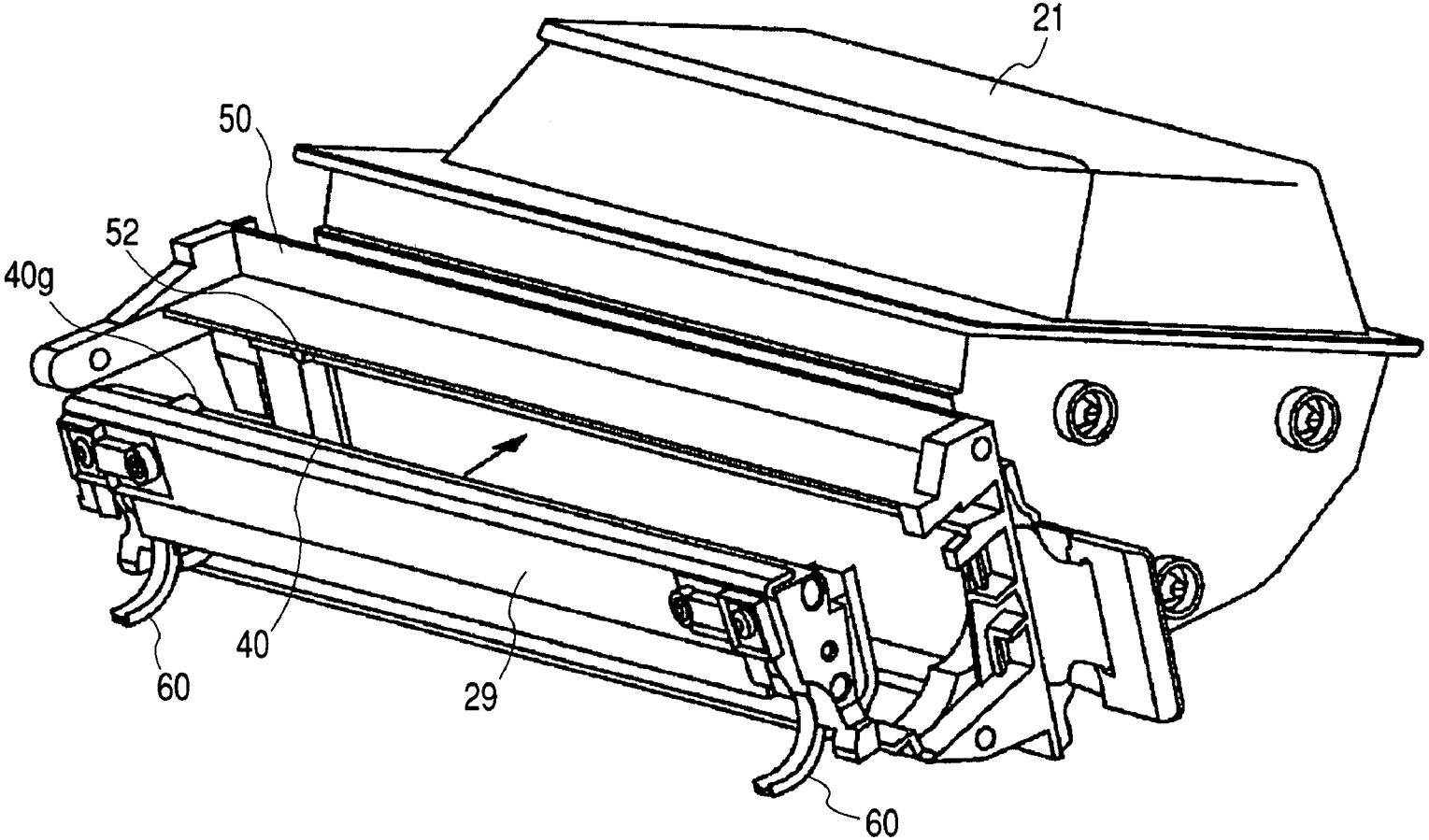
FIG. 18 is a diagram for explaining assembly of a supporting frame.

Next, as shown in FIG. 18, a positioning hole 40*g* of the frame 40 is engaged with a positioning boss 52 of the frame 50, so that registration in the longitudinal direction is performed. In this way, the frame 40 is positioned at the opening portion 50*g* of the frame 50.

(Process of Attaching Developing Roller)

Figure 19:
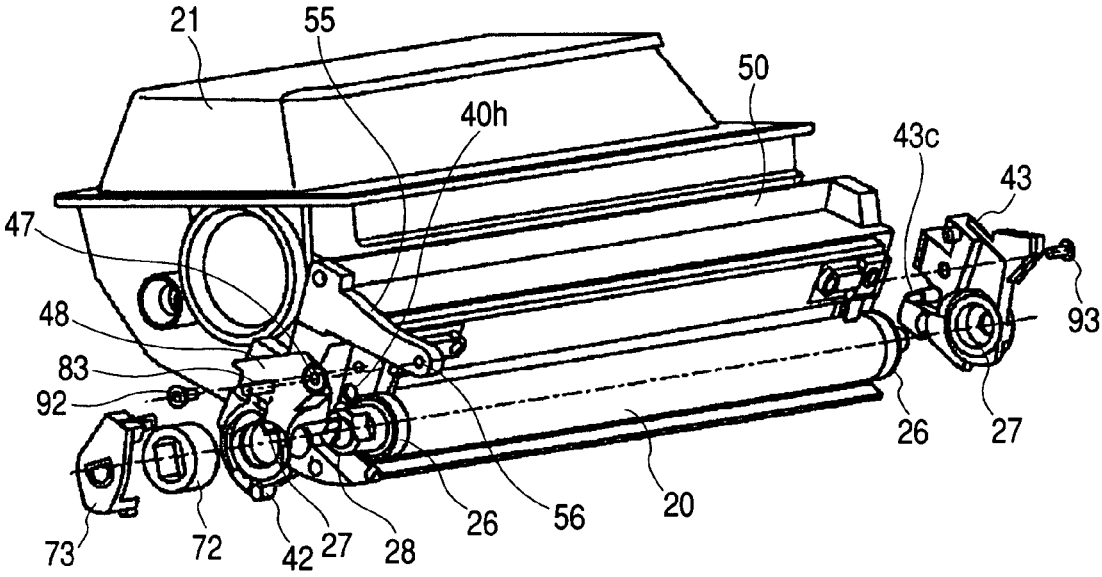
FIG. 19 is a diagram for explaining assembly of a developing roller.

Next, as shown in FIG. 19, the developing roller 20 having spacer runners 26 at both ends is positioned on the supporting frame 40. The first end cover 42 having the bearing 27 is fixed to one end of the frame 40 in the longitudinal direction by engaging a positioning boss (not shown) with a positioning hole 40*h* of the supporting frame 40 and by using a screw 92. In the same way, the second end cover 43 having the bearing 27 is fixed to the other end of the frame 40 in the longitudinal direction by engaging a positioning boss 43*c* with a positioning hole (not shown) of the supporting frame 40 and by using a screw 93. On this occasion, the developing roller 20 is attached to the end covers 42 and 43 in a rotatable manner at both ends via the bearing 27.

In the process of attaching the developing roller, the boss 43*c* and the boss engaging the positioning hole 40*h* are engaged with positioning holes 60*b* (see FIG. 5) of the magnetic seal 60, so that the position of the magnetic seal 60 is determined. After that, the developing roller gear 72 is inserted at one end of the developing roller 20 so that the fixing member 73 is fixed to the end cover 42.

(Process of Connecting Supporting Frame)

Next, the swinging hole 47 that is provided to the swinging arm 46 of the end cover 42 and a fixing hole 56 that is provided to the swinging arm 55 of the developing frame 50 are connected to each other by using the fixing pin 83.

<Method of Assembling Cartridge C>

Figure 20:
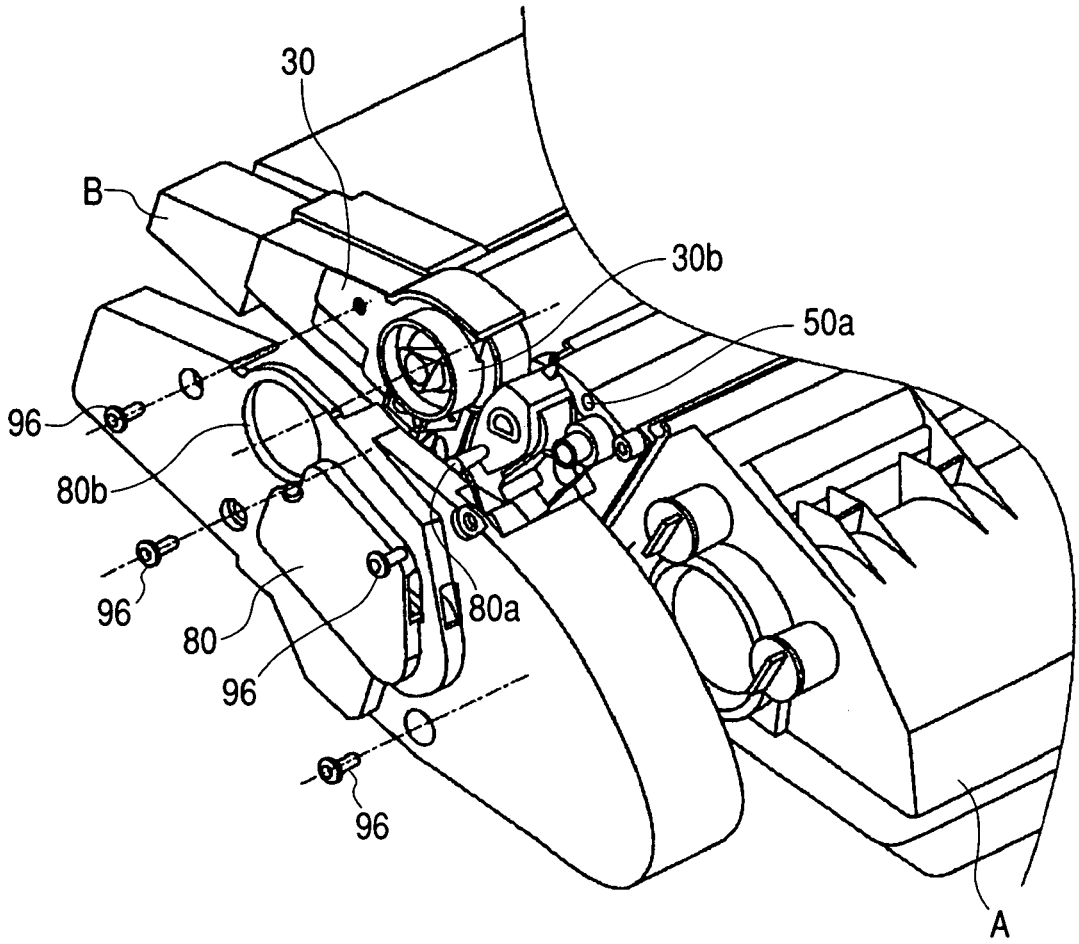
FIG. 20 is a diagram for explaining connecting of frames.
Figure 21:
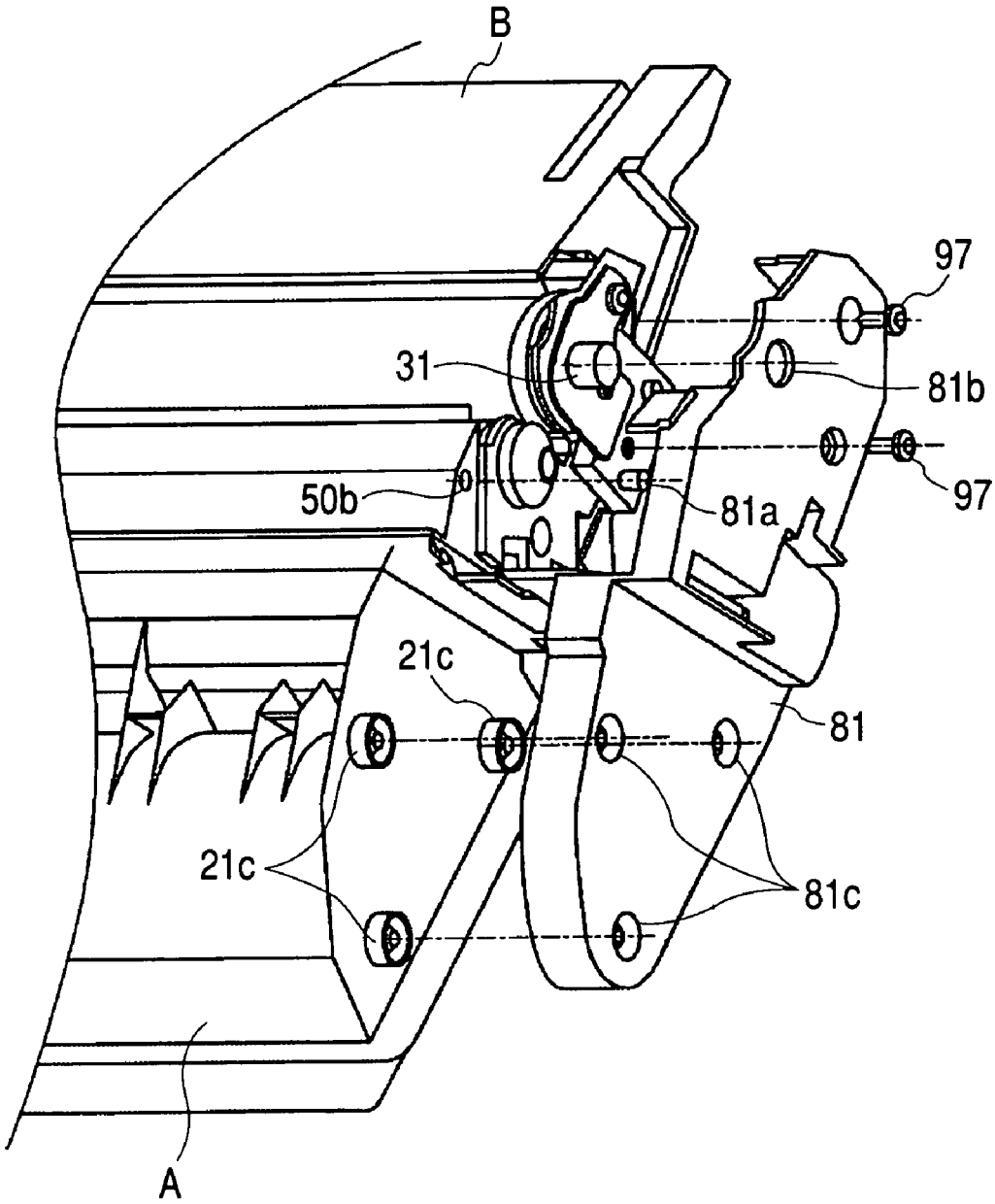
FIG. 21 is a diagram for explaining connecting of frames.

Next, as shown in FIGS. 20 and 21, the unit A and the unit B are positioned so as to face each other. A positioning pin 80*a* of the first cover member 80 with the unit A and a positioning hole 80*b* with the unit B are respectively engaged with the positioning hole 50*a* that is provided to the developing frame 50 and an outer shape portion 30*b* of the drum bearing 30 of the unit B. Thus, relative position between the unit A and the unit B is decided. After that, the both units are connected to the cover member 80 by screws 96.

In the same way, a positioning pin 81*a* of the second cover member 81 with the unit A and a positioning hole 81*b* with the unit B are respectively engaged with the positioning hole 50*b* that is provided to the developing frame 50 and an centering shaft 31 of the photosensitive drum 10 of the unit B. Thus, the both units A and B are positioned. After that, the unit B and the cover member 81 are connected by a screw 97. The unit A and the cover member 81 are fixed by a resin bonding as follows.

Figure 22C:
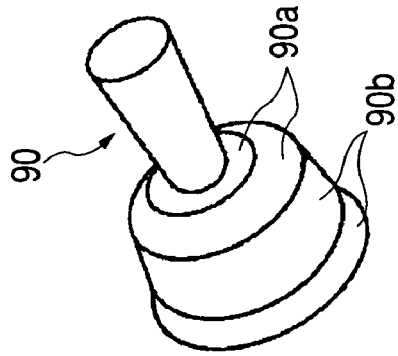
FIG. 22C is a perspective view showing a shape of an injected bonding resin.
Figure 22B:
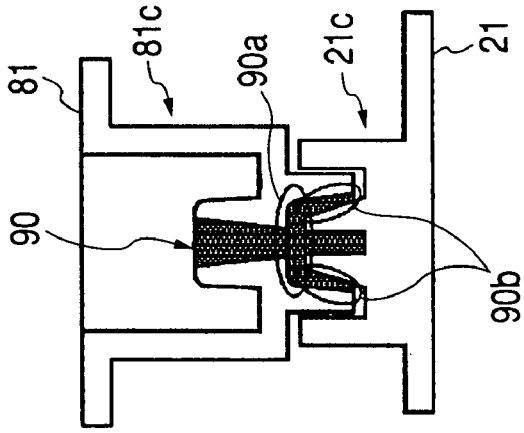
FIGS. 22A and 22B are cross sections of a resin connection portion.
Figure 22A:
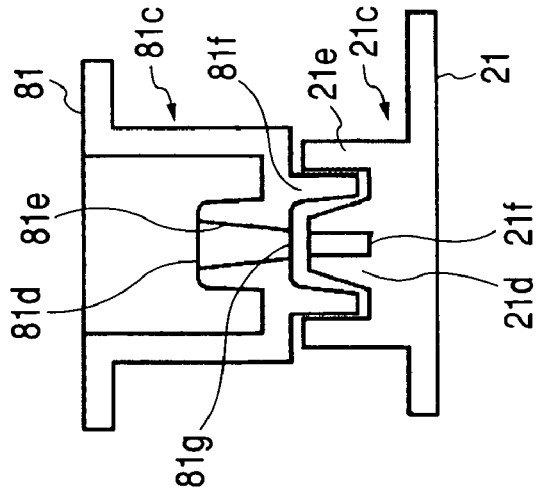

As shown in FIG. 21, the cover member 81 and the frame 21 have resin bonding portions 81*c* and 21*c* on the surfaces facing each other. Molten resin 90 is injected in the gap between both the connection portions 81*c* and 21*c*, so that the cover member 81 and the frame 21 are fixed to each other. FIGS. 22A to 22C show the structure of the resin bonding portion. FIG. 22A is a cross section of the connection portion. FIG. 22B is a cross section of the state after the molten resin is injected in the connection portion. FIG. 22C is a perspective view showing a shape of the connecting resin that was injected. As shown in FIGS. 22A and 22B, the connection portion 81*c* has an injection opening 81*d*, an injection path 81*e* for injecting the molten resin, and a protruding portion 81*f* having a substantially cylindrical shape and forming the connection portion. In addition, the connection portion 21*c* includes a protruding portion 21*d* having a substantially cylindrical shape and forming the connection portion and its thinning portion 21*f*, and a cylindrical portion 21*e* having an inner diameter larger than the outer shape of the protruding portion 81*f* of the cover member 81.

The molten resin 90 for connecting the cover member 81 and the unit A is injected from the injection opening 81*d*. The injected molten resin 90 passes the injection path 81*e* and reaches a downstream opening 81*g*. After that, the injected resin 90 forms a second connection portion 90*b* between the inner rim of the protruding portion 81*f* and the outer rim of the protruding portion 21*d*. As a result, the injected resin 90 becomes the state as shown in FIG. 22B. Therefore, the cover member 81 and the frame 21 are fixed to each other stiffly. In this embodiment, a material of the two frames to be connected, i.e., the cover member 81 and the frame 21 is a high impact polystyrene (HIPS), and a material of the injected resin 90 is also HIPS. Although the material is not limited to HIPS, effective connection can be realized by using the injected resin made of a material compatible to the resin of the frames to be connected. Thus, the resin 90 can connect the frame 81 with the frame 21 stiffly so that they are not separated even if an impact is applied in transportation or when being dropped.

By the above-mentioned process, the unit A and the unit B can be positioned relatively and are connected as a unit.

<Method of Remanufacturing Cartridge C>

Next, a method of disassembling and remanufacturing the cartridge C according to an embodiment of the present invention will be described.

(Process of Removing First and Second Covers)

Figure 23:
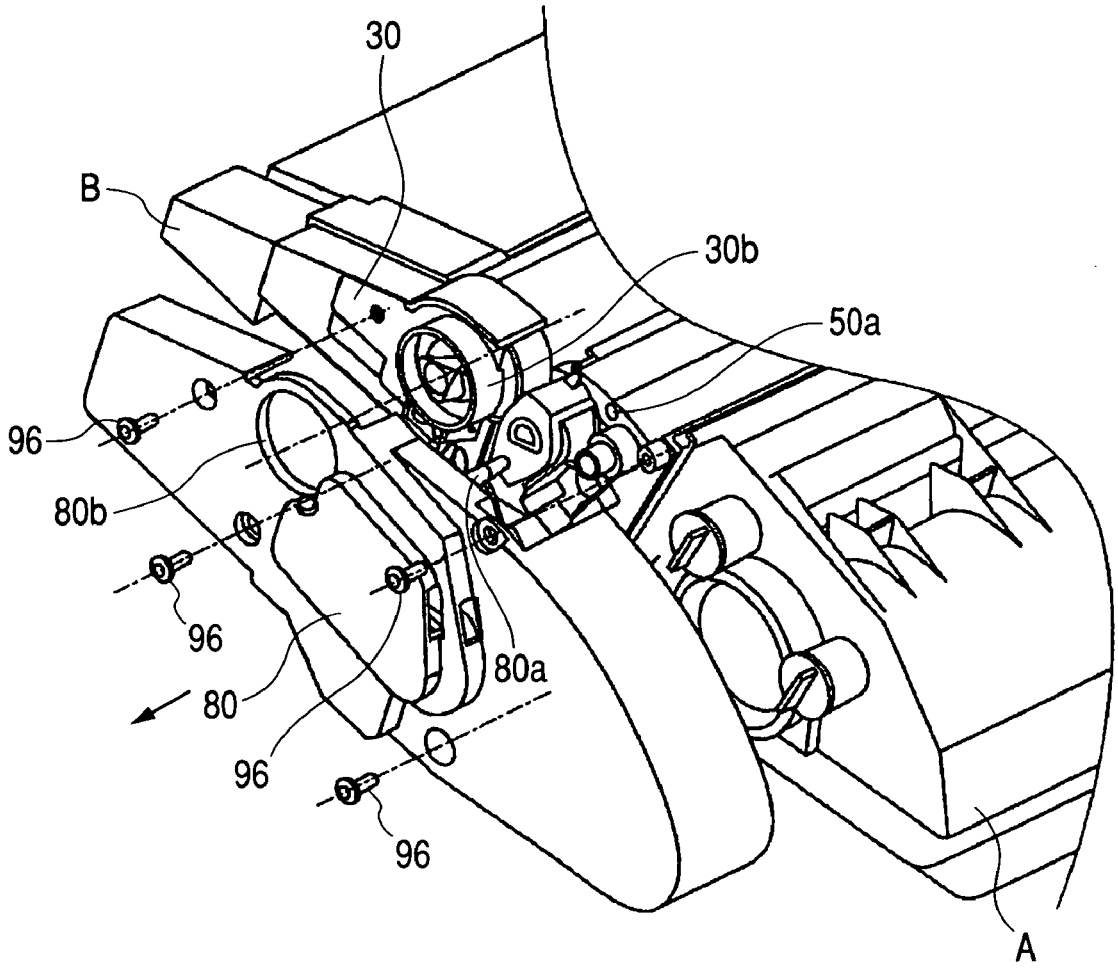
FIG. 23 is an exploded explanatory diagram of a cover.
Figure 24:
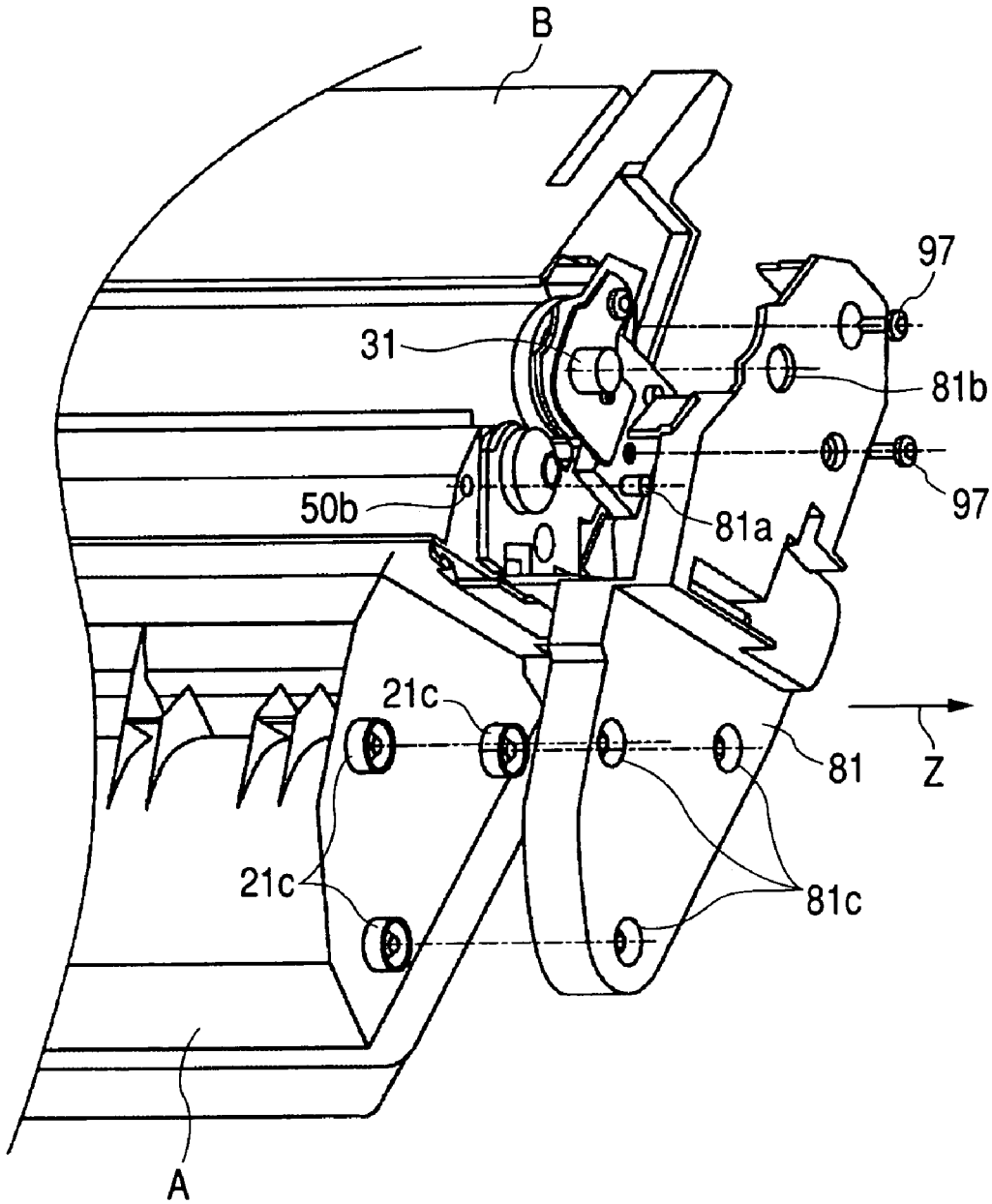
FIG. 24 is an exploded explanatory diagram of a cover.

As shown in FIGS. 23 and 24, screws 96 are removed from the unit A and the unit B at one end of the cartridge C in the longitudinal direction so that the cover member 80 is removed.

In the same way, a screw 97 is removed from the unit B at the other end of the cartridge C in the longitudinal direction. The resin bonding portion between the cover member 81 and the frame 21 is separated and removed from the unit A.

Figure 25A:
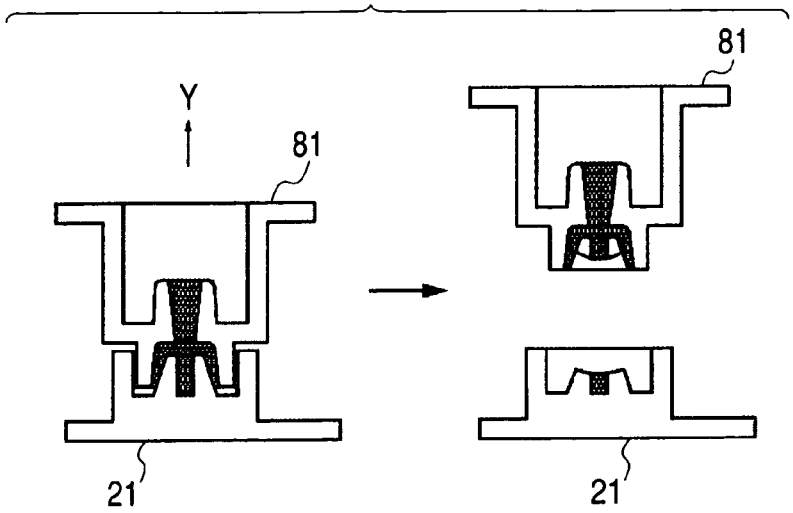
FIGS. 25A, 25B, and 25C are diagrams for explaining separation of a resin connection portion.
Figure 25B:
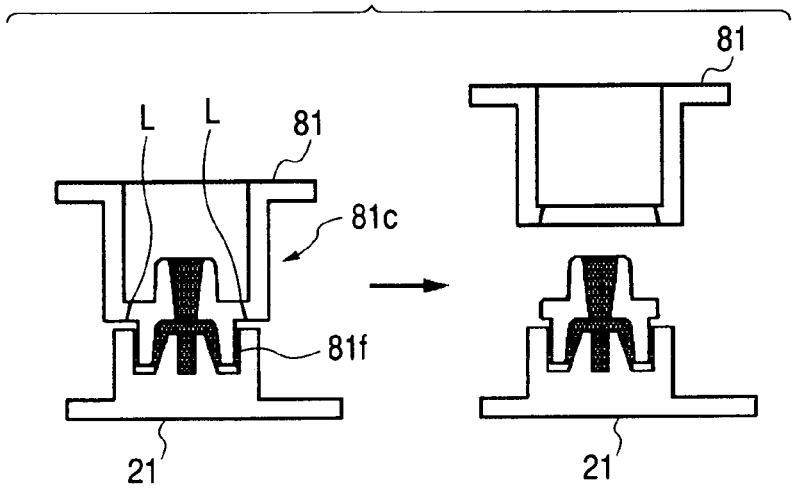
Figure 25C:
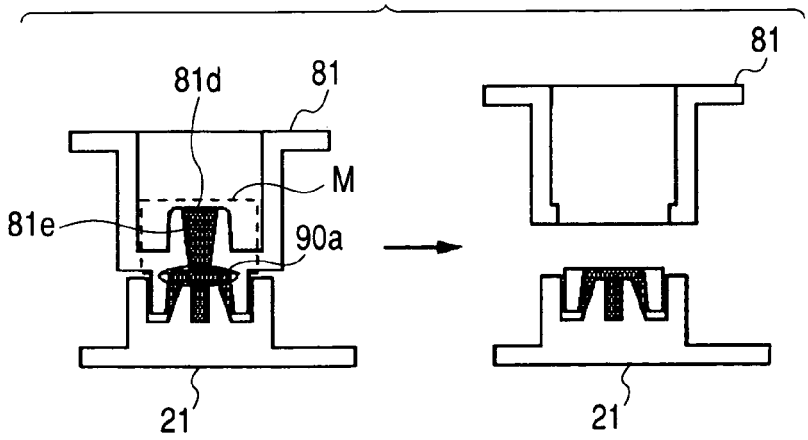

The method of separating the resin bonding portion is performed as shown in FIGS. 25A, 25B, and 25C.

(1) In one method, a force is applied to the cover member 81 in the direction indicated by the arrow Y (the direction indicated by the arrow Z in FIG. 24) so as to remove the resin bonding portion. Alternatively, the connecting resin is cut off for separation (see FIG. 25A).

(2) In another method, the resin bonding portion 81*c* of the cover member 81 is cut at a position of a broken line L (outside the protruding portion 81*f*) (see FIG. 25B).

(3) In still another method, the injection opening 81*d* of the cover member 81, the injection path 81*e* and the first connection portion 90*a* (the area surrounded by a broken line M in FIG. 25C) are cut off for separation (see FIG. 25C).

However, the method is not limited to the above-mentioned three methods.

(Process of Separating Developer Frame 21 and Drum Frame 13)

In this way, the connection between the frames 21 and 13 is released by removing the cover members 80 and 81. Thus, the unit A is separated from the unit B. When the unit A is separated from the unit B, the remanufacture process that will be described below is facilitated.

Figure 26:
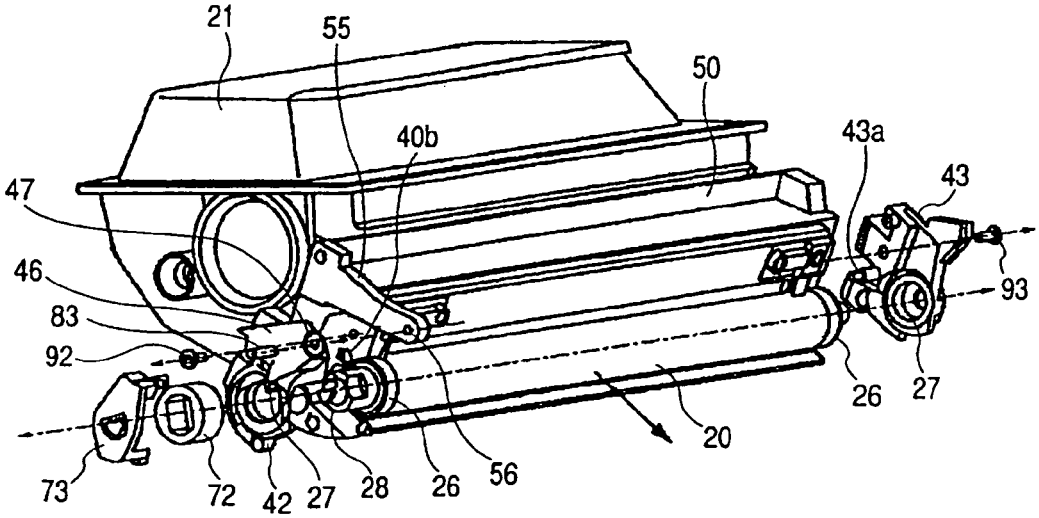
FIG. 26 is a diagram for explaining removal of a developing roller.

Next, with reference to FIG. 26, the process of removing the developing roller 20 from the unit A will be described.

(Process of Removing Pin)

First, the fixing pin 83 that connects the end cover 42 to the developing frame 50 in a rotatable manner is removed. Thus, the connection between the developing frame 50 and the end cover 42 is released. In addition, the fixing member 73 and the developing roller gear 72, which are positioned and fixed to the end cover 42, are removed.

(Process of Removing Developing Roller)

Next, a screw 92 that fastens the end cover 42 to the supporting frame 40 is removed. Furthermore, the end cover 42 is removed from the supporting frame 40 together with the bearing 27. In the same way, a screw 93 that fastens the end cover 43 to the supporting frame 40 is removed. In addition, the end cover 43 is removed from the supporting frame 40 together with the bearing 27.

In this way, the developing roller 20 can be removed by removing the end covers 42 and 43 from the supporting frame 40.

In this case, it is also possible to remove the developing roller 20 by removing only one of the end covers 42 and 43 from the supporting frame 40.

(Process of Removing Developing Blade and Toner Regulating Member)

Figure 27:
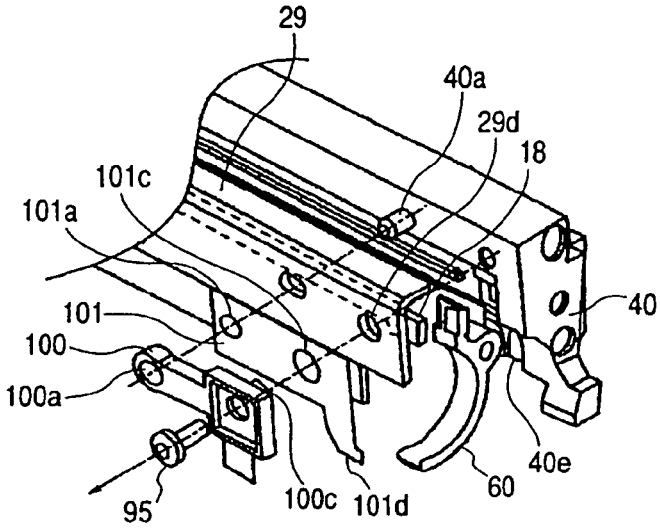
FIG. 27 is an exploded diagram for explaining a developing blade.

Next, the process of removing the developing blade 29 from the supporting frame 40 will be described with reference to FIG. 27.

After removing the developing roller 20, the screw 95 that fastens the developing blade 29, the scraper 101 and the regulation member 100 to the supporting frame 40 is removed. In the same way, the screw 95 is removed on the opposite side in the longitudinal direction. Thus, the developing blade 29 is removed together with the scraper 101 and the regulation member 100. In this way, it is possible to exchange parts when remanufacturing.

(Process of Removing Supporting Frame 40)

Figure 28:
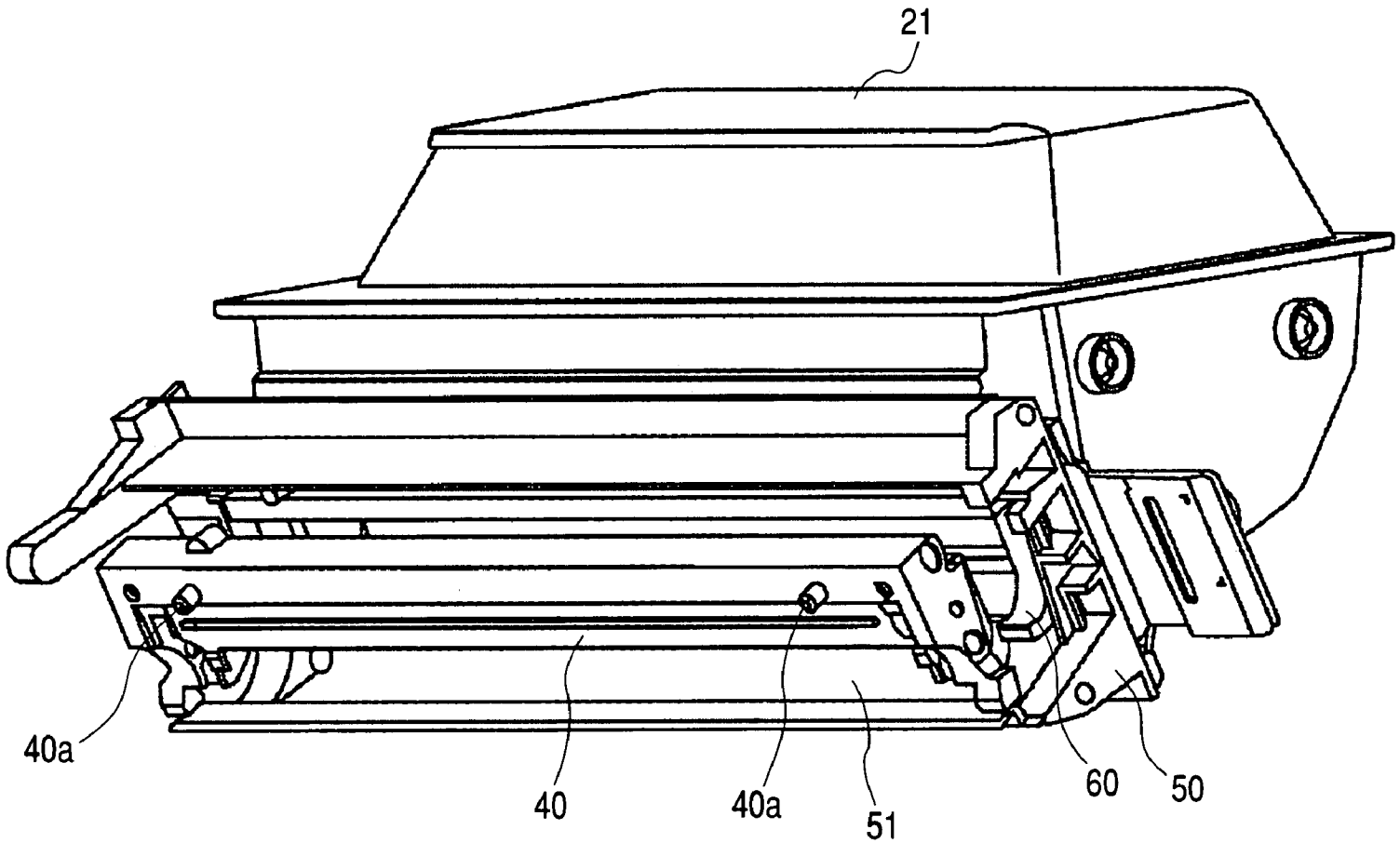
FIG. 28 is a diagram for explaining removal of a supporting frame.

Next, the supporting frame 40, from which the blade 29 was removed, is removed from the developing frame 50 (see FIG. 28). The blade 29 may be removed after the supporting frame 40 is removed from the developing frame 50. By removing the supporting frame 40, a toner supplying opening 51 can be exposed widely. Thus, the process of refilling the developer to be described below can be performed easily.

(Process of Removing Developing Frame 50)

Figure 29:
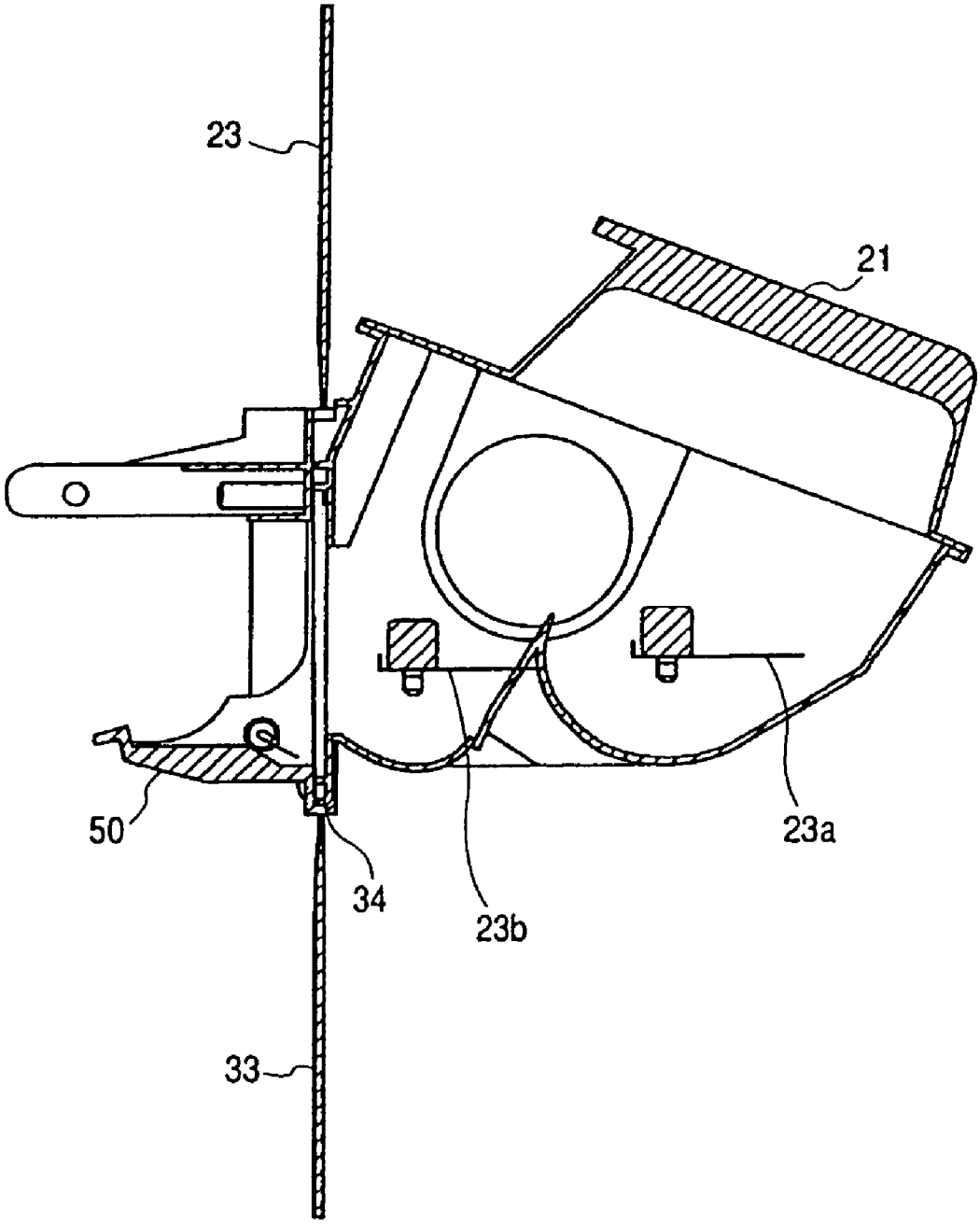
FIG. 29 is a cross section of a developing device according to an embodiment of the present invention.
Figure 30:
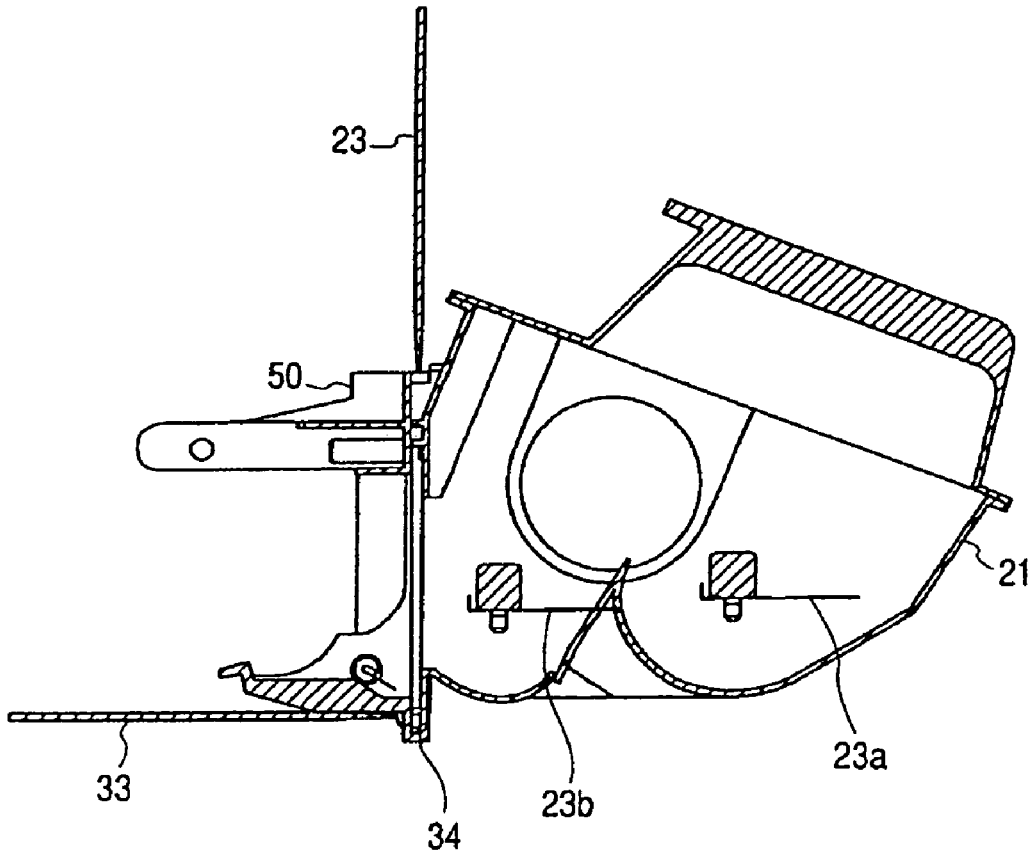
FIG. 30 is a cross section of a developing device according to an embodiment of the present invention.

As described above, the developing frame 50 and the developer frame 21 are connected to each other by an ultrasonic welding or other methods. Therefore, the frames 21 and 50 cannot be separated easily. As show in FIG. 29, in order to separate the developing frame 50 from the developer frame 21, each welding surface is cut by a cutter 33, an ultrasonic cutter or a laser processing machine. The case where the cutter 33 is used will be described. A portion to be cut is a connecting surface 34 that is welded as shown in FIG. 29. Alternatively, it is possible to avoid the welded portion and to cut along the connecting surface 34 as shown in FIG. 30. In the same way, the connecting surface 34 is melted and cut by the cutter to which a ultrasonic vibration is applied in the case of the ultrasonic cutting process. Note that in the case of laser processing, the range of the laser light is limited to the cut portion.

(Process of Refilling Developer)

Figure 31:
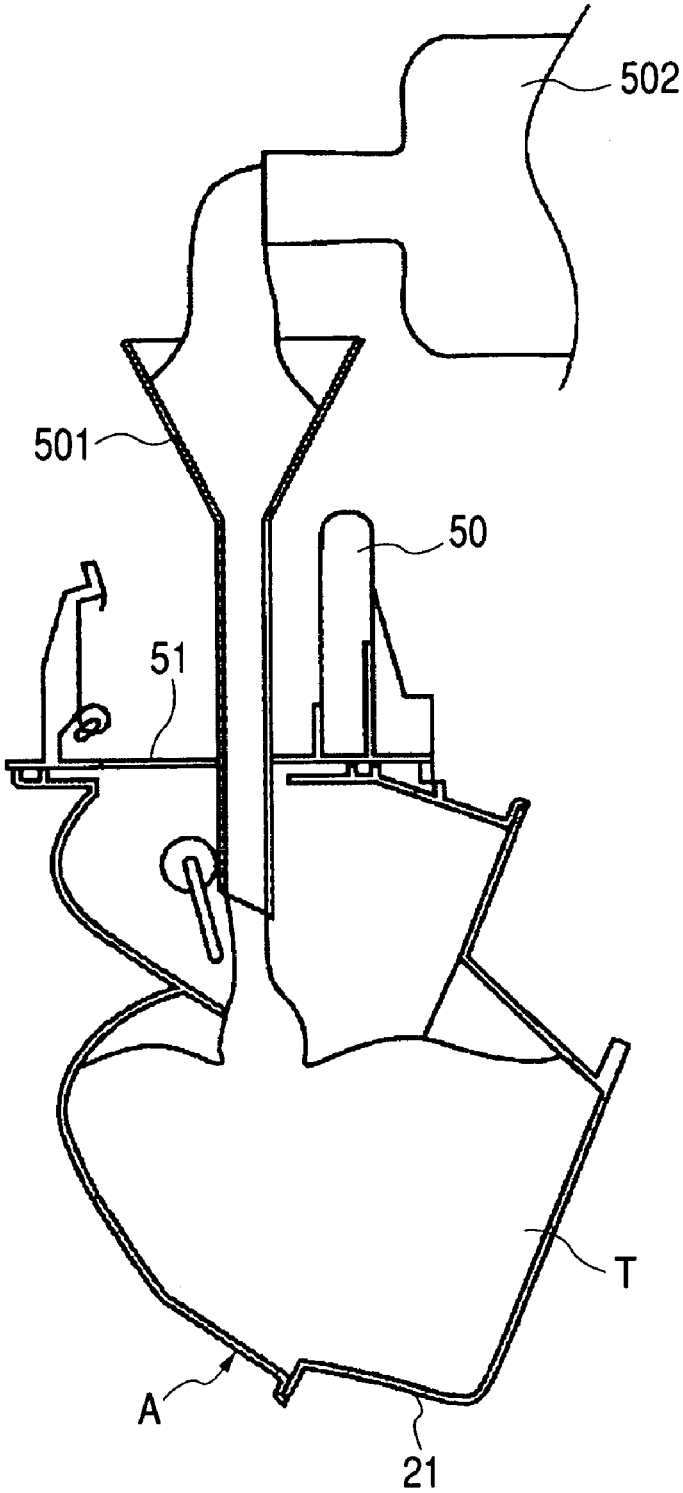
FIG. 31 is a diagram for explaining refilling of toner.

Next, with reference to FIG. 31, a process of refilling developer (hereinafter referred to as toner) T in the developer frame 21 will be described.

First, residual toner in the developer frame 21 is cleaned by sucking it through the opening 51 or by air blowing. After that, the frame 21 is held in a posture so that the opening 51 is positioned at upper side and the frame 21 is down. The leading end of a funnel 501 is inserted in the opening 51 so that the toner T is poured from a toner bottle 502 into the funnel 501.

In this way, the toner is filled into the frame 21 through the opening 51.

After that, the opening 51 is sealed again with a new developer seal member. Thus, leak of toner through the opening 51 is prevented. The step of resealing the opening 51 is not always necessary, but it is possible to remanufacture without resealing.

In addition, the filling of the toner may be performed without removing the supporting frame 40 and the developing blade 29.

Figure 32:
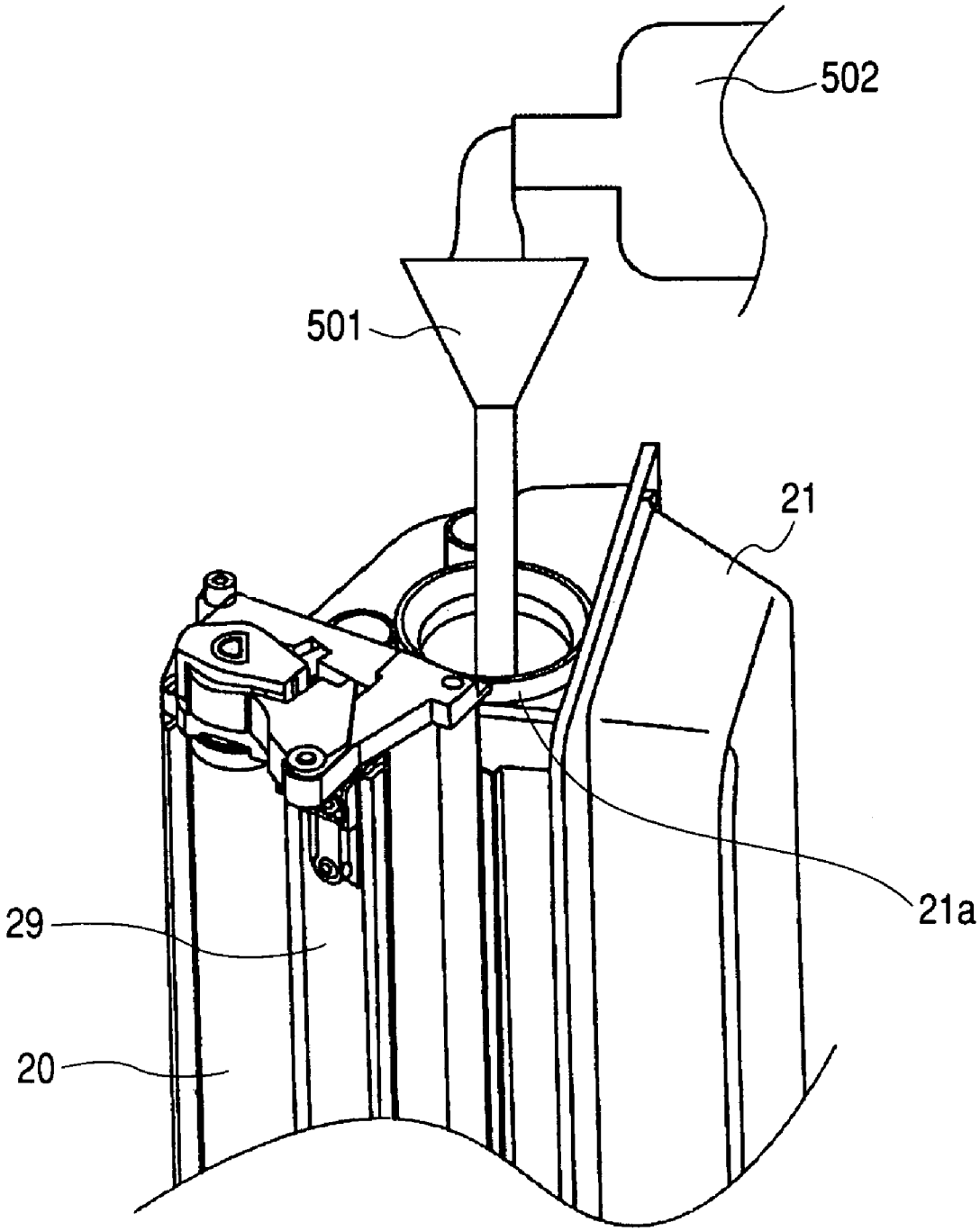
FIG. 32 is a diagram for explaining refilling of toner.

The above-mentioned step of filling toner is not limited to the method of filling toner through the opening 51. For example, as shown in FIG. 32, the toner cap 22 is removed from the exposed toner filling inlet 21*a* of the developer frame 21 after the cover member 80 is removed. After that, toner is refilled through the toner filling inlet 21*a*. Then, the toner filling inlet 21*a* may be resealed by the cap 22. In this case, the process is performed in the state where the developing blade 29 and the developing roller 20 are assembled, so that it is necessary to seal the opening 51 by a new developer seal member in advance.

(Process of Attaching Developing Blade 29)

The developing blade 29 is assembled in the same step as the above-described (Process of attaching developing blade 29) of <Method of assembling developing device unit A>.

If the developing blade 29 that is reattached to the supporting frame 40 is not replaced with new one, it is possible to add the cleaning and inspection steps as follows.

The developing blade 29 is cleaned by removing sticking toner by using air suction and air blowing simultaneously before being attached to the supporting frame 40. After the cleaning, inspection is performed so as to decide whether or not it can be reused. If it can be reused, the blade 29 is attached to the frame 40. If the performance thereof is below a predetermined standard as a result of the inspection, it is replaced with new one as appropriate.

(Process of Attaching Developing Roller 20)

The developing roller 20 is assembled in the same step as the above-described (Process of installing supporting frame) and (Process of fixing developing roller) of <Method of assembling developing device unit A>.

The developing roller 20 can be worn out by rubbing with the developing blade 29. Therefore, if there is high probability in necessity of statistically replacing it upon remanufacture, it is efficiency to replace it with a new one without inspection when remanufacturing it.

However, in order to improve the remanufacture performance, if the developing roller 20 is not replaced with new one, it is possible to add the cleaning and inspection steps as follows.

The developing roller 20 is cleaned by removing sticking toner by using air suction and air blowing simultaneously. Next, inspection of the developing roller 20 is performed so as to decide whether or not it can be reused. If it can be reused, the developing roller 20 is attached to the frame 40. If the performance thereof is below a predetermined standard as a result of the inspection, it is replaced with new one.

The inspection of the developing roller 20 is performed for each member such as the main body, the stationary magnet 28, the bearing 27, the runner 26 and gear 72 of the developing roller 20, after disassembling. Then, members that can be reused are found, and members that cannot be reused may be replaced with new ones.

(Process of Connecting Supporting Frame)

The supporting frame is assembled in the same step as the above-described (Process of connecting supporting frame) of <Method of assembling developing device unit A>.

Next, a method of disassembling and remanufacturing the photosensitive unit B will be described.

A method of disassembling and remanufacturing the photosensitive unit B after the above-mentioned (Process of removing first and second covers) and (Process of separating developing frame and drum frame) will be described.

(Process of Removing Shaft 31)

As shown in FIG. 11, the screw 98 is removed from the left side portion 13*b* of the drum frame 13. Thus, the centering shaft 31 is removed from the frame 13.

(Process of Removing Bearing 30)

In the same way, the screw 99 is removed from the right side portion 13*a* of the drum frame 13. Thus, the drum bearing 30 is removed from the drum frame 13. Either the step of removing the shaft 31 or the step of removing the bearing 30 can be performed first.

(Process of Removing Drum)

After removing the shaft 31 and the bearing 30 as described above, the photosensitive drum 10 can be removed in the direction crossing the longitudinal direction thereof.

When removing the photosensitive drum 10, it is possible to remove only the shaft 31 so that the drum 10 is removed from the frame 13. In this case, the steps can be shortened.

Figure 33:
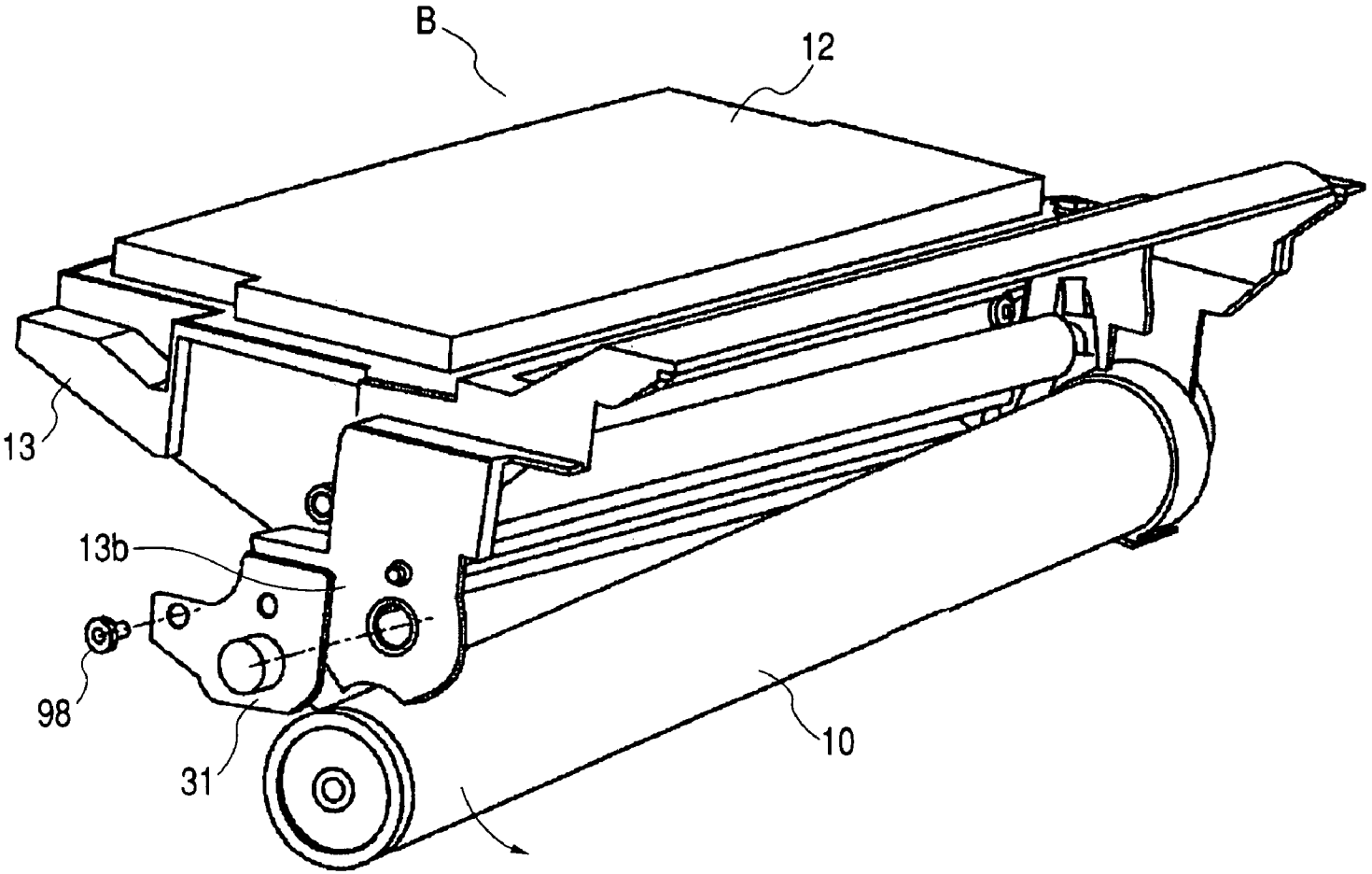
FIG. 33 is a diagram for explaining removal of a photosensitive drum.

On this occasion, the photosensitive drum 10 is removed by shifting the non-drive side first (see FIG. 33)

By removing the photosensitive drum 10, it becomes possible to exchange the photosensitive drum 10 and to remove toner contained in the waste toner container 12 as being described later.

(Process of Removing Charging Roller 11)

Figure 34:
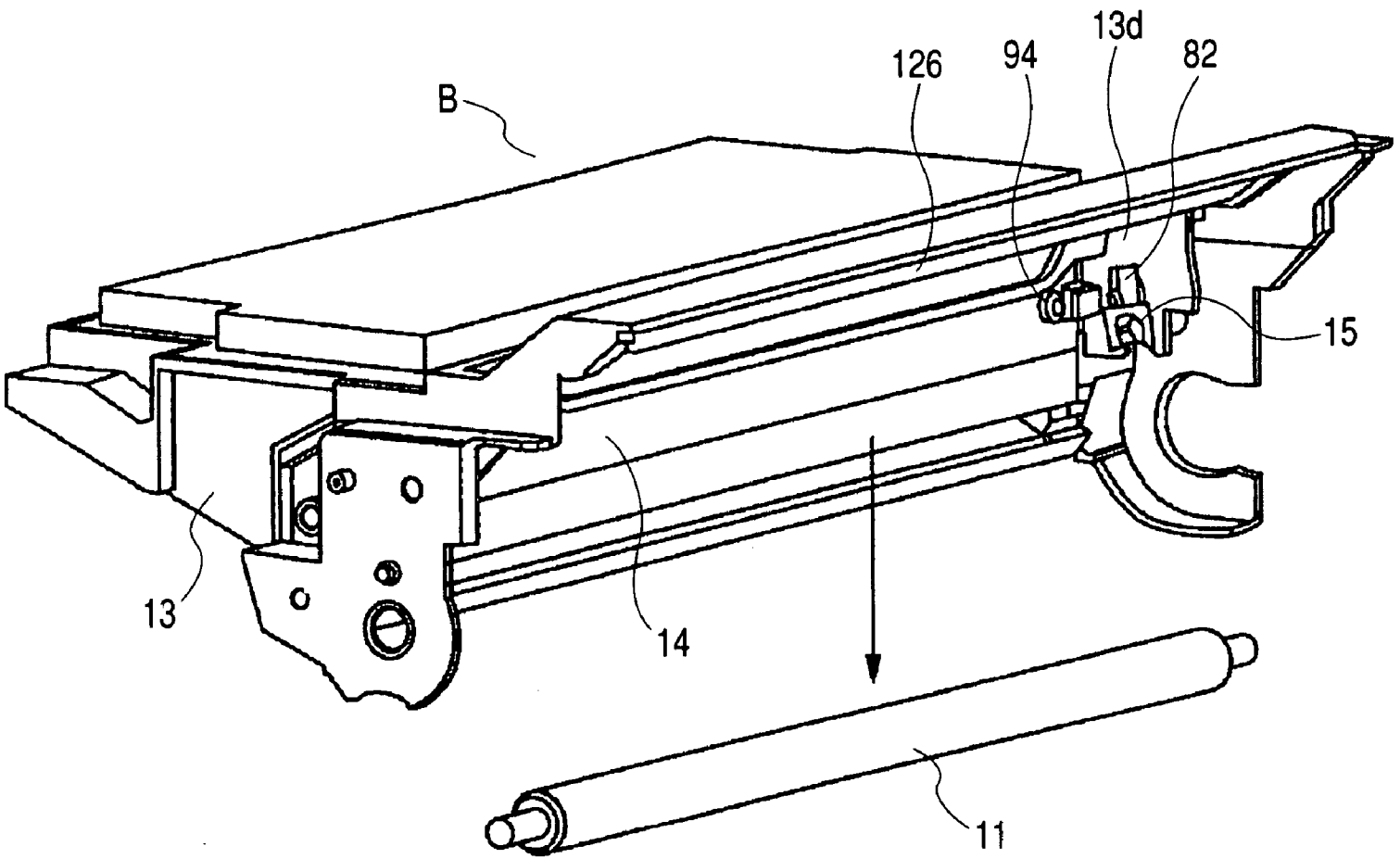
FIG. 34 is a diagram for explaining removal of a charging roller.

Next, as shown in FIG. 34, the charging roller 11 that is provided to the inner wall 13*d* is removed. On this occasion, the bearing 15 and the biasing member 82 may be removed if necessary.

(Process of Removing Blade 14)

As described above, the drum frame 13 in this embodiment includes the frames 121 and 122 that are integrated by ultrasonic welding. In addition, as shown in FIGS. 2 and 13, the blade 14 and the drum frame 13 includes the rib 122*a* of the frame 122 that covers the surface of the blade supporting portion 14*b* at the attachment side of the photosensitive drum 10.

Figure 35:
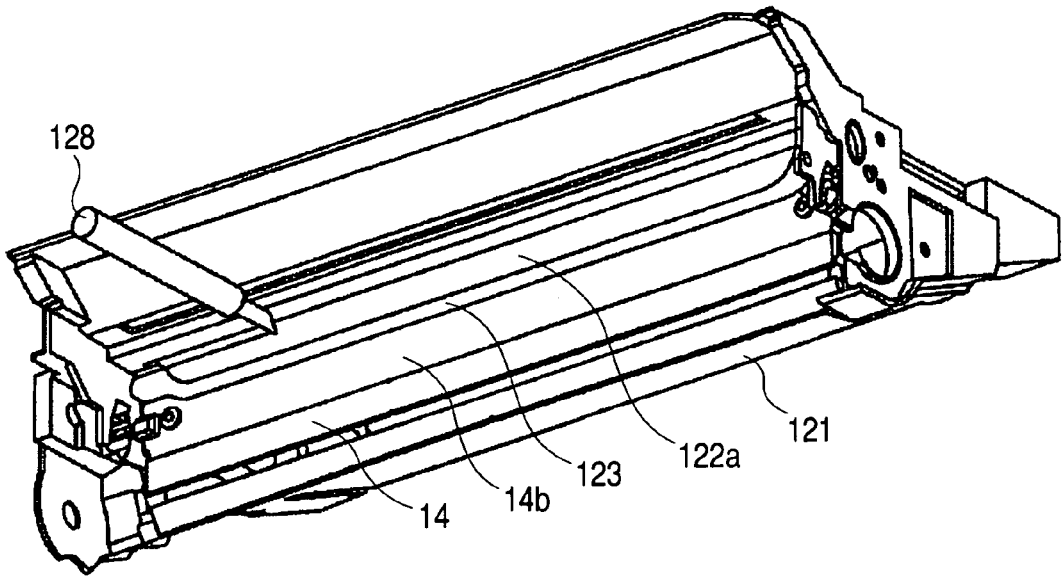
FIG. 35 is an explanatory diagram of steps for removing a cleaning blade.
Figure 36:
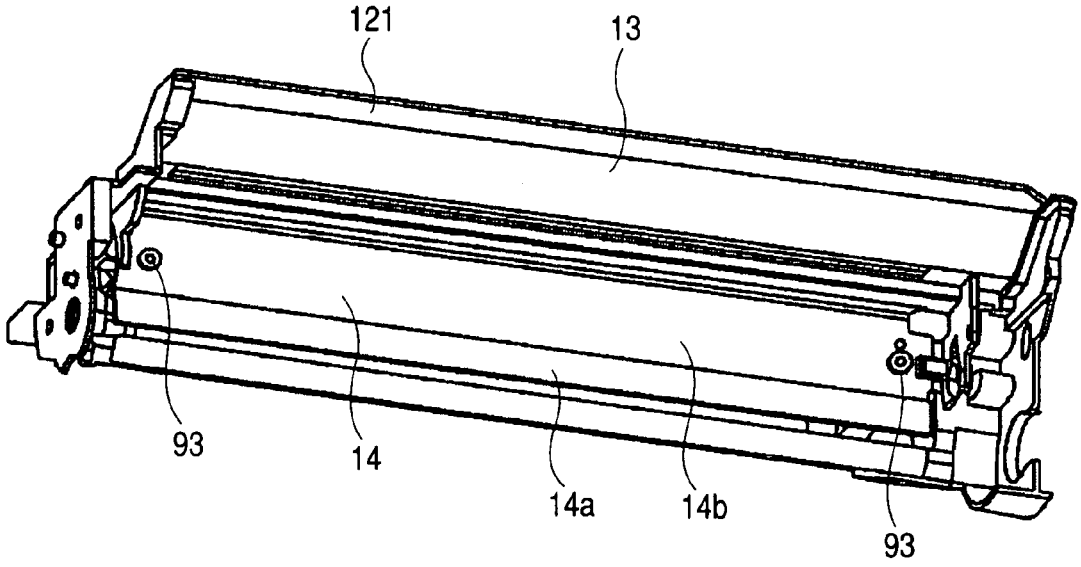
FIG. 36 is an explanatory diagram of steps for removing a cleaning blade.
Figure 37:
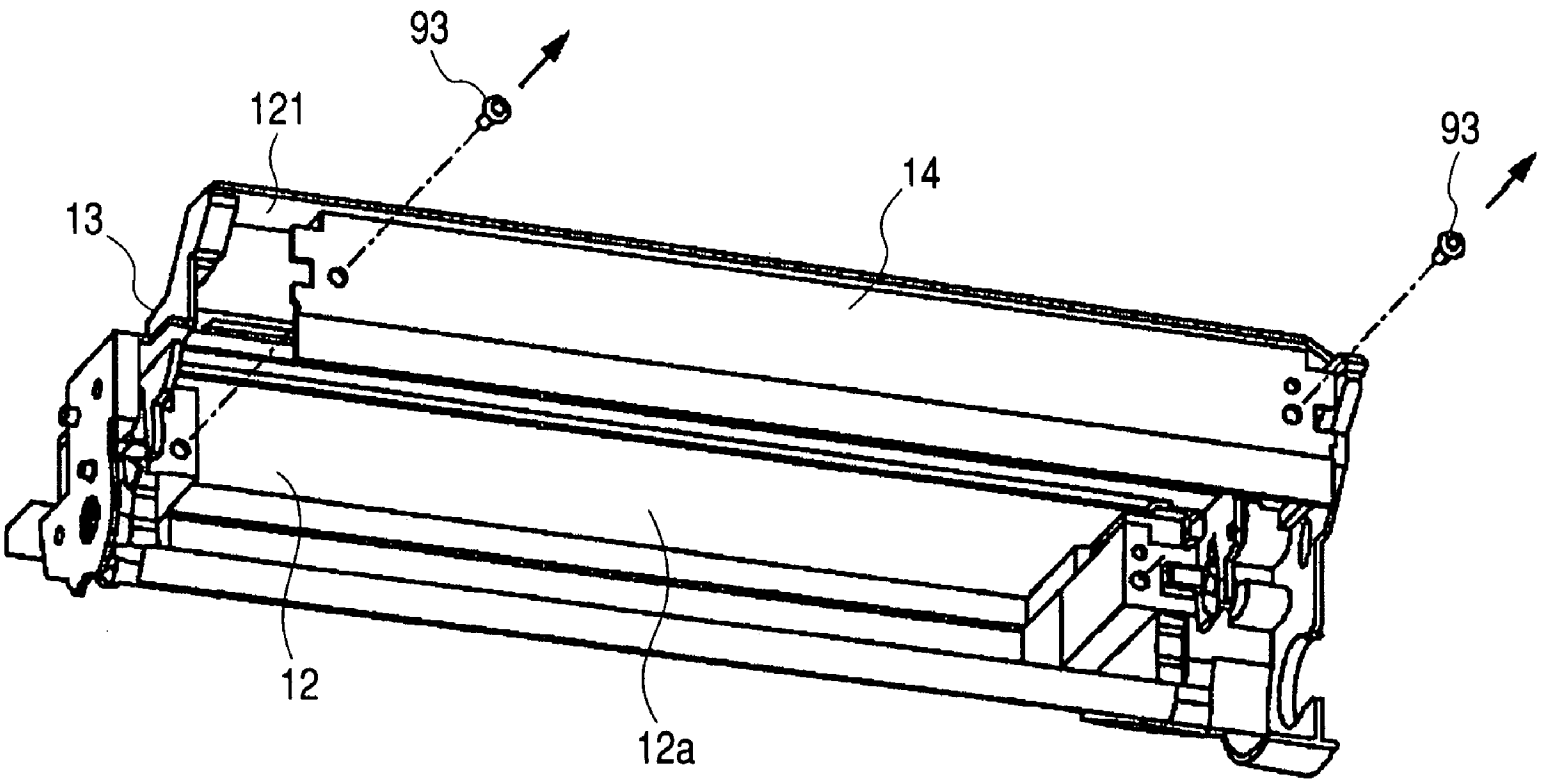
FIG. 37 is an explanatory diagram of steps for removing a cleaning blade.

Therefore, when removing the blade 14 from the drum frame 13, the rib 122*a* is cut off by using a tool 128 such as a cuter, an ultrasonic cutter or a milling cutter as shown in FIG. 35. After removing the rib 122*a* (see FIG. 36), a screw 94 is removed so that the blade 14 is removed from the drum frame 13 (see FIG. 37).

By performing this process, the blade 14 can be removed from the drum frame. 13 easily and securely.

(Process of Removing Developer)

Furthermore, after removing the blade 14, toner is removed from the toner container 12. Since the blade 14 is removed, the opening 12*a* of the container 12 is large enough to remove the toner easily (see FIG. 37).

In the step of removing the developer, the toner is removed from the container 12 by vacuum suction of the toner from the inside of the container 12 or by blowing the toner by compressed air. In addition, it is preferable to supply the compressed air into the container 12 and to perform the suction simultaneously so that the toner is not dispersed and is removed fast.

In the above description, a process of removing the charging roller 11 is omitted. In the step of removing the developer, the step of removing the charging roller 11 may be omitted.

(Process of Reassembling Photosensitive Unit B)

The photosensitive unit B is reassembled by attaching the cleaning blade 14, the charging roller 11 and the photosensitive drum 10 to the drum frame 13 in this order.

Figure 38:
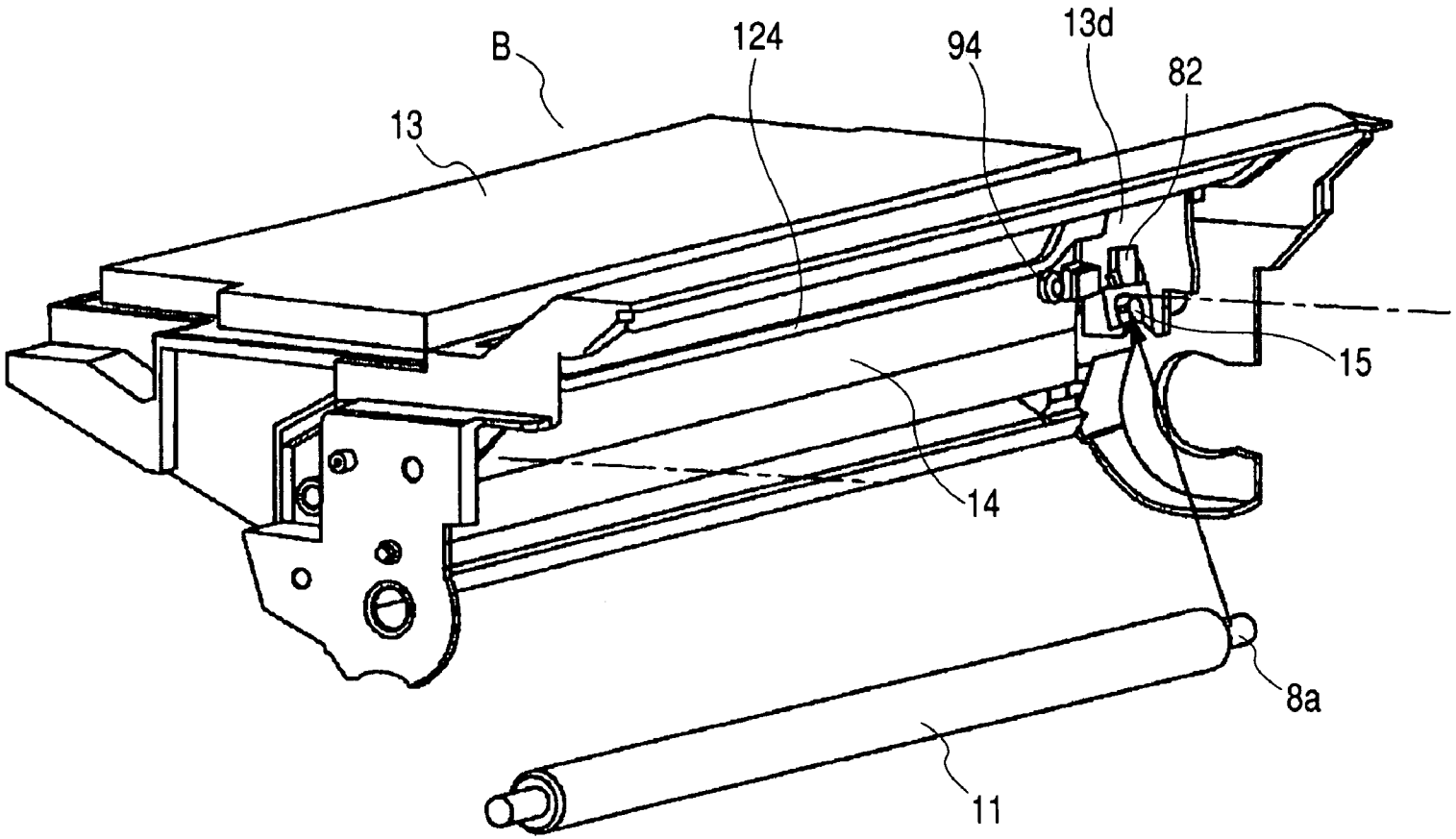
FIG. 38 is an explanatory diagram for assembling a charging roller.
Figure 39:
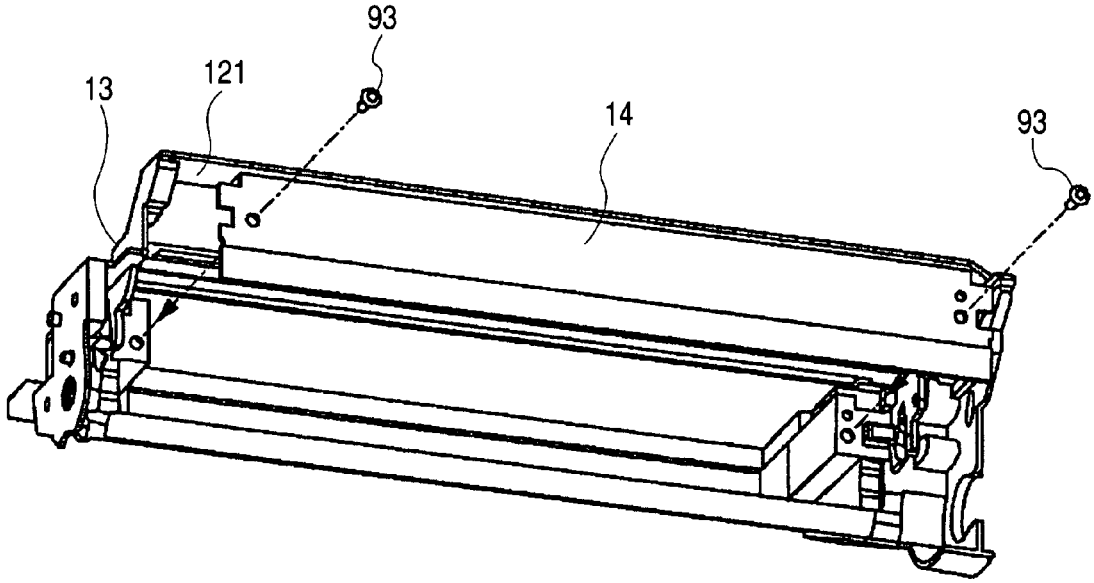
FIG. 39 is an explanatory diagram of a method for reattaching a cleaning blade.
Figure 40:
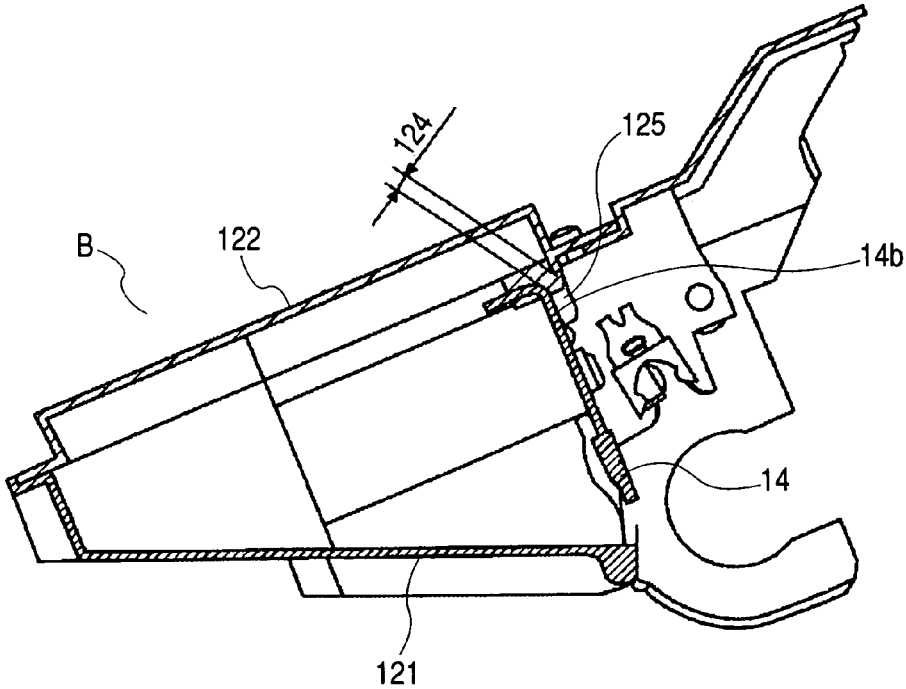
FIG. 40 is a perspective view of a photosensitive unit B.

The blade 14 that passed the inspection is reused. If the blade 14 cannot be reused as a result of the inspection, a new one is used. As shown in FIGS. 38 and 39, the blade 14 is attached to the frame 13 by using the screw 94. FIG. 40 shows a cross section of a unit B including the blade 14 as shown in FIG. 39 that is attached to the frame 13 by using the screw 94.

Figure 41:
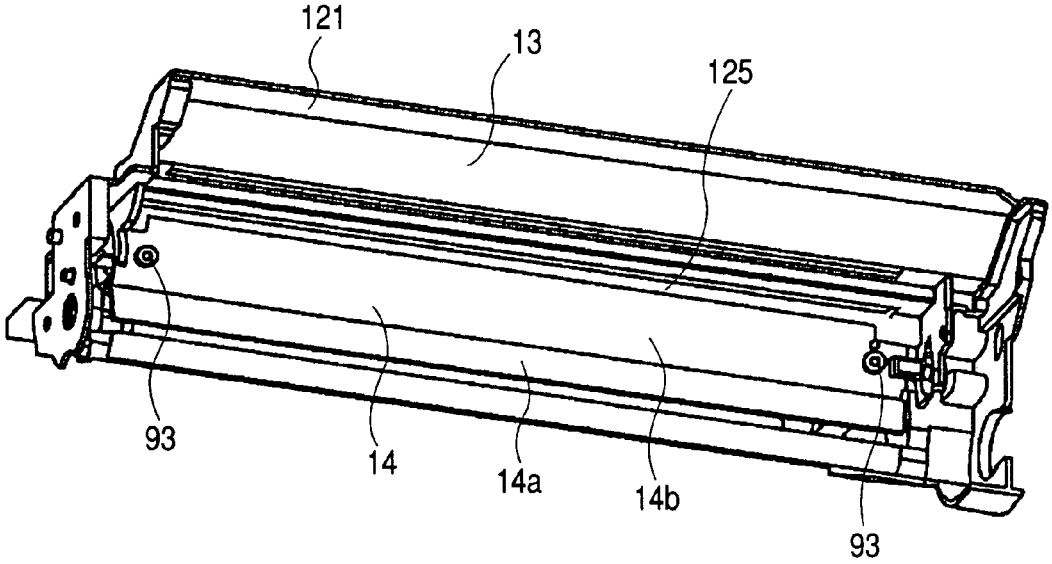
FIG. 41 is an explanatory diagram of a method for reattaching a cleaning blade.
Figure 42:
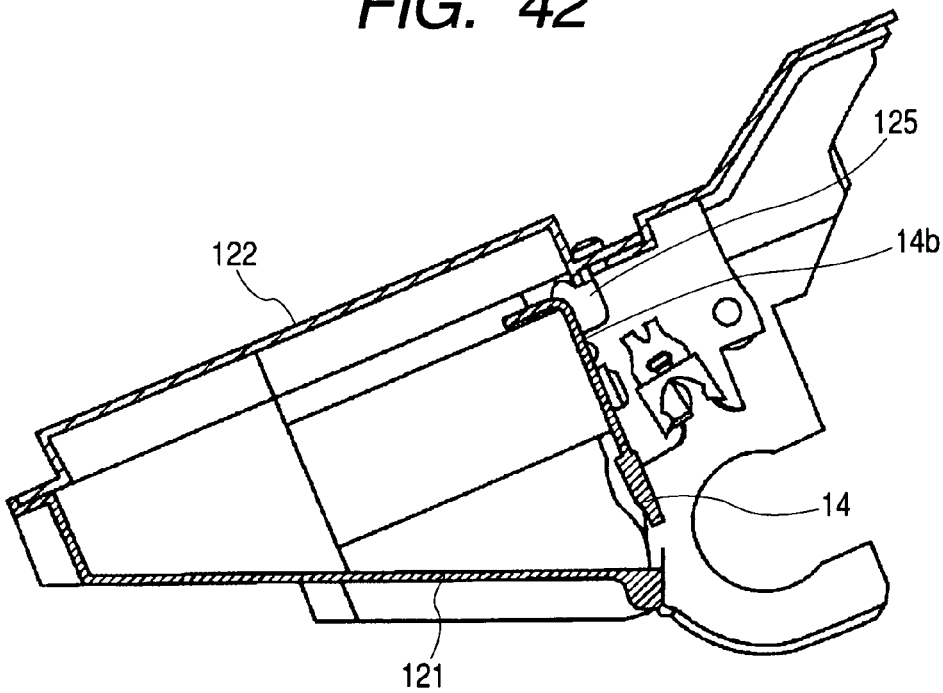
FIG. 42 is a perspective view of a photosensitive unit B.

As shown in FIG. 41, the gap 124 between the frame 13 and the blade 14 is sealed by injecting a fluid material 125 such as a foaming elastomer, an adhesive, a grease and a molten resin in the gap 124 between the frame 13 and the blade 14 over the entire area in the longitudinal direction (see FIG. 38). The cross section of the unit B in this case is shown in FIG. 42.

By using the above-mentioned resealing method, a single material and a single step can be used for resealing. Therefore, the number of parts can be reduced and the resealing can be performed by minimum man power. In addition, since the fluid material 125 is used, the tiny gap between the frame 13 and the blade 14 can be sealed securely. Thus, reliability can be improved.

Figure 43:
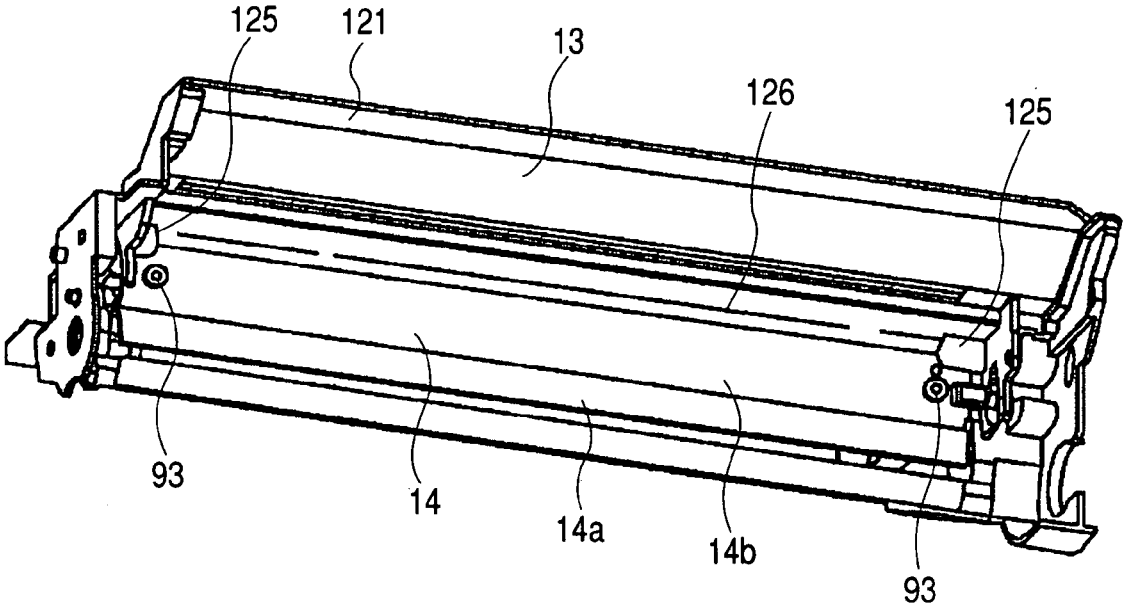
FIG. 43 is an explanatory diagram of a method for reattaching a cleaning blade.
Figure 44:
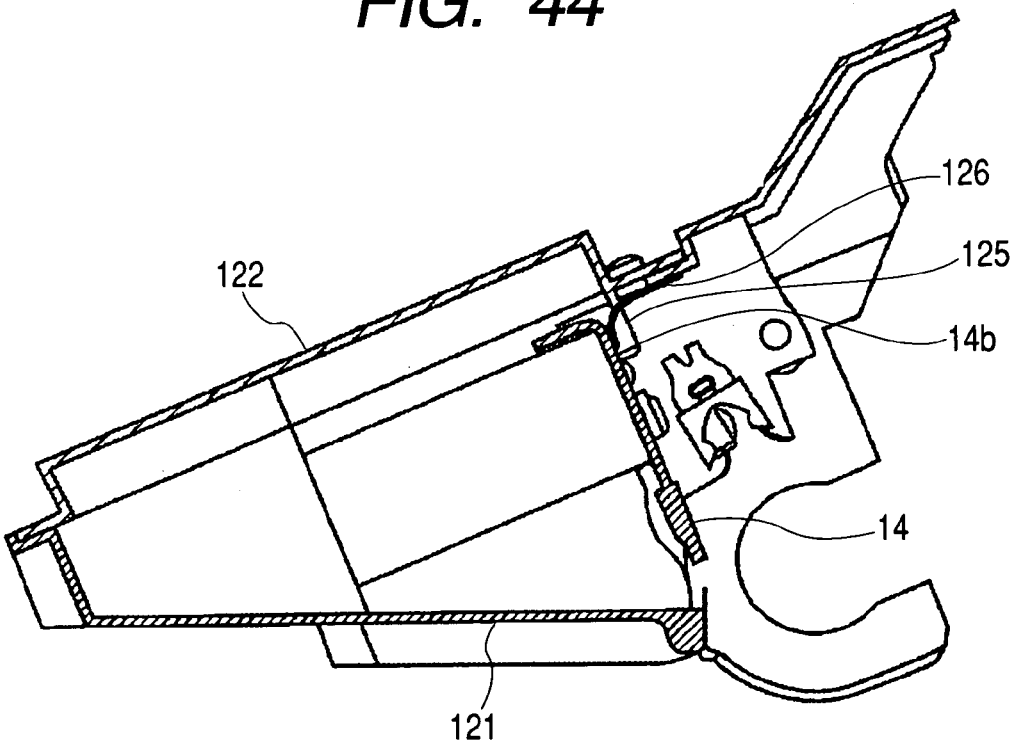
FIG. 44 is a cross section of a photosensitive unit B.

Alternatively, as shown in FIGS. 43 and 44 (FIG. 44 is a cross section of the unit B shown in FIG. 43), an adhesive tape 126 is used for bridging the frame 13 and the supporting portion 14*b* of the blade 14 over the entire area in the longitudinal direction. Then, the fluid material 125 such as a foaming elastomer, an adhesive, a grease and a molten resin is applied to the end portions having too complicated shape to seal by the adhesive tape 126. In this way, the gap 124 is sealed.

By utilizing the above-mentioned resealing method, a major part of the gap 124 can be sealed by the inexpensive adhesive tape 126. Thus, the used amount of the fluid material 125, which requires higher cost and more difficult management of a storage condition, a heating condition and vaporization than the adhesive tape 126, can be reduced. That is, by using both the inexpensive adhesive tape 126 and the fluid material 125 having high sealing performance, a low cost and high reliability of the sealing can be realized.

Figure 45:
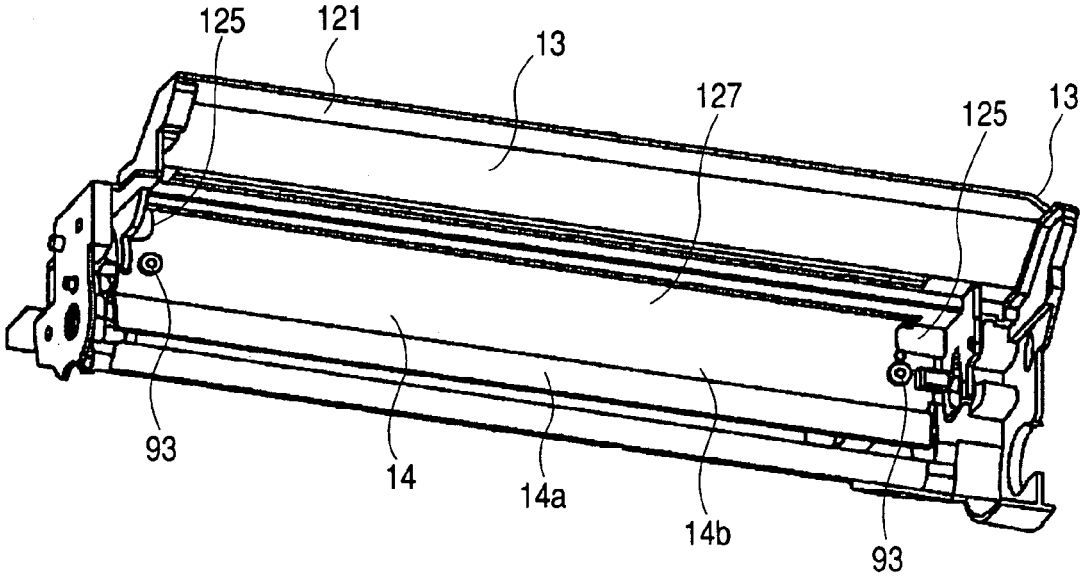
FIG. 45 is an explanatory diagram showing a method for reattaching a cleaning blade.
Figure 46:
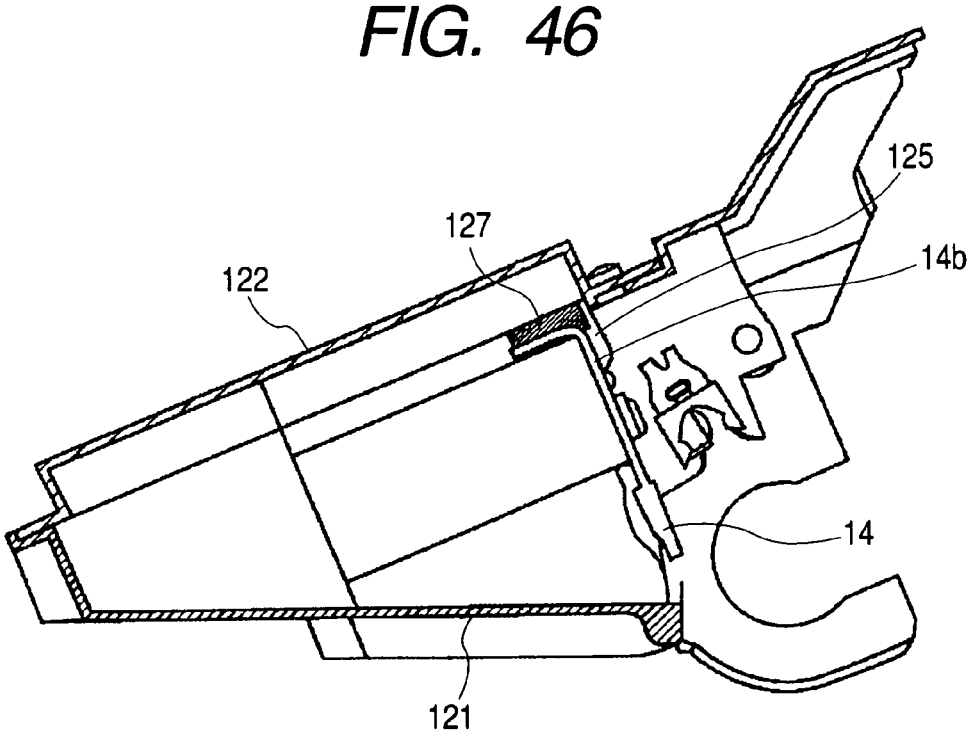
FIG. 46 is a cross section of a photosensitive unit B.

Alternatively, as shown in FIGS. 45 and 46 (FIG. 46 is a cross section of the unit B shown in FIG. 45), an elastic material 127 such as a sponge is inserted in the gap 124 over the entire area in the longitudinal direction. In addition, the fluid material 125 such as a foaming elastomer, an adhesive, a grease, or a molten resin is applied to the end portions of the gap 124. Thus, the gap 124 is sealed.

By utilizing the above-mentioned resealing method, a major part of the gap 124 can be sealed by the inexpensive elastic material 127 such as a sponge. Thus, the used amount of the fluid material 125 can be reduced. That is, by using both the inexpensive elastic material 127 and the fluid material 125 having high sealing performance, a low cost and high reliability of the sealing can be realized.

Although the above-mentioned structures are desired, it is possible to use the adhesive tape 126 or the elastic material 127 to seal the entire area in the longitudinal direction.

Next, the core metal 8*a* of the charging roller 11 is engaged with the bearing 15. If the bearing 15 and the biasing member 82 are removed in the disassembling process, the biasing member 82 and the bearing 15 are engaged with a bearing guide 19 (not shown) of the inner wall 13*d* of the drum frame 13. Then, the core metal 8*a* of the charging roller 11 is engaged with the bearing 15.

(Process of Inserting Drum 10)

Figure 47:
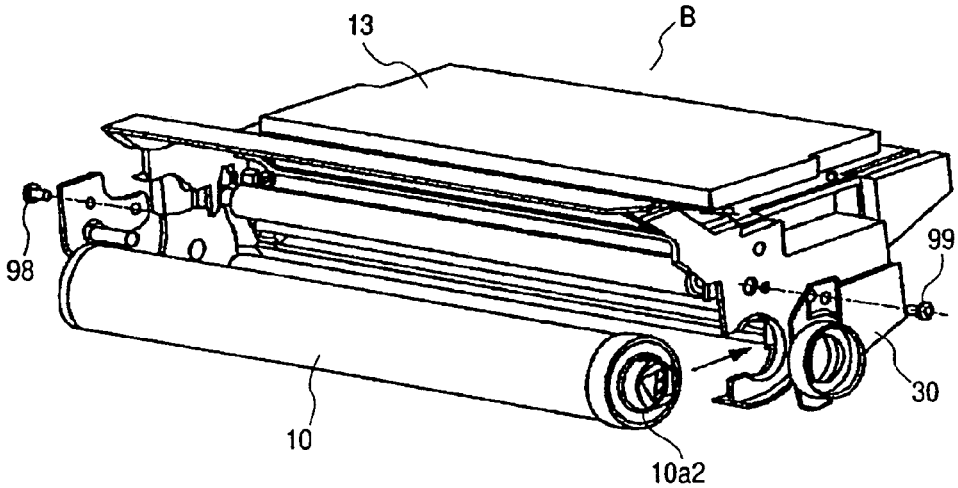
FIG. 47 is a diagram for explaining assembly of a photosensitive drum.

Next, as shown in FIG. 47, a new photosensitive drum 10 is inserted in the drum frame 13 in the direction crossing the longitudinal direction thereof. Here, when the photosensitive drum 10 is inserted in the drum frame 13, the shaft portion 10*a*2 that is provided to one end thereof is inserted in the cut portion 13*o* of the drum frame 13.

(Process of Attaching Drum 10)

The drum bearing 30 to be a bearing portion for supporting the shaft portion 10*a*2 that is provided to one end of the new photosensitive drum 10 is attached to one end of the drum frame 13 in the longitudinal direction by using a screw 99. In addition, the centering shaft 31 is attached to one end of the drum frame 13 in the longitudinal direction by using a screw 98.

Figure 48:
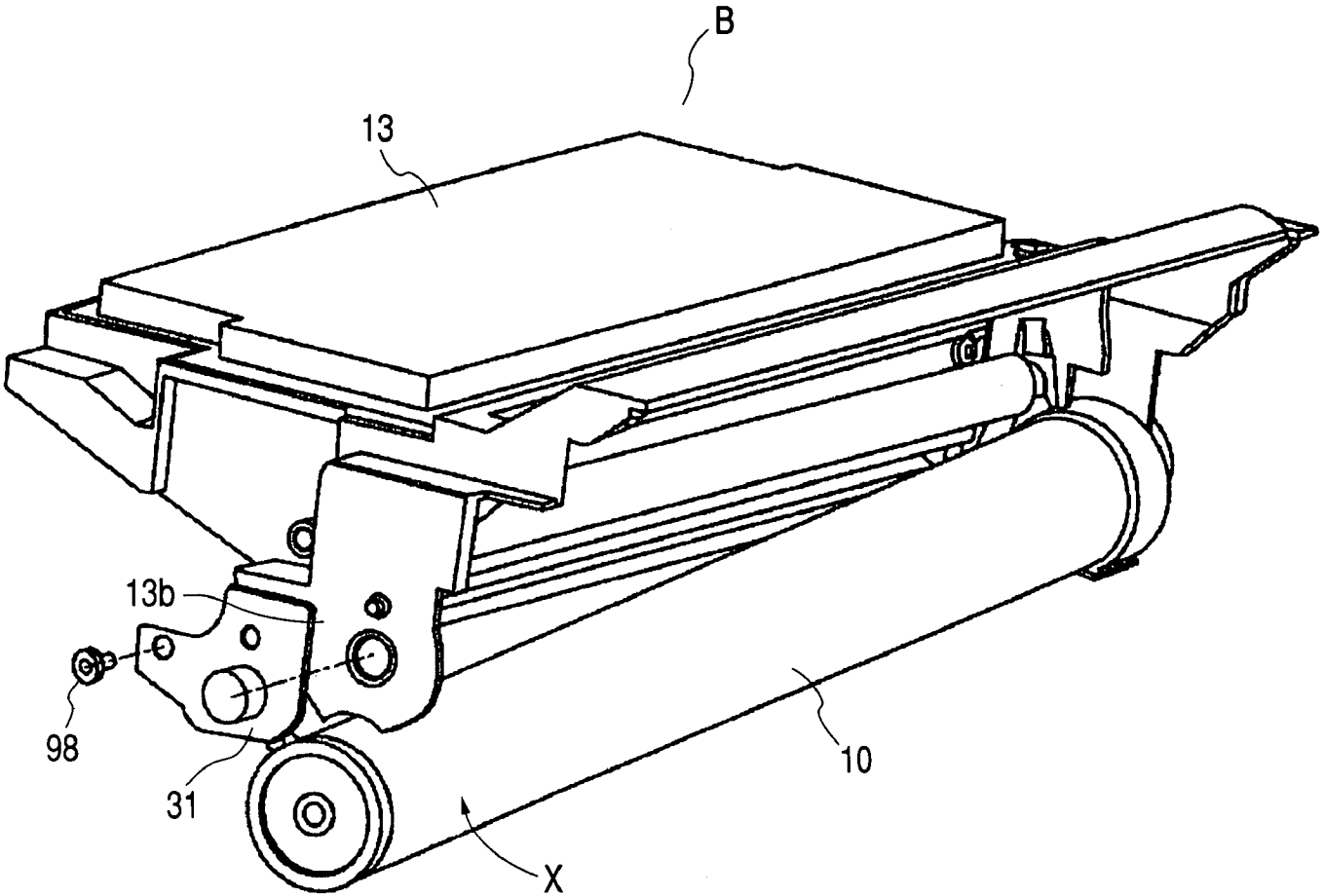
FIG. 48 is a diagram for explaining assembly of a photosensitive drum.

If the photosensitive drum 10 was removed from the frame 13 by removing only the shaft 31, the drive side flange 10*a* of the new photosensitive drum 10 is inserted first in the inner diameter portion 30*a* of the drum bearing 30. Then, by shifting the non-drive side in the direction of the arrow (direction indicated by the arrow X) shown in FIG. 48, the shaft 31 may be attached to one end of the frame 13 in the longitudinal direction by using a screw 98.

Next, the case where the toner supplying opening 51 is resealed by a new sealing member will be described. As described above, the reseal of the opening 51 is not always necessary.

When performing this reseal process, it is performed in accordance with the following (Process of resealing developer seal), (Process of resealing between developing frame and developer frame), and (Process of Reconnecting Developing Frame with Developer Frame).

Next, the following description is made with reference to FIGS. 29, 30 and 49–58.

(Process of Resealing Developer Seal)

Figure 56:
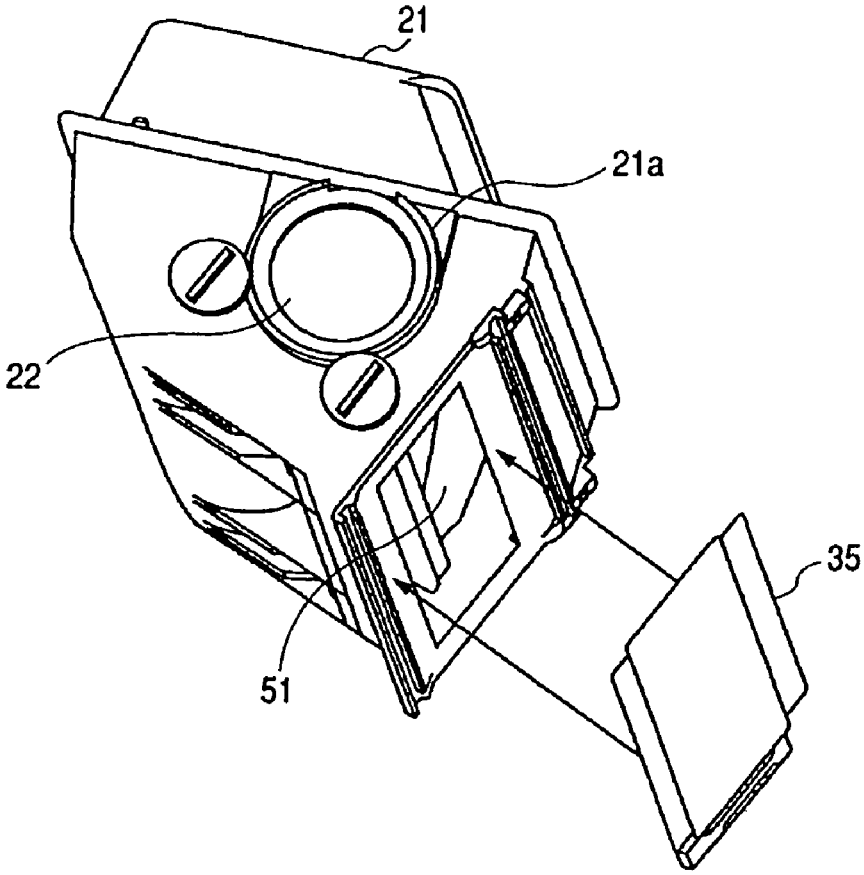
FIG. 56 is a perspective view of a developer frame according to an embodiment of the present invention.

As shown in FIG. 56, a developer seal member 35 is fixed to the opening 51 by using thermal welding, gluing, or a double faced adhesive tape for resealing. This seal member 35 is folded at the end in the longitudinal direction. The seal member 35 has a notch extending in the longitudinal direction at both end portions in the short side direction. That is, the seal member 35 can be ripped off when opening the seal of the opening 51.

(Process of Resealing Between Developing Frame 50 and Developer Frame 21)

Figure 57:
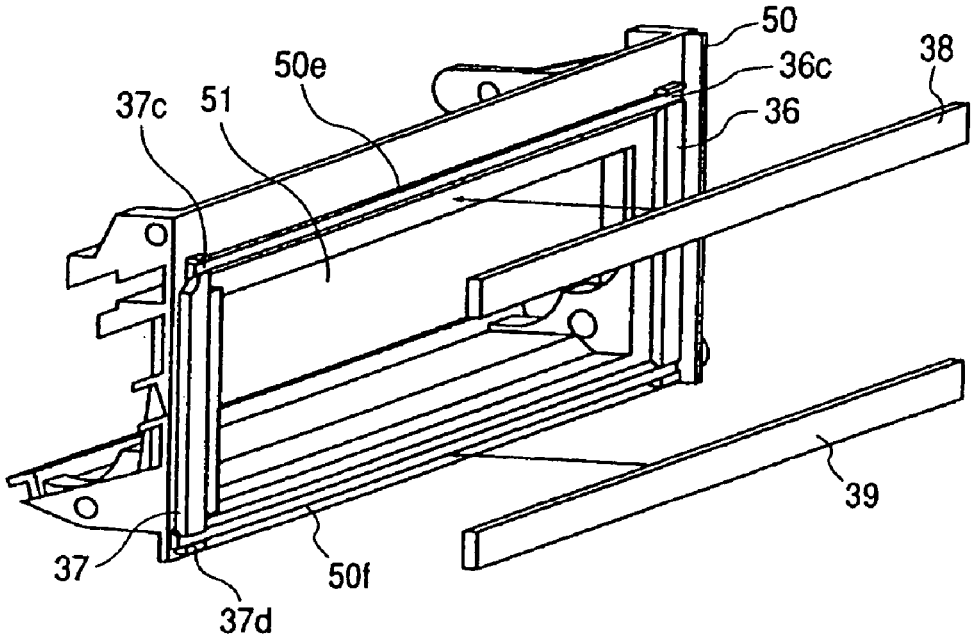
FIG. 57 is a perspective view of a developing frame according to an embodiment of the present invention.

As shown in FIG. 57, the disassembled developing frame 50 is in the state where the overlapping portions 36*c*, 37*c* and 37*d* between a triangular rib of protruding portions of the elastic seal members 36 and 37, which were melted and connected by an ultrasonic wave, are melted. Therefore, it is necessary to seal those portions so that toner does not leak through those portions when reconnecting them.

Therefore, as shown in FIG. 57, an elastic seal member 38 is glued over the elastic seal members 36 and 37 between the welding rib 50*e* and the upper side of the opening 51 of the developer frame 21. Thus, the upper side of the frame 21 is sealed. In the same way, an elastic seal member 39 is glued between the welding rib 50*f* and the lower side of the opening 51 so that the lower side of the frame 21 is sealed.

Figure 58:
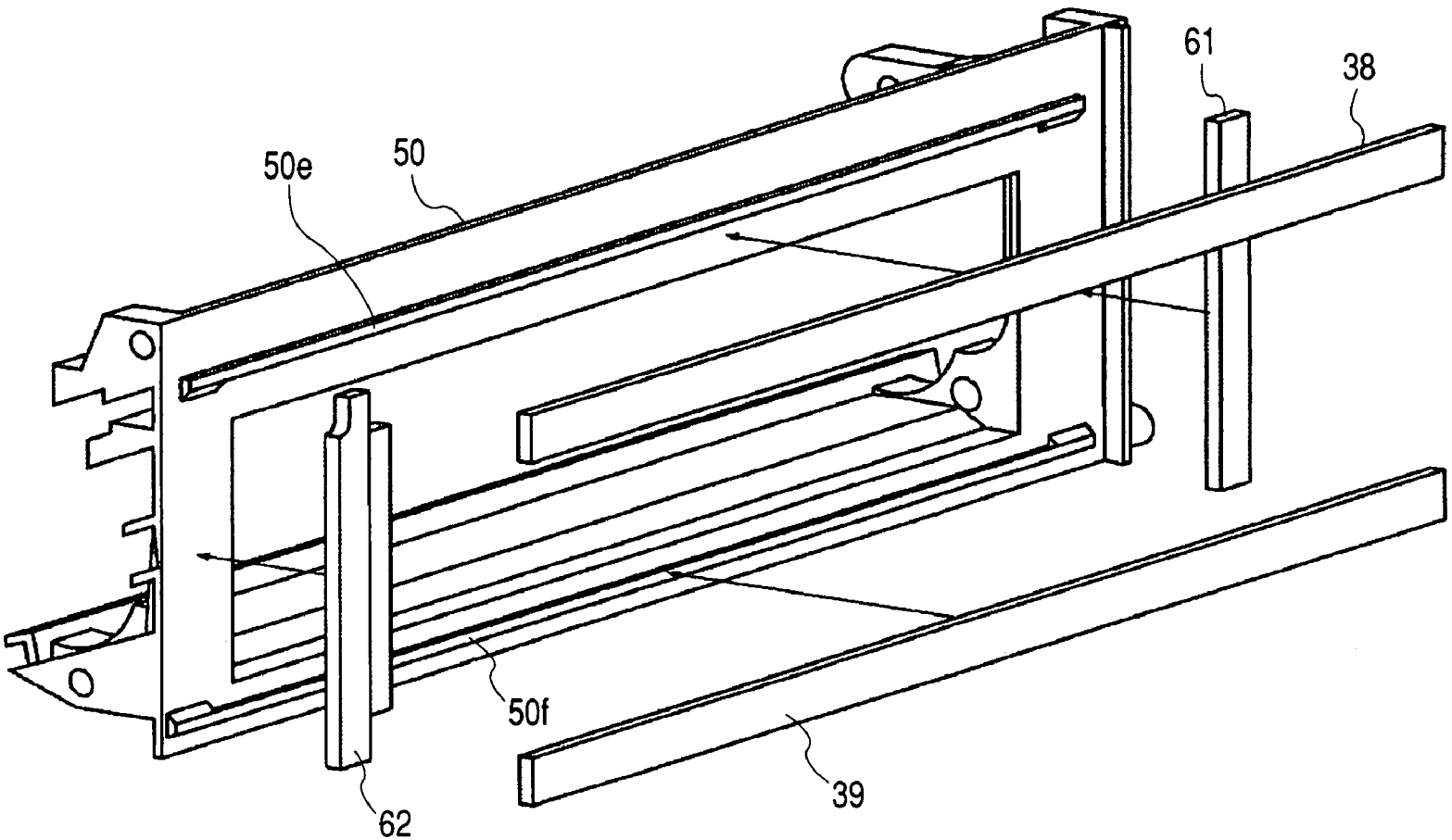
FIG. 58 is a perspective view of a developing frame according to an embodiment of the present invention.

In this way, it is possible to seal the entire periphery of the opening 51 by gluing the seal members 38 and 39. Further, as shown in FIG. 58, it is also possible to remove the elastic seal members 36 and 37 that seal both ends of in the longitudinal direction and are melted partially by welding. Then, new elastic seal members 61 and 62 are glued so as to seal both ends in the short side direction. It is also sealed in the same way by gluing the elastic seal members 38 and 39 in the longitudinal direction, respectively.

The elastic seal members 38, 39, 61, and 62 can be glued on the developer frame 21 in the same way as glued on the developing frame 50 for sealing. In addition, the elastic seal members 38, 39, 61 and 62 can be formed as one unit.

(Process of Reconnecting Developing Frame 50 with Developer Frame 21)

After that, the developing frame 50 is reconnected with the developer frame 21. A method of connecting the frames will be described as follows.

Figure 54:
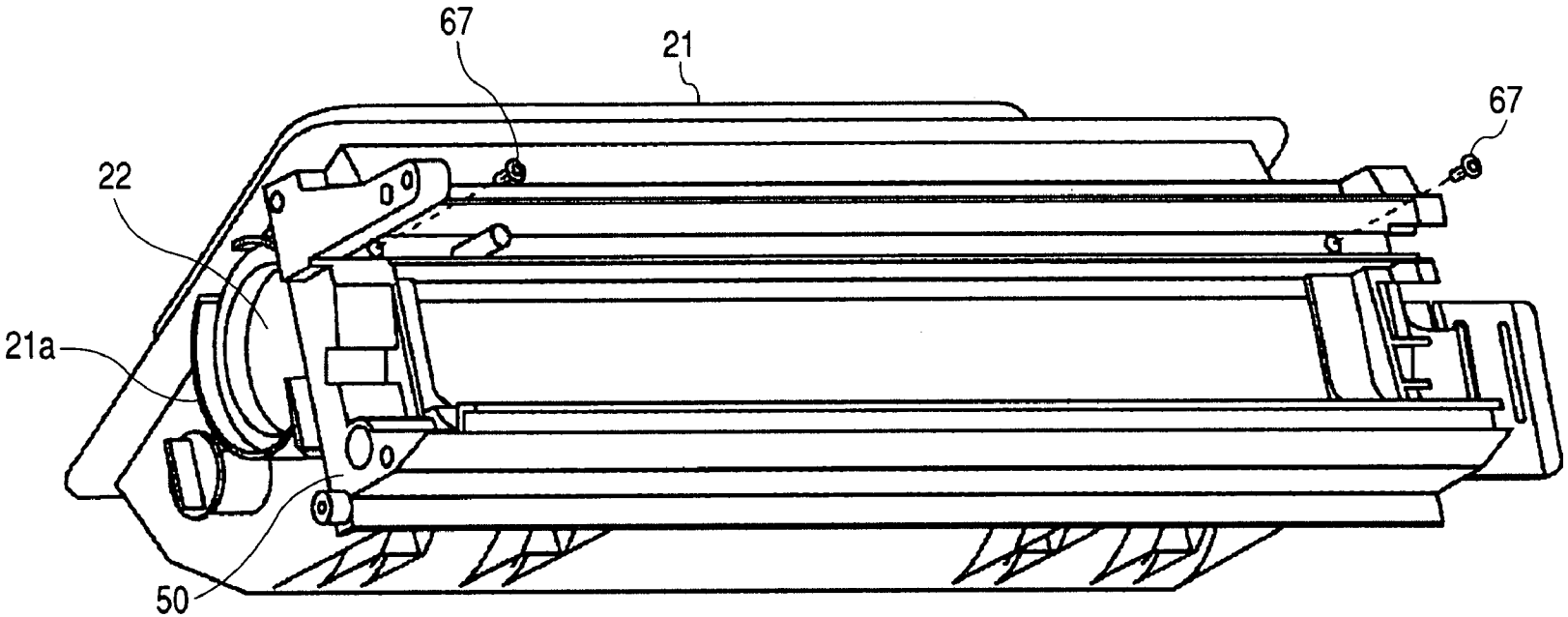
FIG. 54 is a perspective view of a developing device according to an embodiment of the present invention.
Figure 55:
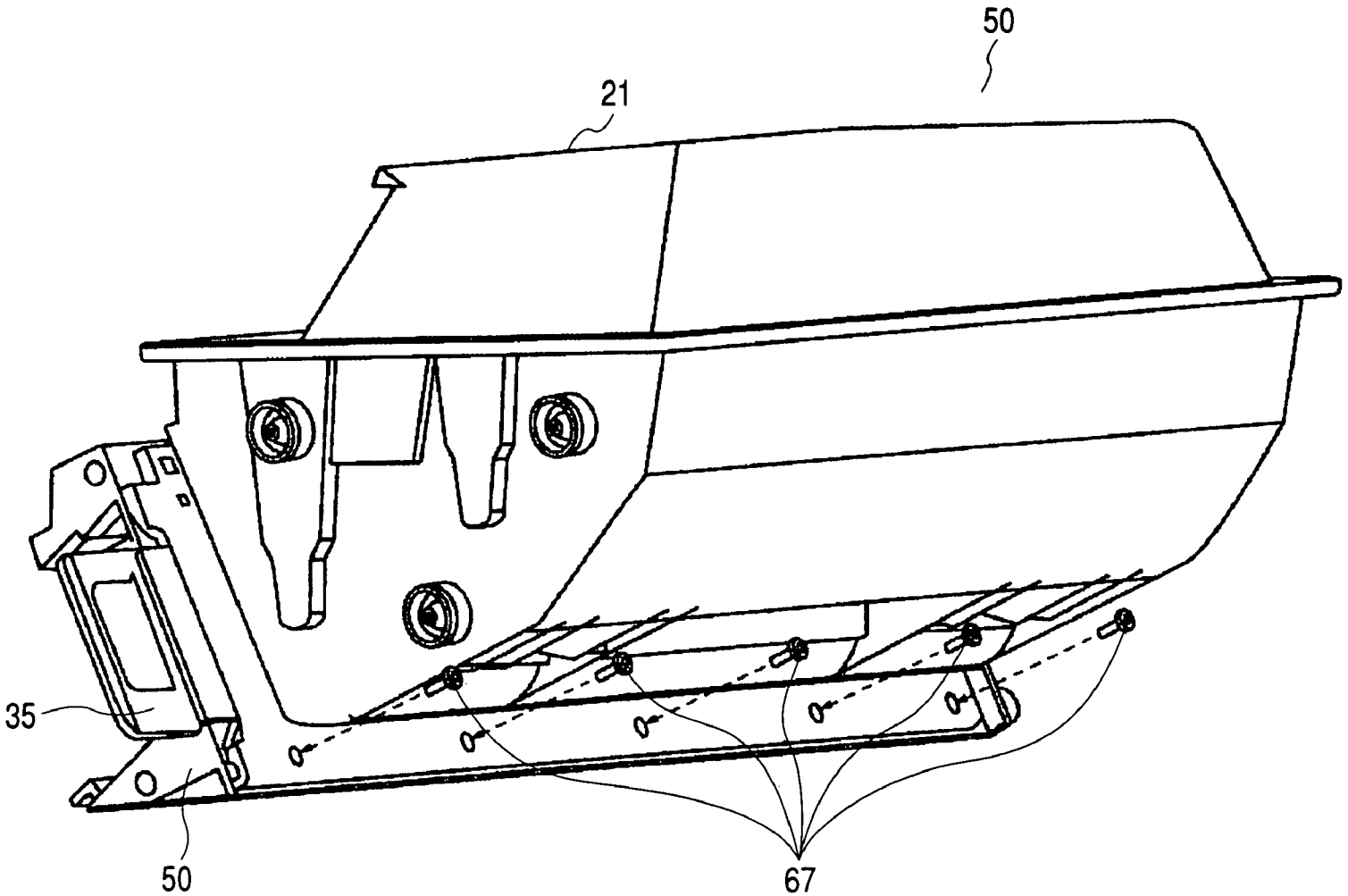
FIG. 55 is a perspective view of a developing device according to an embodiment of the present invention.

As shown in FIGS. 54 and 55, the connection of the developer frame 21 with the developing frame 50 can be performed by the method of connecting the frame 50 with an end of the frame 21 in the short side direction by using a screw 67. In another method, adhesive is applied on the connection surfaces of the frames 21 and 50 to be connected. In still another method, an adhesive double-coated tape is used for the connection surfaces of the frames 21 and 50. In still another method, a resin is melted through the heat application for connecting the frames 21 and 50. However, the method will be described, in which a clip made of a U-shaped spring 63 is used for pinching and connecting the frames 21 and 50.

Figure 49:
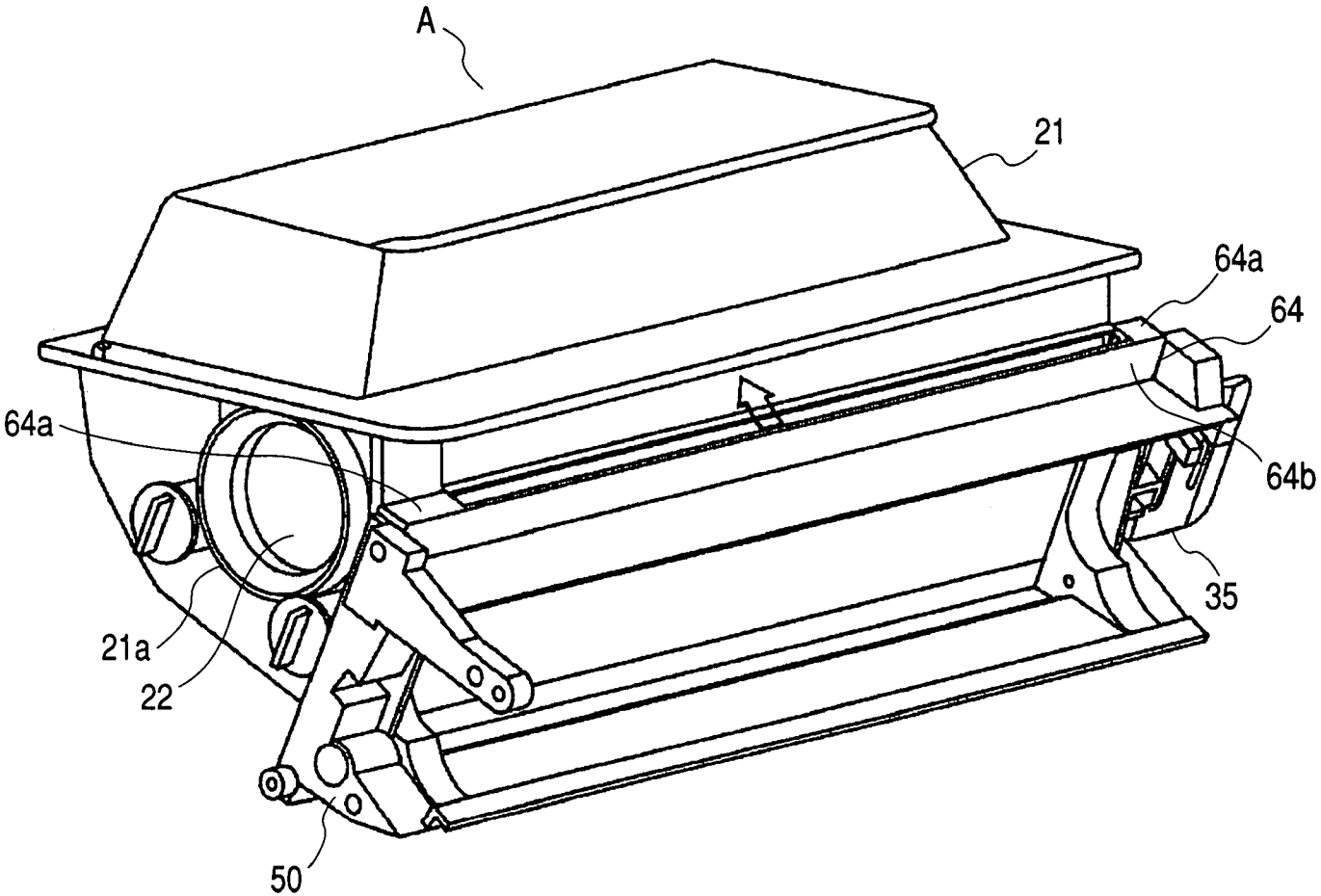
FIG. 49 is a perspective view of a developing device according to an embodiment of the present invention.
Figure 50:
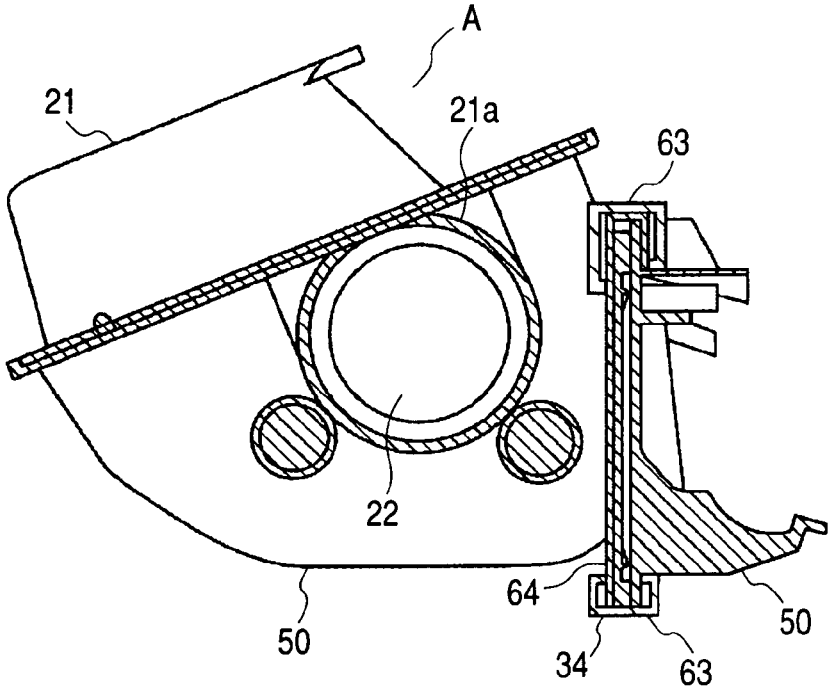
FIG. 50 is a cross section of a developing device according to an embodiment of the present invention.
Figure 51:
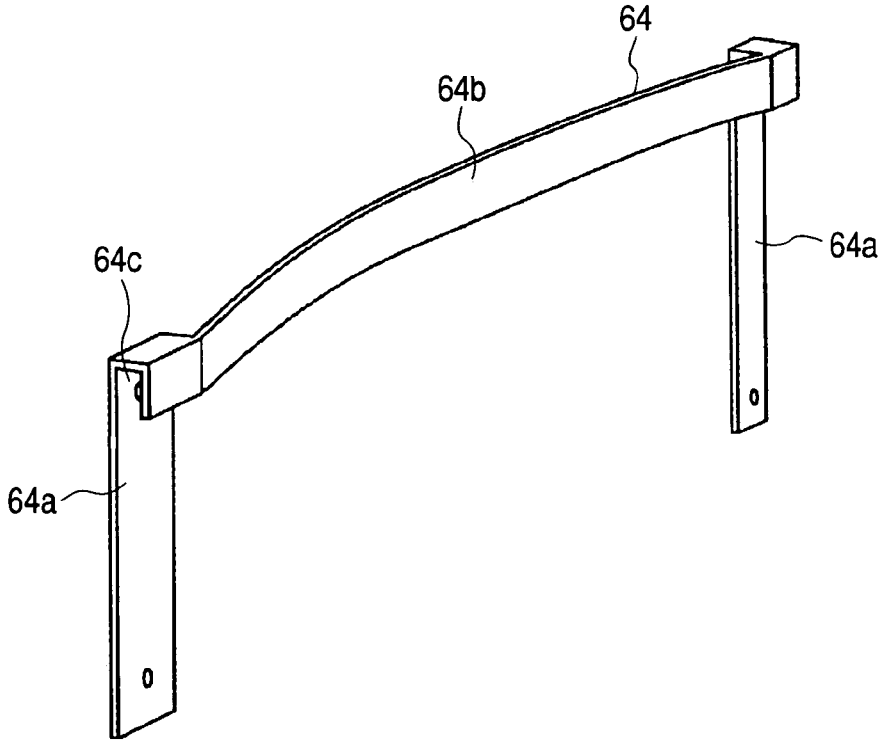
FIG. 51 is a perspective view of a frame connecting member according to an embodiment of the present invention.
Figure 52:
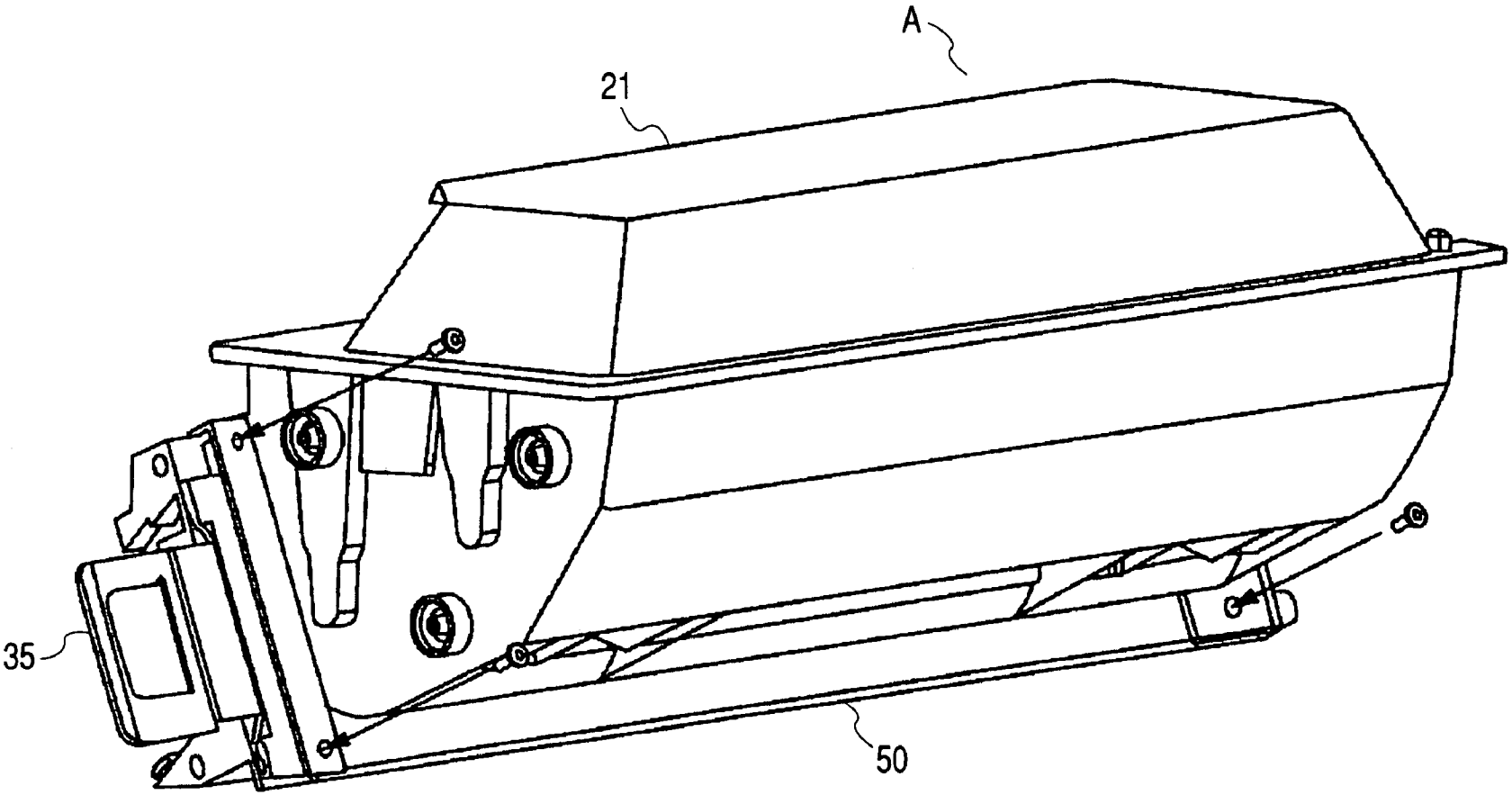
FIG. 52 is a perspective view of a developing device according to an embodiment of the present invention.
Figure 53:
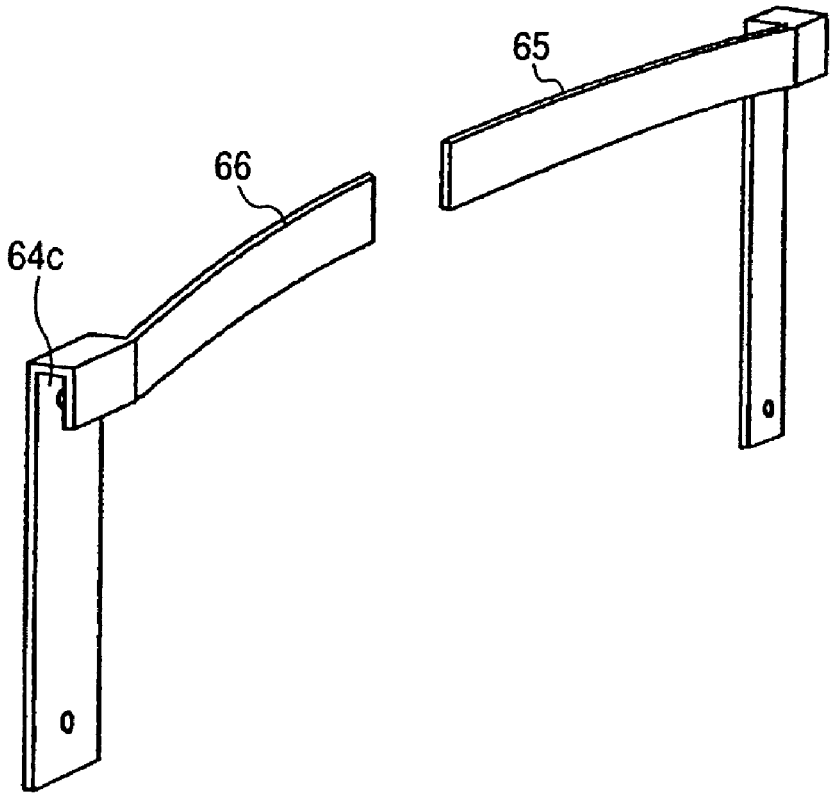
FIG. 53 is a perspective view of a frame connecting member according to the example.

As shown in FIG. 51, a connecting member 64 including a portion 64*a* fixed to the flange portions of the frames 21 and 50 at both ends in the longitudinal direction and a spring portion 64*b* having a shape that the center portion protrudes more than the end portion in the longitudinal direction can be used for the connection. As shown in FIG. 50, the method of connection includes fixing the fixing portion of the connecting member 64 to the developer frame 21 or to both of the developer frame 21 and the developing frame 50 by a clip 64*c* made of a U-shaped spring (see FIG. 51). Then, as shown in FIG. 49, the developing frame 50 is biased toward the frame 21 by the spring portion 64*b*. Thus, the frame 21 is connected with the frame 50. The connecting member 64 can be separated around a middle portion in the longitudinal direction as shown in FIG. 53. The fixing portions of the connecting members 64, 65 and 66 with the frames 21 and 50 have a shape of the clip 64*c*. Therefore the connection of the fixing portions of the connecting members 64, 65 and 66 to the frames 21 and 50 can be performed by pinching the frames 21 and 50. Alternatively, the adhesive, an adhesive double-coated tape, heat welding or a screw can be used for the connection.

Among the above-mentioned connection methods, use of the clip made of the U-shaped spring provides a good property of assembling since it is performed only by pinching. However, if the connection portion does not have the flange shape as in the upper side of the frame 21 of this embodiment, the clip cannot be used. Therefore, by using the connecting member 64 thus structured, when connecting the frames 21 and 50 that do not take a flange shape, they can be assembled easily. That is, even if the connection portion of the frame 21 does not have a flange shape, the developing frame 50 can be connected to the developer frame 21 easily.

As described above, the method of remanufacturing the cartridge C, which includes the step of resealing the opening 51 includes the following steps.

The method of remanufacturing a process cartridge C that is detachably attachable to an electrophotographic image forming apparatus main body 200 includes:

(a) a first cover removing step of removing a first cover member 80 on one end side in the longitudinal direction of the process cartridge C from a drum frame 13 and a developing frame 50 or a developer frame 21;

(b) a second cover removing step of removing a second cover member 81 on the other end side in the longitudinal direction;

(c) a frame separating step of separating the developing frame 50 or the developer frame 21 from the drum frame 13;

(d) a fixing pin removing step of separating the developing frame 50 from the first end cover 42 by removing the fixing pin 83;

(e) a supporting frame removing step of removing the supporting frame 40 from the developing frame 50 by removing the first end cover 42 and the second end cover 43;

(f) a developing frame removing step of removing the developing frame 50 from the developer frame 21;

(g) a developer refilling step of refilling developer T in a developer containing portion 21*x* through a toner supplying opening 51;

(h) a resealing step of resealing the toner supplying opening 51 by the seal member 35 that can be ripped off;

(i) a reconnecting step of reconnecting the developing frame 50 and the developer frame 21 by the connecting member 110;

(j) a step of positioning provisionally the supporting frame 40 to the developing frame 50;

(k) a developing roller attaching step of attaching the first and the second end covers 42 and 43 to the supporting frame 40 and rotatably attaching the developing roller 20;

(l) a supporting frame attaching step of attaching a fixing pin 83 so that the first end cover 42 is rotatably connected to the developing frame 50;

(m) a first frame connecting step of positioning and fixing a drum frame 13 and the developing frame 50 or a developer frame 21 with the first cover member 80 on one end side in the longitudinal direction; and (n) a second frame connecting step of positioning and fixing the drum frame 13 and the developing frame 50 or a developer frame 21 by the second cover member 81 on the other end side in the longitudinal direction.

In addition, in the step of connecting the developing frame 50 to the developer frame 21 by using a connecting member 110, a biasing member (the clip 64*c*) for biasing the developing frame 50 and the developer frame 21 to each other, and a biasing member (the spring portion 64*b*) for biasing the developing frame 50 to the developer frame 21 are provided.

Furthermore, the connecting member 110 includes the biasing member (the clip 64*c*) for biasing the developing frame 50 and the developer frame 21 to each other, and the biasing member (the spring portion 64*b*) for biasing the developing frame 50 to the developer frame 21, which are integrated into one unit.

In addition, the biasing member (the spring portion 64*b*) of the connecting member for biasing the developing frame 50 to the developer frame 21 is glued or fastened to either or both of the developing frame 50 and the developer frame 21.

A connecting member 64 for connecting a developing frame 50 and a developer frame 21 of a process cartridge C detachably attachable to a main body 200 of an electrophotographic image forming apparatus, the process cartridge C including:

an electrophotographic photosensitive drum 10;

a drum frame 13 for supporting the electrophotographic photosensitive drum 10;

a developing roller 20 for developing an electrostatic latent image formed on the electrophotographic photosensitive drum 10 by using the developer T;

a supporting frame 40 for attaching the first end cover 42 and the second end cover 43 that support the developing roller 20 in a rotatable manner;

the developing frame 50 for supporting the supporting frame 40 in a movable manner;

a fixing pin 83 for fixing the first end cover 42 to the developing frame 50 in a rotatable manner;

the developer frame 21 that has a developer containing portion 21*x* for containing the developer T and supplying the developer T to the developing roller 20 through a toner supplying opening 51 and is connected to the developing frame 50 via a first developing frame connection portion and a second developing frame connection portion opposed to each other with respect to the toner supplying opening 51, at least one of the first developing frame connection portion and the second developing frame connection portion not being in the flange shape;

a developer seal member 35 for sealing the toner supplying opening 51, which is detachable;

a first cover member 80 for positioning and fixing the drum frame 13 to the developing frame 50 or the developer frame 21 at one end in the longitudinal direction; and a second cover member 81 for positioning and fixing the frames 13, 21 and 50 at the other end in the longitudinal direction, in which the connection means 64 includes:

a biasing member (clip 64*c*) for biasing the developing frame 50 and the developer frame 21 to each other; and a biasing member (spring portion 64*b*) for biasing the developing frame 50 to the developer frame 21.

In the connecting member 64, the biasing member (the clip 64*c*) for biasing the developing frame 50 and the developer frame 21 to each other and the biasing member (the spring portion 64*b*) for biasing the developing frame 50 to the developer frame 21 are integrated into one unit.

Moreover, the biasing member of the connecting member 64 for biasing the developing frame 50 and the developer frame 21 to each other is glued or fastened to one or both of the developing frame 50 and the developer frame 21.

According to the method of remanufacturing the cartridge C and the connecting member, the developing frame 50 can be connected to the developer frame 21 easily even if the connection portion of the developer frame 21 does not have a flange shape.

Next, a method of reassembling the cartridge C will be described.

(Process of Connecting Frames)

Figure 59:
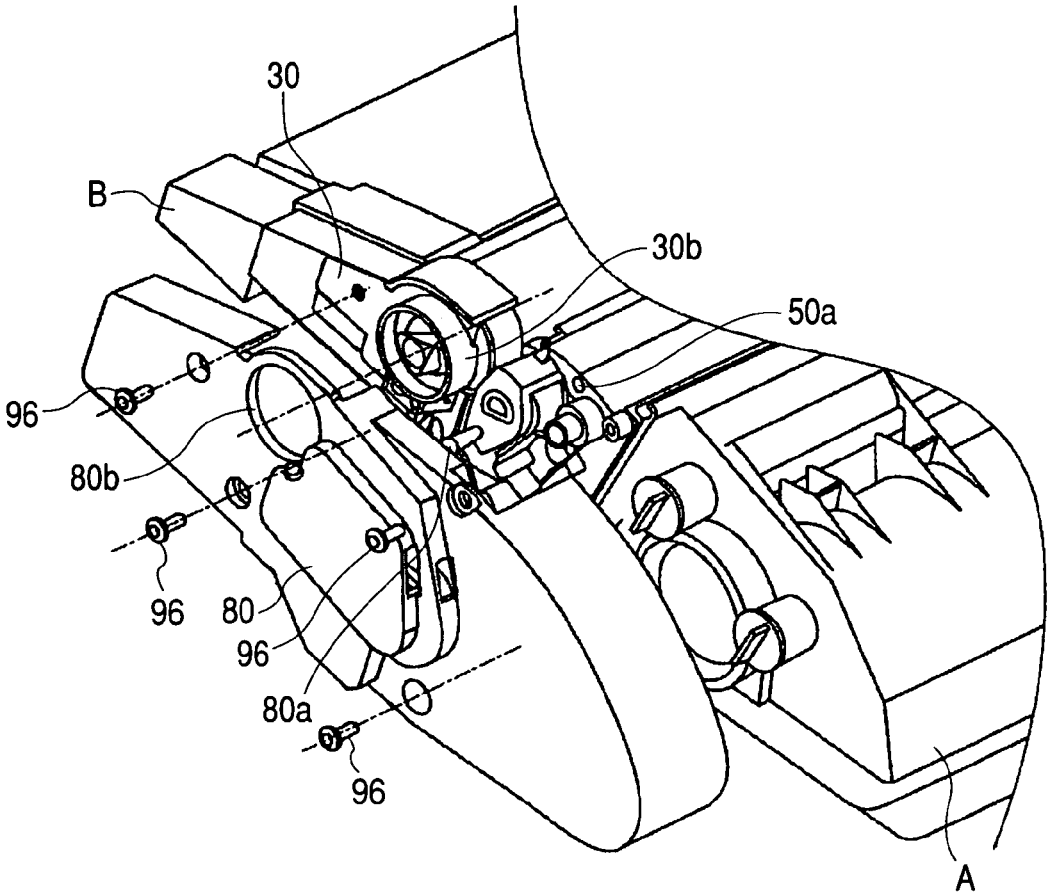
FIG. 59 is a diagram for explaining connecting of frames.
Figure 60:
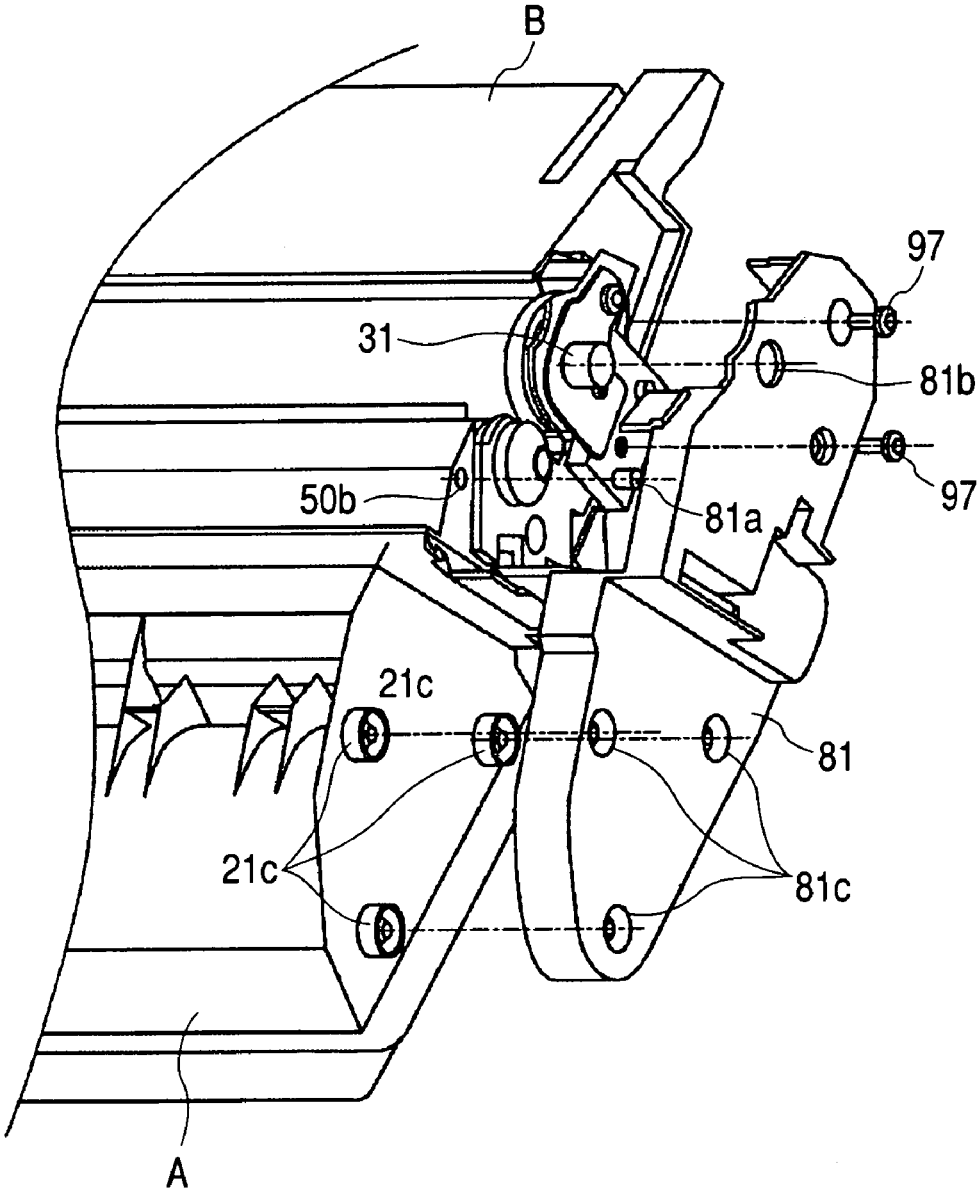
FIG. 60 is a diagram for explaining connecting of frames.

Finally, as shown in FIGS. 59 and 60, the units A and B are positioned so that they face each other. The positioning pin 80*a* of the cover member 80 with the unit A and the positioning hole 80*b* with the unit B are respectively engaged with the positioning hole 50*a* of the developing frame 50 and the outer diameter portion 30*b* of the drum bearing 30 of the unit B. Then the relative position between the units A and B is determined. After that, both the units A and B are connected to the cover member 80 by using the screw 96.

In the same way, the positioning pin 81*a* of the cover member 81 with the unit A and the positioning hole 81*b* with the unit B are respectively engaged with the positioning hole 50*b* of the developing frame 50 and the centering shaft 31 of the photosensitive drum 10 of the unit B. Thus, positioning of both the units A and B is completed. After that, the unit B is connected to the cover member 81 by using the screw 97.

The unit A and the cover member 81 are connected at the separated resin bonding portions in the following connecting process.

(Process of Connecting Resin Bonding Portions)

Figure 61A:
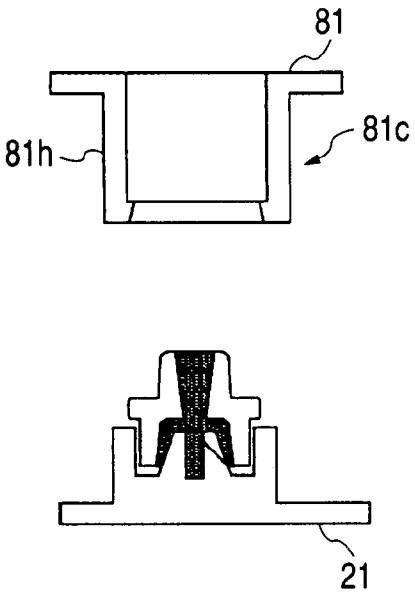
FIGS. 61A, 61B, and 61C are explanatory diagrams showing a process for connecting a resin connecting portion.
Figure 61B:
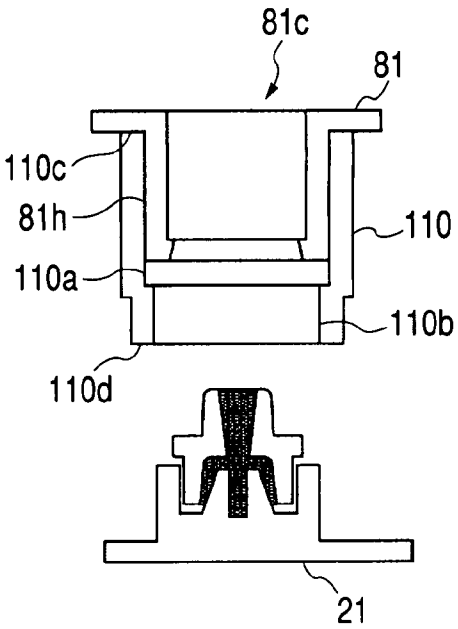
Figure 61C:
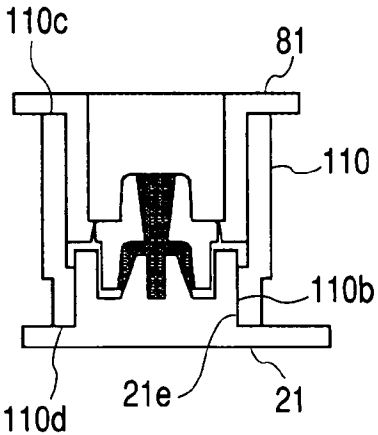

Next, a method of connecting the separated resin bonding portions will be described with reference to FIGS. 61A, 61B and 61C. FIG. 61A shows a cross section of the resin bonding portions that have been separated by the method described above. The cover member 81 is removed from the frame 21 in which the inner side of the cylindrical portion 81*h* of the resin bonding portion 81*c* is cut. When connecting the cover member 81 to the frame 21, the connecting member 110 is prepared as shown in FIG. 61B. The cylindrical portion 81*h* is pressed into a first press fitting portion 110*a* that is provided to the connecting member 110. Then, as shown in FIG. 61C, the cylindrical portion 21*e* of the resin bonding portion 21*c* of the frame 21 is pressed into a second press fitting portion 110*b* that is provided to the connecting member 110. Either process of pressing the cover member 81 or the frame 21 into the connecting member 110 can be performed first. The press fitting portion

110*a* has a cylindrical shape of a size so as to fit the cylindrical portion 81*h* tightly. In the same way, the press fitting portion 110*b* has a cylindrical shape of a size so as to fit the cylindrical portion 21*e* tightly.

Furthermore, in this embodiment, the end surface 110*c* of the connecting member 110 is positioned by abutting against the cover member 81. In addition, the end surface 110*d* of the connecting member 110 is positioned by abutting against the frame 21. That is, the cover member 81 and the frame 21 are positioned according to the length of the connecting member 110. Therefore, the length of the connecting member 110 is defined so that the cover member 81 and the frame 21 become in positions similar to positions before disassembled. Such a structure for positioning is not always necessary for obtaining the effect of this embodiment. However, by adopting this structure, it is possible to realize easier positioning and connection.

In this way, when connecting the cover member 81 with the frame 21, the separated resin bonding portions can be connected easily without providing a step of gluing or a post-process. The material of the connecting member is not limited to a specified one but can be any material that can provide sufficient connection force for connecting the cover member 81 with the frame 21 in accordance with a shape and a size of the press fitting portion.

As described above, the cartridge C can be reassembled easily and securely.

(Modifications of Process of Connecting Resin Bonding Portion)

The connecting member for connecting the cover member 81 with the frame 21 can have following shapes in addition to the cylindrical shape as described above.

Figure 62C:
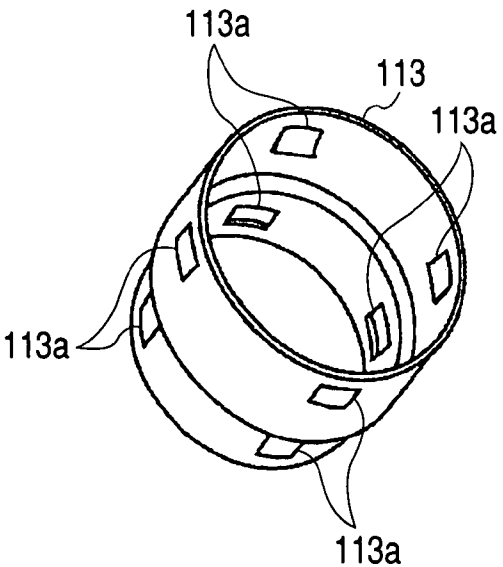
FIGS. 62A, 62B, and 62C are explanatory diagrams showing variations of a connecting member of the resin connecting portion.
Figure 62B:
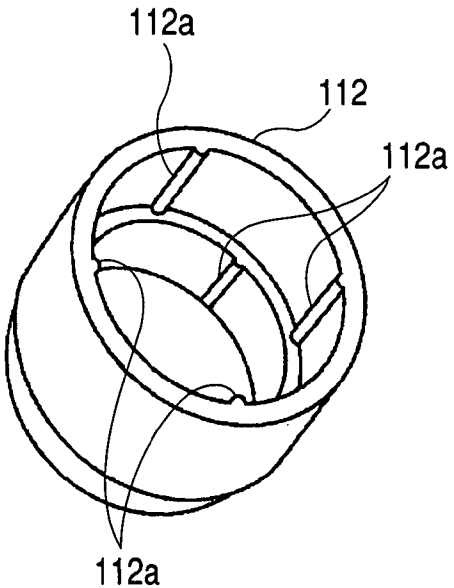
Figure 62A:
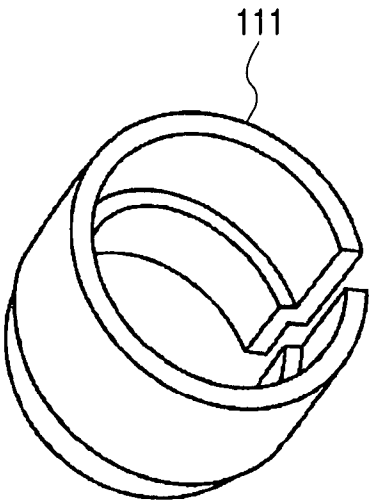

(1) As shown in FIG. 62A, it can be C-shape obtained by cutting the part of the connecting member 111. The inner diameter of the C-shape is set to a value smaller than the cylindrical portions 81*h* and 21*e* of the cover member 81 and the frame 21, respectively. When inserting the cylindrical portions 81*h* and 21*e*, the C-shape is expanded slightly. The connecting member 111 is made of a material having elastic property so that the C-shape can provide a fastening force to the cylindrical portions 81*h* and 21*e* when it is expanded by them. Thus, with this arrangement, even if the size of the inner diameter of the connecting member 111 or the size of the outer diameter of the cylindrical portions 81*h* and 21*e* has some variation, they can be connected securely without impairing the assembling property.

(2) A rib 112*a* is provided to the inner circumferential surface of a connecting member 112. When the cylindrical portions 81*h* and 21*e* are inserted, the rib 112*a* is crushed so as to generate a connection force. The material of the connecting member 112 may be a resin having an elastic property so that the rib 112*a* is crushed (see FIG. 62B).

(3) As shown in FIG. 62C, a connecting member 113 is a thin cylinder made of metal and has plural cut and raised pawls 113*a*. When the cylindrical portions 81*h* and 21*e* are inserted, the cut and raised pawls 113*a* are bent so as to exert a fastening force. If a force is applied to the cylindrical portions 81*h* and 21*e* in the removing direction, the cut and raised pawls 113*a* embed themselves in the cylindrical portions 81*h* and 21*e* so as to prevent dropping.

According to the structure described above, the connection between the resin bonding portions can be performed easily and securely.

In this way, the cartridge C can be assembled again.

<Case Where Connectors are Provided>

Figure 63:
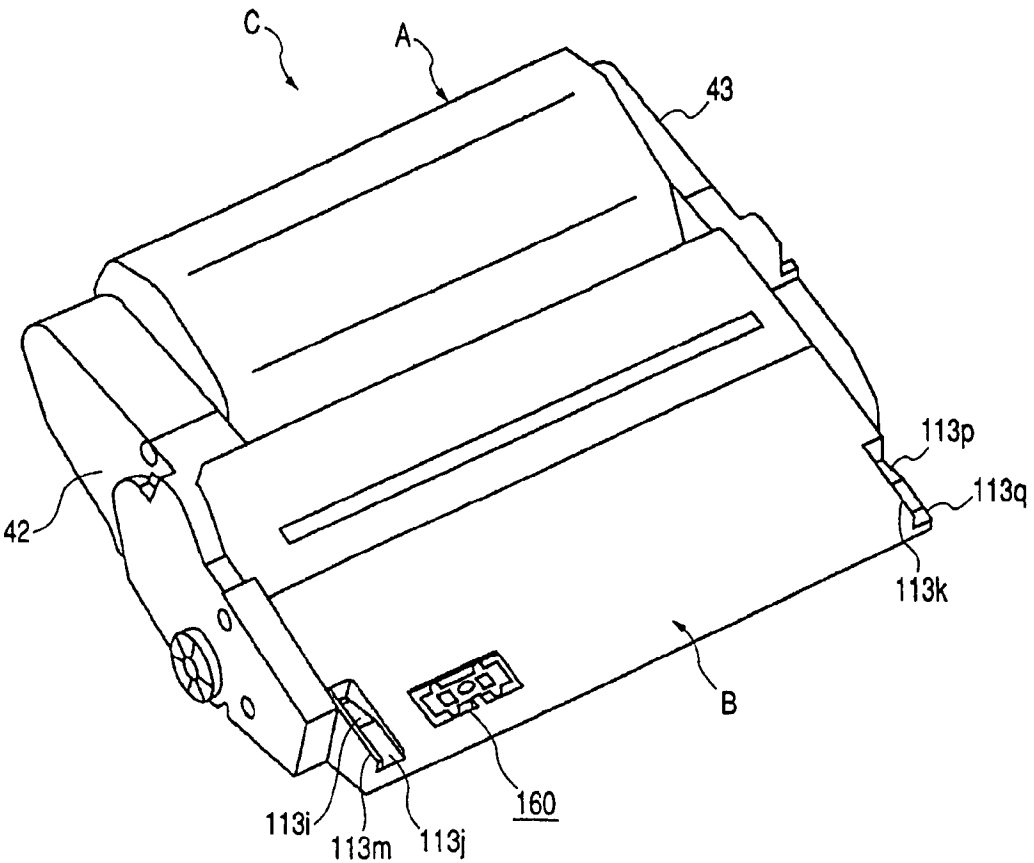
FIG. 63 is a perspective view of a process cartridge including a memory tag.

There is the case where a memory tag as shown in FIG. 63 is provided. In this case, there is a possibility that a rubbing flaw develops on the surface of the memory tag 160. Therefore, when remanufacturing the cartridge C, the tag 160 is exchanged if necessary.

Hereinafter, rubbing of the tag will be described. Each of the contact points of the memory tag 160 in the connector 440 is provided with one or two metal electric contacts 442 that generate contact pressure by deforming elastically. In addition, an abutting portion 441 that abuts against a contact portion of the memory tag 160 is provided to each end in the longitudinal direction at a portion close to the contact 442. A lead wire is connected to the opposite side of the contact portion with the memory tag 160, and the other end of the lead wire is connected to a control portion of the main body (not shown).

Figure 64:
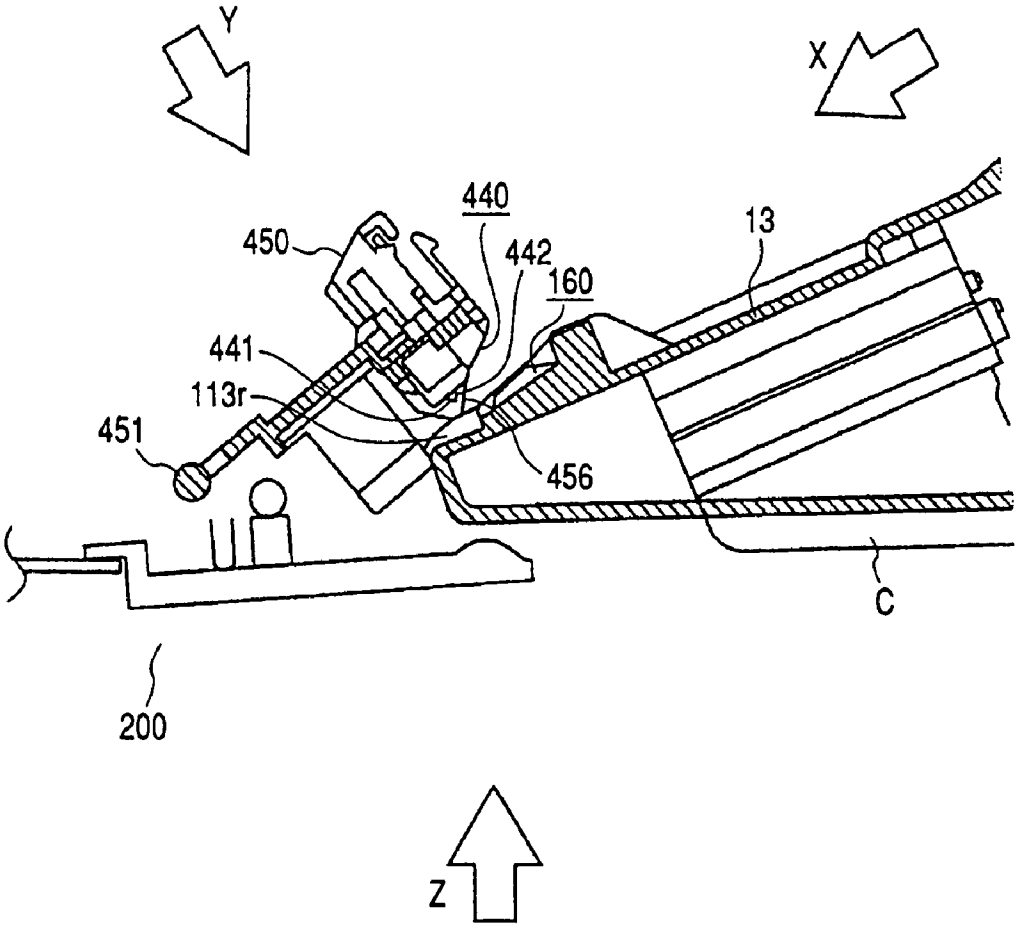
FIG. 64 is a perspective view of the main body of the apparatus having a mechanism for electrical connecting with the memory tag.

The connector 440 is fixed to a connector holder 450 by a snap fit, a screw and others (not shown). In addition, as shown in FIG. 64, the connector holder 450 rotates around a rotation axis 451 as described above. Moreover, the axis 451 is retained by the main body in a slidable manner by a bearing in the longitudinal direction (in the direction indicated by the arrow C). Then, a spring (not shown) applies biasing force to the holder 450 in the direction indicated by the arrow Y.

Next, connection of the connector 440 to the memory tag 160 in accordance with the operation of attaching the cartridge C to the apparatus main body 200 will be described.

Furthermore, a regulation abutting portion 113*i* at the right side of the cartridge C is disposed in a groove 113*j* that is an attachment guiding portion having a rib 113*m* as a wall member for opening and closing a shutter that is a laser beam shielding member (exposure light shielding member) of the apparatus main body 200 (see FIG. 63). In addition, a regulation abutting portion 113*p* at the left side is disposed in a groove 113*q* that is an attachment guiding portion having an opening at the outside (see FIG. 63). As shown in FIG. 64, when inserting the cartridge C in the apparatus main body 200 in the direction indicated in the arrow X, a fixed member (not shown) that is provided to the apparatus main body 200 is sandwiched between both end walls of the groove 113*j* (one of which is denoted by reference characters 113*k*) on the way of the insertion as shown in FIG. 64. In this way, the cartridge C is guided in the direction crossing the insertion direction of the cartridge C. When the cartridge C is further inserted, a positioning lever in the longitudinal direction of the holder 450 that is arranged in a movable manner in the longitudinal direction also enters the portion between both end walls of the groove 113*j*, one of which is the end wall 113*k*. Then, the position of the connector 440 to the cartridge C is defined in the longitudinal direction of the cartridge C.

That is, the end walls of the grove 113*j*, one of which is end wall 113*k*, are are also a positioning portion of the cartridge supporting member for positioning in the longitudinal direction of the connector 440 to the cartridge C. The fixed member (not shown) that is a rotation regulating member is also a main body cartridge attachment guiding portion for guiding the cartridge C in the direction crossing the insertion direction of the cartridge C.

Moreover, plural connector holder guides 113*r* having a shape of parallel ribs in the insertion direction of the cartridge C to the apparatus main body 20 are provided to a vicinity of each end portion in the longitudinal direction of the attachment portion of the tag 160 in the cartridge C.

Then, the holder 450 is biased in the direction of the arrow Y by the spring (not shown) as described above. As shown in FIG. 64, when the cartridge C is further inserted, a guide rib 456 that is a main body contact portion provided to the holder 450 abuts the guide 113*r*. On this occasion, the electric contact 442 does not contact the memory tag 160 and the drum frame that retains the memory tag 160. After the cartridge C is further inserted and just before it is attached to a predetermined position of the apparatus main body 200, the contact 442 contacts the contact portion of the memory tag 160. Then, the abutting portion 441 abuts against the contact portion of the memory tag 160. Then, the guide rib 456 reaches the position corresponding to the recess so as to go away from the drum frame 13. On this occasion, the contact 442 and the contact portion of the memory tag 160 are in contact with each other and rub each other until the attachment of the cartridge C is completed.

The tag 160 stores used amount of the cartridge C at any time. The cartridge used amount that is stored in the tag 160 should be judged by the image forming apparatus main body without other special limitation. For example, it may store rotation time of each unit such as a photosensitive drum 10, the charging roller 11, or the developing roller 20, a bias application time to the charging roller 11, the developing roller 20 or others, a residual amount of the toner, the number of printed sheets, the number of dots of an image that is formed on the photosensitive member, an accumulated value of a laser irradiation time for exposing the photosensitive member, a thickness of the photosensitive member, and a combination value of used amount with weighting.

A method of assembling the above-mentioned cartridge C is as follows.

The method of assembling a process cartridge C that is detachably attachable to an electrophotographic image forming apparatus main body 200 is characterized by including:

(a) a developing blade attaching step of attaching a developing blade 29 for regulating developer T on a developing roller 20 to a supporting frame 40 after attaching a magnetic seal member 60 for preventing the developer from leaking at both ends of the developing roller 20 to both ends in the longitudinal direction of the supporting frame 40;

(b) a step of provisionally positioning and installing the supporting frame 40 onto a developing frame 50;

(c) a step of positioning the magnetic seal member 60 by a first end cover 42 and a second end cover 43 when attaching the first end cover 42 and the second end cover 43 to the supporting frame 40 to attach the developing roller 20 to the supporting frame 40, the first end cover 42 rotatably supporting one end of the developing roller 20, the second end cover 43 rotatably supporting the other end of the developing roller 20;

(d) a supporting frame attaching step of rotatably connecting the first end cover 42 to the developing frame 50 by attaching a fixing pin 83;

(e) a first frame connecting step of positioning and fixing a drum frame 13 and the developing frame 50 or a developer frame 21 by a first cover member 80 on one end side in the longitudinal direction; and (f) a second frame connecting step of positioning and fixing the drum frame 13 and the developing frame 50 or the developer frame 21 by a second cover member 81 on the other end side in the longitudinal direction.

Further, a method of remanufacturing the above-mentioned process cartridge C is as follows.

The method of remanufacturing a process cartridge C that is detachably attachable to an electrophotographic image forming apparatus main body 200 includes:

(a) a first cover removing step of removing a first cover member 80 on one end side in the longitudinal direction of the process cartridge C from a drum frame 13 and a developing frame 50 or a developer frame 21;

(b) a second cover removing step of removing a second cover member 81 on the other end side in the longitudinal direction;

(c) a frame separating step of separating the developing frame 50 or the developer frame 21 from the drum frame 13;

(d) a fixing pin removing step of separating the developing frame 50 from the first end cover 42 by removing the fixing pin 83;

(e) a developing roller removing step of removing the first end cover 42 and the second end cover 43 from the supporting frame 40 and removing the developing roller 20;

(f) a developer refilling step of refilling developer T in a developer containing portion 21*x* through a developer supply opening 51 of the developer frame 21 that is exposed when the developing roller 20 is removed from the supporting frame 40;

(g) a step of provisionally positioning the supporting frame 40 to the developing frame 50;

(h) a developing roller attaching step of attaching the first end cover 42 and the second end cover 43 to the supporting frame 40 and rotatably attaching the developing roller 20;

(i) a supporting frame attaching step of attaching a fixing pin 83 so that the first end cover 42 is rotatably connected to the developing frame 50;

(j) a first frame connecting step of positioning and fixing a drum frame 13 and the developing frame 50 or a developer frame 21 by the first cover member 80 on one end side in the longitudinal direction; and (k) a second frame connecting step of positioning and fixing a drum frame 13 and the developing frame 50 or a developer frame 21 by the second cover member 81 on the other end side in the longitudinal direction.

The method of remanufacturing a process cartridge C further includes the steps as follows after the developing roller removing step:

(a) a developing blade and toner regulating member removing step of removing a screw 95 that is fastened at one end in the longitudinal direction of the developing blade 29 for regulating the developer on the developing roller 20 so as to remove the one end in the longitudinal direction of developing blade 29 and a toner regulating member 100 that is attached to one end in the longitudinal direction of the developing blade 29 from the supporting frame 40, and of removing a screw that is fastened at the other end in the longitudinal direction of the developing blade 29 so as to remove the other end in the longitudinal direction of the developing blade 29 and a toner regulating member 100 that is attached to the other end in the longitudinal direction of the developing blade 29 from the supporting frame 40;

(b) the developer refilling step including refilling developer T in a developer containing portion 21*f* through a developer supply opening 51 that is exposed when the developing roller 20, the developing blade 29, and the toner regulating member 100 are removed from the supporting frame 40;

(c) a developing blade positioning step of positioning the developing blade 29 to the supporting frame 40;

(d) a toner regulating member positioning step of positioning the toner regulating member 100 at one end or the other end in the longitudinal direction of the developing blade 29 that is positioned to the supporting frame 40; and (e) a developing blade and toner regulating member attaching step of fastening one end or the other end in the longitudinal direction of the developing blade 29 together with the toner regulating member 100 to the supporting frame 40 by using a screw.

The method of remanufacturing a process cartridge C further includes the steps as follows after the developing roller removing step:

(a) a supporting frame removing step of removing the supporting frame 40 from the developing frame 50 or the developer frame 21;

(b) the developer refilling step including refilling developer T in a developer containing portion 21*f* through a developer supply opening 51 that is exposed when the supporting frame 40 is removed from the developing frame 50 or the developer frame 21; and (c) a step of provisionally positioning and installing the supporting frame 40 onto the developing frame 50 or the developer frame 21.

The method of remanufacturing a process cartridge C further includes a step of gluing a developer seal member 35 to the developer supply opening 51 after the developer refilling step.

The method of remanufacturing a process cartridge C that is detachably attachable to an electrophotographic image forming apparatus main body 200 includes:

(a) a first cover removing step of removing a first cover member 80 on one end side in the longitudinal direction of the process cartridge C from a drum frame 13 and a developing frame 50 or a developer frame 21;

(b) a second cover removing step of removing a second cover member 81 on the other end side in the longitudinal direction;

(c) a frame separating step of separating the developing frame 50 or the developer frame 21 from the drum frame 13;

(d) a shaft removing step of removing a shaft 31, which supports one end of the electrophotographic photosensitive drum 10 and is at least provided at one end in the longitudinal direction of the drum frame 13, from the drum frame 13;

(e) a drum removing step of shifting the electrophotographic photosensitive drum 10 from the drum frame 13 to remove the electrophotographic photosensitive drum 10 from the drum frame 13;

(f) a developer removing step of removing developer T from a developer containing portion 12 that contains developer T that is removed from the electrophotographic photosensitive drum 10 by a cleaning blade 14;

(g) a drum inserting step of inserting a new electrophotographic photosensitive drum 10 into the drum frame 13 in the direction crossing the longitudinal direction of the drum 10, with a shaft portion 10*a*2 provided to one end of the drum 10 being inserted into a bearing portion 30 of the drum frame 13 when the electrophotographic photosensitive drum 10 is inserted into the drum frame 13;

(h) a drum attaching step of attaching a shaft 31 to one end in the longitudinal direction of the drum frame 13 so as to support the other end of the new electrophotographic photosensitive drum 10;

(i) a first frame connecting step of positioning and fixing the drum frame 13 and the developing frame 50 or the developer frame 21 by a first cover member 80 at one end in the longitudinal direction; and (j) a second frame connecting step of positioning and fixing the drum frame 13 and the developing frame 50 or the developer frame 21 by a second cover member 81 at the other end in the longitudinal direction.

The method of remanufacturing a process cartridge C further includes:

(a) a bearing portion removing step of removing a bearing portion 10*a*2, which supports the shaft portion 30 provided to one end of the electrophotographic photosensitive drum 10 and is provided to one end in the longitudinal direction of the drum frame 13, from the drum frame 13; and (b) a bearing portion attaching step of attaching the bearing portion 30 to one end in the longitudinal direction of the drum frame 13 so as to support the shaft portion 10*a*2 provided to one end of the new electrophotographic photosensitive drum 10 in the drum attaching step.

The method of remanufacturing a process cartridge C further includes a cleaning blade removing step of removing the cleaning blade 14 from the drum frame 13.

Further, in the method, the developer removing step includes removing the developer from the removed developer containing portion 12 that contains developer removed from the electrophotographic photosensitive drum 10 by a cleaning blade 14 after removing the cleaning blade 14.

In addition, the second cover member 81 and the developing frame 50 or the developer frame 21 are connected to each other by injecting a molten resin 90 into the resin bonding portion 81*c* that is provided to the second cover member 81 and the developing frame 50 or the developer frame 21, and the second frame connecting process includes:

(a) a step of press-fitting the first press fitting portion 110*a* of the connecting member 110 having the first press fitting portion 110*a* and the second press fitting portion 110*b* to fit in the resin bonding portion 81*c* of the second cover member 81 for fixing; and (b) a step of press-fitting the second press fitting portion 110*b* of the connecting member 110 to fit in the resin bonding portion 81*c* of the developing frame 50 or the developer frame 21.

Moreover, in the above-mentioned method of remanufacturing the process cartridge, if the memory tag 160 that stores information about the process cartridge C is provided to the process cartridge C, the memory tag 160 is exchanged if necessary.

The method of remanufacturing a process cartridge C that is detachable attachable to an electrophotographic image forming apparatus main body 200 includes:

(a) a first cover removing step of removing a first cover member 80 at one end in the longitudinal direction of the process cartridge C from a drum frame 13 and a developing frame 50 or a developer frame 21;

(b) a second cover removing step of removing a second cover member 81 at the other end in the longitudinal direction;

(c) a frame separating step of separating the developing frame 50 or the developer frame 21 from the drum frame 13;

(d) a shaft removing step of removing a shaft 31 that supports one end of an electrophotographic photosensitive drum 10 and is at least provided at one end in the longitudinal direction of the drum frame 13 from the drum frame 13;

(e) a drum removing step of removing the electrophotographic photosensitive drum 10 from the drum frame 13;

(f) a step of removing a rib of the drum frame 13 that is arranged on a surface of a cleaning blade 14 facing the electrophotographic photosensitive drum 10;

(g) a step of removing the cleaning blade 14 from the drum frame 13 after removing the rib;

(h) a developer removing step of removing a developer from a developer containing portion 12 that contains the developer that is removed from the electrophotographic photosensitive drum 10 by the cleaning blade 14 after removing the electrophotographic photosensitive drum 10;

(i) a step of sealing between the cleaning blade 14 and the drum frame 13;

(j) a step of attaching the cleaning blade 14 to the drum frame 13;

(k) a drum inserting step of inserting a new electrophotographic photosensitive drum 10 into the drum frame 13 in the direction crossing the longitudinal direction of the electrophotographic photosensitive drum 10, with a shaft portion 10*a*2 provided to one end of the electrophotographic photosensitive drum 10 being inserted into a bearing portion 30 of the drum frame 13 when the electrophotographic photosensitive drum 10 is inserted into the drum frame 13;

(l) a drum attaching step of attaching a shaft 31 to one end in the longitudinal direction of the drum frame 13 so as to support the other end of the new electrophotographic photosensitive drum 10;

(m) a first frame connecting step of positioning and fixing the drum frame 13 and the developing frame 50 or the developer frame 21 by a first cover member 80 at one end in the longitudinal direction; and (n) a second frame connecting step of positioning and fixing the drum frame 13 and the developing frame 50 or the developer frame 21 by a second cover member 81 at the other end in the longitudinal direction.

The method of remanufacturing a process cartridge C further includes:

(a) a bearing portion removing step of removing a bearing portion 30, which supports the shaft portion 10*a*2 provided to one end of the electrophotographic photosensitive drum 10 and is provided to one end in the longitudinal direction of the drum frame 13, from the drum frame 13; and (b) a bearing portion attaching step of attaching the bearing portion 30 to one end in the longitudinal direction of the drum frame 13 so as to support the shaft portion 10*a*2 provided to one end of the new electrophotographic photosensitive drum 10 in the drum attaching step.

Further, in the method, the sealing between the cleaning blade 14 and the drum frame 13 is performed by injecting a fluid material 125.

Further, in the method, the sealing between the cleaning blade 14 and the drum frame 13 is performed by gluing an adhesive tape 126.

Further, in the method, the sealing between the cleaning blade 14 and the drum frame 13 is performed by disposing a sponge member 127 between the cleaning blade 14 and the drum frame 13.

In addition, the operation for seal between the cleaning blade 14 and the drum frame 13 includes injection of the fluid material 125 in both ends in the longitudinal direction.

In the above-described embodiment of the assembling method and the remanufacturing method, an example of a process cartridge is described in which the unit A and the cover member 81 are fixed to each other by utilizing a bonding process with the molten resin. However, without being bound to this method, other bonding methods such as welding or caulking may be adopted.

Furthermore, although the method of fixing with a screw for portions except for the portion bonded with the molten resin has been described, any other methods including welding and caulking can be adopted as long as plural parts can be fixed.

Furthermore, each process in the remanufacturing method of the present invention is not limited to the steps in the described order, but the order can be changed if necessary.

The present invention includes any cases as described below.

(1) The case where only parts removed from one process cartridge are used for remanufacturing a process cartridge.

(2) The case where if there is a part that cannot be reused because the service life expires or it is damaged in the case (1), a new part or a part removed from another cartridge is used for remanufacturing a process cartridge.

(3) The case where parts removed from plural process cartridges are provisionally collected for each type of the part before remanufacturing a process cartridge. Then, a necessary part is selected from the collected parts for each type and is reused for remanufacturing a process cartridge.

(4) The case where if there is a part that cannot be reused because the service life expires or it is damaged in the case (3), a new part is used for remanufacturing a process cartridge.

Furthermore, the part means a structure described in the following claims, i.e., a part that constitutes a certain portion of the cartridge. It also includes the case where it is a minimum unit or a unit that can be disassembled.

As described above, according to the present invention, simple methods for assembling and remanufacturing a process cartridge can be realized.

While the invention has been described with reference to the structure disclosed herein, it is not confined to the details set forth and this application is intended to cover such modifications or changes as may come within the purposes of the improvements or the scope of the following claims.

What is claimed is:

1. A method of assembling a process cartridge that is detachably attachable to a main body of an electrophotographic image forming apparatus, said method comprising:

(a) a developing blade attaching step of attaching a developing blade for regulating a developer on a developing roller, to a supporting frame after attaching magnetic seal members to both longitudinal ends of the supporting frame, the magnetic seal members preventing the developer from leaking at both ends of the developing roller;

(b) a step of provisionally positioning and installing the supporting frame onto a developing frame;

(c) a step of positioning the magnetic seal members by a first end cover and a second end cover when attaching the first end cover and the second end cover to the supporting frame to attach the developing roller to the supporting frame, the first end cover rotatably supporting one end of the developing roller, the second end cover rotatably supporting the other end of the developing roller;

(d) a supporting frame attaching step of rotatably connecting the supporting frame to the developing frame by attaching a fixing pin;

(e) a first cover connecting step of positioning and fixing a drum frame and one of the developing frame and a developer frame by a first cover member on one longitudinal end side of the process cartridge; and (f) a second cover connecting step of positioning and fixing the drum frame and one of the developing frame and the developer frame by a second cover member on the other longitudinal end side of the process cartridge.

2. A method of remanufacturing a process cartridge that is detachably attachable to a main body of an electrophotographic image forming apparatus, said method comprising:

(a) a first cover removing step of removing a first cover member from a drum frame and one of a developing frame and a developer frame on one longitudinal end side of the process cartridge;

(b) a second cover removing step of removing a second cover member on the other longitudinal end side of the process cartridge;

(c) a frame separating step of separating one of the developing frame and the developer frame from the drum frame;

(d) a fixing pin removing step of separating the developing frame from a first end cover by removing a fixing pin;

(e) a developing roller removing step of removing the first end cover and a second end cover from a supporting frame connected to the developing frame to remove a developing roller supported by the first and second end covers and then separating the supporting frame from the developing frame;

(f) a developer refilling step of refilling a developer in a developer containing portion of the developer frame through a developer supply opening of the developer frame that is exposed by removing the developing roller from the supporting frame;

(g) a step of provisionally positioning the supporting frame on the developing frame;

(h) a developing roller attaching step of rotatably attaching the developing roller by attaching the first end cover and the second end cover to the supporting frame;

(i) a supporting frame attaching step of rotatably connecting the first end cover to the developing frame by attaching the fixing pin;

(j) a first cover connecting step of positioning and fixing the drum frame and one of the developing frame and a developer frame by the first cover member on one longitudinal end side of the process cartridge; and (k) a second cover connecting step of positioning and fixing the drum frame and one of the developing frame and the developer frame by the second cover member on the other longitudinal end side of the process cartridge.

3. A method of remanufacturing a process cartridge according to claim 2, further comprising, after said developing roller removing step:

(a) a developing blade and toner regulating member removing step of removing, from the supporting frame, one longitudinal end of a developing blade for regulating the developer on the developing roller and a toner regulating member that is attached to the one longitudinal end of the developing blade, by removing a screw that is fastened at the one longitudinal end of the developing blade, and of removing, from the supporting frame, the other longitudinal end of the developing blade and the toner regulating member that is attached to the other longitudinal end of the developing blade, by removing a screw that is fastened at the other longitudinal end of the developing blade;

(b) said developer refilling step including refilling the developer in the developer containing portion through the developer supply opening that is exposed by removing the developing roller, the developing blade, and the toner regulating members from the supporting frame;

(c) a developing blade positioning step of positioning the developing blade with respect to the supporting frame;

(d) a toner regulating member positioning step of positioning the toner regulating member at the one longitudinal end of the developing blade that is positioned with respect to the supporting frame, and of positioning the toner regulating member at the other longitudinal end of the developing blade; and (e) a developing blade and toner regulating member attaching step of fastening the one longitudinal end of the developing blade together with the toner regulating member to the supporting frame by using a screw, and of fastening the other longitudinal end of the developing blade together with the toner regulating member to the supporting frame by using a screw.

4. A method of remanufacturing a process cartridge according to claim 2 or 3, further comprising, after said developing roller removing step:

said developer refilling step including refilling the developer in the developer containing portion through the developer supply opening that is exposed by removing the supporting frame from one of the developing frame and the developer frame; and a step of provisionally positioning and installing the supporting frame onto the developing frame.

5. A method of remanufacturing a process cartridge according to claim 4, further comprising a step of providing a developer seal member on the developer supply opening after said developer refilling step.

6. A method of remanufacturing a process cartridge according to claim 2, wherein said second frame connecting step includes:

(a) a step of press-fitting a first press fitting portion of a connecting member to a resin bonding portion of the second cover member; and (b) a step of press-fitting a second press fitting portion of the connecting member to a resin bonding portion of one of the developing frame and the developer frame.

7. A method of remanufacturing a process cartridge that is detachably attachable to a main body of an electrophotographic image forming apparatus, said method comprising:

(a) a first cover removing step of removing a first cover member from a drum frame and one of a developing frame and a developer frame on one longitudinal end side of the process cartridge;

(b) a second cover removing step of removing a second cover member on the other longitudinal end side of the process cartridge;

(c) a frame separating step of separating one of the developing frame and the developer frame from the drum frame;

(d) a shaft removing step of removing a shaft, which supports one end of an electrophotographic photosensitive drum and is provided at least at one longitudinal end of the drum frame, from the drum frame;

(e) a drum removing step of removing the electrophotographic photosensitive drum from the drum frame;

(f) a step of removing a rib of the drum frame that is arranged on a surface of a cleaning blade opposed to the electrophotographic photosensitive drum;

(g) a step of removing the cleaning blade from the drum frame after removing the rib;

(h) a developer removing step of removing a developer from a developer containing portion of the drum frame that contains the developer that is removed from the electrophotographic photosensitive drum by the cleaning blade after removing the electrophotographic photosensitive drum;

(i) a step of attaching the cleaning blade to the drum frame;

(j) a step of sealing a space between the cleaning blade and the drum frame;

(k) a drum inserting step of inserting a new electrophotographic photosensitive drum into the drum frame in a direction crossing the longitudinal direction of the drum, with a shaft portion provided on one end of the new electrophotographic photosensitive drum being inserted into a bearing portion of the drum frame when the new electrophotographic photosensitive drum is inserted into the drum frame;

(l) a drum attaching step of attaching the shaft to one longitudinal end of the drum frame so as to support the other end of the new electrophotographic photosensitive drum;

(m) a first cover connecting step of positioning and fixing the drum frame and one of the developing frame and the developer frame by the first cover member on one longitudinal end side of the process cartridge; and (n) a second cover connecting step of positioning and fixing the drum frame and one of the developing frame and the developer frame by the second cover member on the other longitudinal end side.

8. A method of remanufacturing a process cartridge according to claim 7, further comprising:

(a) a bearing portion removing step of removing the bearing portion from the drum frame, the bearing portion supporting the shaft portion provided on the one end of the electrophotographic photosensitive drum and being provided on one longitudinal end of the drum frame; and (b) a bearing portion attaching step of attaching the bearing portion to the one longitudinal end of the drum frame so as to support a shaft portion of the new electrophotographic photosensitive drum provided on the one end of the new electrophotographic photosensitive drum in said drum attaching step.

9. A method of remanufacturing a process cartridge according to claim 7 or 8, wherein said sealing between the cleaning blade and the drum frame is performed by injecting a fluid material.

10. A method of remanufacturing a process cartridge according to claim 7 or 8, wherein said sealing between the cleaning blade and the drum frame is performed using an adhesive tape.

11. A method of remanufacturing a process cartridge according to claim 7 or 8, wherein said sealing between the cleaning blade and the drum frame is performed by disposing a sponge member between the cleaning blade and the drum frame.

12. A method of remanufacturing a process cartridge that is detachably attachable to a main body of an electrophotographic image forming apparatus, said method comprising:

(a) a first cover removing step of removing a first cover member from a drum frame and one of a developing frame and a developer frame on one longitudinal end side of the process cartridge;

(b) a second cover removing step of removing a second cover member on the other longitudinal end side of the process cartridge;

(c) a frame separating step of separating one of the developing frame and the developer frame from the drum frame;

(d) a fixing pin removing step of separating the developing frame from a first end cover by removing a fixing pin;

(e) a developing roller removing step of removing the first end cover and a second end cover from a supporting frame connected to the developing frame to remove a developing roller and then separating the supporting frame from the developing frame;

(f) a developer refilling step of refilling a developer in a developer containing portion of the developer frame through a developer supply opening of the developer frame that is exposed by removing the developing roller from the supporting frame;

(g) a step of provisionally positioning the supporting frame on the developing frame;

(h) a developing roller attaching step of rotatably attaching the developing roller by attaching the first end cover and the second end cover to the supporting frame;

(i) a supporting frame attaching step of rotatably connecting the first end cover to the developing frame by attaching the fixing pin;

(j) a first cover connecting step of positioning and fixing a drum frame and one of the developing frame and the developer frame by the first cover member on one longitudinal end side of the process cartridge; and (k) a second cover connecting step of positioning and fixing the drum frame and one of the developing frame and the developer frame by the second cover member on the other longitudinal end side of the process cartridge.

13. A method of remanufacturing a process cartridge according to claim 12, further comprising:

(a) a bearing portion removing step of removing a bearing portion from the drum frame, the bearing portion supporting a shaft portion provided on the one end of the electrophotographic photosensitive drum and being provided to one longitudinal end of the drum frame; and (b) a bearing portion attaching step of attaching the bearing portion to the one longitudinal end of the drum frame so as to support a shaft portion provided on the one end of a new electrophotographic photosensitive drum in a new electrophotographic photosensitive drum attaching step.

14. A method of remanufacturing a process cartridge according to claim 12 or 13, further comprising the step of sealing a space between a cleaning blade and the drum frame by injecting a fluid material.

15. A method of remanufacturing a process cartridge according to claim 12 or 13, further comprising the step of sealing a space between a cleaning blade and the drum frame by using an adhesive tape.

16. A method of remanufacturing a process cartridge according to claim 12 or 13, further comprising the step of sealing a space between a cleaning blade and the drum frame by disposing a sponge member between the cleaning blade and the drum frame.

17. A connecting member for connecting a developing frame and a developer frame of a process cartridge that is detachably attachable to a main body of an electrophotographic image forming apparatus, wherein the process cartridge includes an electrophotographic photosensitive drum, a drum frame configured and positioned to support the electrophotographic photosensitive drum, a developing roller configured and positioned to develop an electrostatic latent image formed on the electrophotographic photosensitive drum by using a developer, a supporting frame configured and positioned to attach a first end cover and a second end cover that rotatably support the developing roller, a developing frame that movably supports the supporting frame, a fixing pin that rotatably fixes the first end cover to the developing frame, a developer frame that has a developer containing portion configured to contain the developer and to supply the developer to the developing roller through a toner supply opening and is connected to the developing frame via a first developing frame connection portion and a second developing frame connection portion positioned with the toner supplying opening interposed therebetween, at least one of the first developing frame connection portion and the second developing frame connection portion not having a flange shape, a developer seal member configured and positioned to seal the toner supplying opening and being detachable therefrom, a first cover member configured and positioned to position and fix the drum frame to one of the developing frame and the developer frame on one end side in a longitudinal direction thereof, and a second cover member configured and positioned to position and fix the frames on the other end side in the longitudinal direction thereof, said connecting member comprising:

a biasing member configured and positioned to bias the developing frame and the developer frame to each other; and a biasing member configured and positioned to bias the developing frame to the developer frame.

18. A connecting member according to claim 17, wherein said biasing member configured and positioned to bias the developing frame and the developer frame to each other and said biasing member configured and positioned to bias the developing frame to the developer frame are made as one unit.

19. A connecting member according to claim 17 or 18, wherein said biasing member configured and positioned to bias the developing frame and the developer frame to each other is glued or fastened to at least one of the developing frame and the developer frame.

* * * * *

UNITED STATES PATENT AND TRADEMARK OFFICE

CERTIFICATE OF CORRECTION

PATENT NO. : 7,024,131 B2
APPLICATION NO. : 10/701467
DATED : April 4, 2006
INVENTOR(S) : Noriyuki Komatsu et al.

It is certified that error appears in the above-identified patent and that said Letters Patent is hereby corrected as shown below:

COLUMN 5
Line 30, “bean” should read --beam--.

COLUMN 6
Line 15, “an” should read --a--.

COLUMN 7
Line 65, “ ‘a” should read --a--.

COLUMN 11
Line 7, “an” should read --a--.

COLUMN 13
Line 22, “a” should read --an--.

COLUMN 14
Line 17, “efficiency" should read --efficient--.

COLUMN 15
Line 23, “cuter” should read --cutter--.
Line 28, “frame.” should read --frame--.

COLUMN 22
Line 55, “grove” should read --groove--.

Signed and Sealed this

Thirty-first Day of July, 2007

JON W. DUDAS
*Director of the United States Patent and Trademark Office*